US012449215B2

(12) United States Patent
Mitchell et al.

(10) Patent No.: US 12,449,215 B2
(45) Date of Patent: Oct. 21, 2025

(54) AUTOMATED MISSILE LAUNCHER RELOADER

(71) Applicant: Lockheed Martin Corporation, Bethesda, MD (US)

(72) Inventors: Steven Wylie Mitchell, Bethesda, MD (US); Timothy Michael Karl Engel, Bethesda, MD (US); Weetek Foo, Bethesda, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 18/712,583

(22) PCT Filed: Nov. 28, 2022

(86) PCT No.: PCT/US2022/080473
§ 371 (c)(1),
(2) Date: May 22, 2024

(87) PCT Pub. No.: WO2023/234975
PCT Pub. Date: Dec. 7, 2023

(65) Prior Publication Data

US 2025/0012528 A1 Jan. 9, 2025

Related U.S. Application Data

(60) Provisional application No. 63/284,180, filed on Nov. 30, 2021, provisional application No. 63/284,188, filed on Nov. 30, 2021.

(51) Int. Cl.
*F41A 9/01* (2006.01)
*B63G 5/00* (2006.01)
(Continued)

(52) U.S. Cl.
CPC ..... *F41A 9/01* (2013.01); *B63G 5/00* (2013.01); *F41A 9/02* (2013.01); *F41F 3/052* (2013.01)

(58) Field of Classification Search
CPC ... B63G 3/00; B63G 3/02; B63G 3/04; B63G 3/06; B63G 5/00; F41A 9/00; F41A 9/01; F41A 9/02; F41F 3/052
(Continued)

(56) References Cited

U.S. PATENT DOCUMENTS 2,745,317 A * 5/1956 Stanton ..... F41A 9/21 89/34
2,855,828 A * 10/1958 Girouard ..... F41A 9/54 89/21
3,218,930 A * 11/1965 Girouard ..... F41A 9/73 89/45

FOREIGN PATENT DOCUMENTS

FR 2 102 840 A5 4/1972
FR 2 597 065 A5 10/1987
RU 2 578 917 C1 3/2016

OTHER PUBLICATIONS

PCT International Search Report and the Written Opinion of the International Searching Authority, or the Declaration for PCT Application No. PCT/US2022/080473 dated Jan. 30, 2024 (Jan. 30, 2024), 13 pages.

* cited by examiner

*Primary Examiner* — Bret Hayes
(74) *Attorney, Agent, or Firm* — Baker Botts L.L.P.

(57) ABSTRACT

In one embodiment, a method of automated missile launcher reloading includes aligning one or more collars of a shelving system with a path of a canister and activating one or more rollers of the shelving system to translate the canister into the one or more collars. The method also includes coupling
(Continued)

a first collar of the one or more collars to the canister and adjusting the one or more collars to align the canister with a path of a launcher cell. The method further includes translating the one or more collars into the path of the launcher cell to feed the canister into the launcher cell.

20 Claims, 84 Drawing Sheets

(51) Int. Cl.
*F41A 9/02* (2006.01)
*F41F 3/052* (2006.01)
(58) Field of Classification Search
USPC ..... 89/45, 46, 47
See application file for complete search history.

AUTOMATED MISSILE LAUNCHER RELOADER

REFERENCE TO RELATED APPLICATIONS

The present nonprovisional application is a U.S. National Stage Filing under 35 U.S.C. § 371 of International Patent Application Serial No. PCT/US2022/080473 filed Nov. 28, 2022, which claims priority to U.S. Provisional Application No. 63/284,180, filed Nov. 30, 2021, entitled "Automated Missile Launcher Reloader", and U.S. Provisional Application No. 63/284,188, filed Nov. 30, 2021, entitled "Automated Missile Launcher Reloader", all of which are incorporated by reference herein in their entirety.

TECHNICAL FIELD

This disclosure generally relates to missile launchers, and more specifically to an automated missile launcher reloader.

BACKGROUND

Conventional vertical launching systems may be used to hold and fire missiles on platforms (e.g., mobile naval platforms such as ship surfaces and submarines). Each vertical launch system includes a number of cells to hold missiles. In certain environments such as during battle at sea, the cells of the vertical launching system need to quickly reload. However, conventional reloading of launcher cells can be slow and manpower intensive.

SUMMARY OF THE DISCLOSURE

According to a first embodiment, a method of automated missile launcher reloading includes positioning a canister positioning device proximate to a canister. The canister positioning device is coupled to a pivot arm by one or more pivot joints and the pivot arm is coupled to a tower. The method also includes coupling the canister positioning device to the canister, attaching a hoist cable to the canister, and raising the pivot arm on the tower from a first position on the tower to a second position on the tower. The method further includes adjusting a positioning of the pivot arm to position the canister proximate to a launcher cell, adjusting a positioning of the pivot joints to align the canister with the launcher cell, and lowering the hoist cable to lower the canister into the launcher cell.

In certain embodiments, coupling the canister positioning device to the canister includes engaging one or more clamps of the canister positioning device. In some embodiments, adjusting the positioning of the pivot arm includes adjusting a positioning of a counterbalance coupled to the pivot arm.

In certain embodiments, the method includes determining a positional alignment of the canister with respect to the launcher cell in a first direction and in a second direction opposite to the first direction, and/or determining an angular alignment of the canister with respect to the launcher cell. In some embodiments, adjusting the positioning of the pivot joints includes adjusting the positioning of the pivot joints to align the canister with the launcher cell based on the positional alignment of the canister and the angular alignment of the canister.

In certain embodiments, after adjusting the positioning of the pivot joints, the method includes lowering the pivot arm on the tower from the second position on the tower to the first position on the tower such that the canister positioning device contacts the launcher cell.

In some embodiments, after the canister is fully positioned within the launcher cell, the method includes releasing the hoist cable from the canister. In certain embodiments, after releasing the hoist cable from the canister, the method includes raising the pivot arm on the tower from the first position on the tower to the second position on the tower such that the canister positioning device clears an alignment flange assembly of the launcher cell.

In some embodiments, after the canister is fully positioned within the launcher cell, the method includes removing the canister from the launcher cell. In certain embodiments, removing the canister from the launcher cell includes positioning the canister positioning device proximate to the canister positioned within the launcher cell, attaching the hoist to the first end of the canister, and/or raising the hoist cable to raise the canister from the launcher cell to remove the canister from the launcher cell.

According to the first embodiment, an automated missile launcher reloader system includes a tower, a pivot arm coupled to the tower, a canister positioning device coupled to the pivot arm by one or more joints, a hoist including a hoist cable, a launcher cell, and a control system. The control system is configured to provide control signals to the pivot arm and the hoist to control the pivot arm and the hoist to perform actions. The actions include positioning the canister positioning device proximate to a canister, coupling the canister positioning device to the canister, and attaching the hoist cable from the hoist to the canister, The actions also include raising the pivot arm on the tower from a first position on the tower to a second position on the tower and adjusting a positioning of the pivot arm to position the canister proximate to the launcher cell. The actions further include adjusting a positioning of the pivot joints to align the canister with the launcher cell and lowering the hoist cable to lower the canister into the launcher cell.

According to the first embodiment, one or more computer-readable non-transitory storage media embody instructions that, when executed by a processor, cause the processor to perform operations. The operations include positioning a canister positioning device proximate to a canister, coupling the canister positioning device to the canister, and attaching a hoist cable from a hoist to the canister. The operations also include raising a pivot arm on a tower from a first position on the tower to a second position on the tower and adjusting a positioning of the pivot arm to position the canister proximate to a launcher cell. The operations further include adjusting a positioning of one or more pivot joints to align the canister with the launcher cell and lowering the hoist cable to lower the canister into the launcher cell.

According to a second embodiment, a method of automated missile launcher reloading includes coupling a canister positioning device to one or more overhead load-moving devices, configuring the canister positioning device to be positioned proximate to a canister and coupled to the canister, and providing control signals to the overhead load-moving devices to control the overhead load-moving devices. The overhead load-moving devices may be configured to i) decrease a distance between the canister positioning device and the overhead load-moving devices, ii) adjust a positioning of the canister positioning device to align the canister with a launcher cell, and iii) translate towards the launcher cell to position the canister within the launcher cell.

In certain embodiments, the method includes retracting one or more coupling elements of the canister positioning device to disconnect from the canister when the canister becomes positioned within the launcher cell. In some embodiments, the method includes, after retracting each of the coupling elements of the canister positioning device, exerting a force to a first side of the canister to further position the canister within the launcher cell. The first side is opposite to a second side of the canister that initially is positioned within the launcher cell.

In certain embodiments, coupling the canister positioning device to the canister includes engaging one or more clamps of the canister positioning device such that the canister positioning device is coupled with the canister. In some embodiments, engaging one or more clamps of the canister positioning device includes engaging the clamps with the canister to couple the canister positioning device with the canister. In certain embodiments, coupling the canister positioning device to the canister further includes releasing clamps previously coupling the canister to a shelving system.

In some embodiments, the method includes, after decreasing the distance between the canister positioning device and the overhead load-moving devices, repositioning a shelf of a shelving system that previously stored the canister such that access to a further canister is provided.

In certain embodiments, after the canister is fully positioned within the launcher cell, the method includes removing the canister from the launcher cell. Removing the canister from the launcher cell may include positioning the canister positioning device proximate to the canister positioned within the launcher cell, adjusting the positioning of the canister positioning device to align the canister positioning device with the canister within the launcher cell, coupling the canister positioning device to the canister, and/or translating the overhead load-moving devices away from the launcher cell to remove the canister from the launcher cell.

According to the second embodiment, an automated missile launcher reloader system includes one or more overhead load-moving devices, a canister positioning device coupled to the overhead load-moving devices, a launcher cell, and a control system configured to provide control signals to the overhead load-moving devices to control the overhead load-moving devices to perform actions. The actions include positioning the canister positioning device proximate to a canister, coupling the canister positioning device to the canister, decreasing a distance between the canister positioning device and the overhead load-moving devices, adjusting a positioning of the canister positioning device to align the canister with the launcher cell, and/or translating the overhead load-moving devices towards the launcher cell to position the canister within the launcher cell.

According to the second embodiment, one or more computer-readable non-transitory storage media embody instructions that, when executed by a processor, cause the processor to perform operations. The operations include coupling a canister positioning device to one or more overhead load-moving devices, configuring the canister positioning device to be positioned proximate to a canister and coupled to the canister, and providing control signals to the overhead load-moving devices to control the overhead load-moving devices. The overhead load-moving devices may be configured to i) decrease a distance between the canister positioning device and the overhead load-moving devices, ii) adjust a positioning of the canister positioning device to align the canister with a launcher cell, and iii) translate towards the launcher cell to position the canister within the launcher cell.

According to a third embodiment, a method of automated missile launcher reloading includes adjusting a vertical positioning of a first platform of a shelving system to align the first platform with a launcher cell, extending a sliding portion of the first platform towards the launcher cell, and coupling a coupling bracket of the first platform to a first canister at a first end of the sliding portion. The method also includes translating the coupling bracket to a second end of the sliding portion, opposite the first end, to remove the first canister from the first launcher cell, retracting the sliding portion of the first platform from the first launcher cell to further remove the first canister from the first launcher cell, and decoupling the coupling bracket of the first platform from the first canister. The method further includes adjusting a vertical positioning of a second platform to match the vertical positioning of the first platform, and/or translating the first canister from the first platform through the second to the third platform.

In certain embodiments, the method includes extracting a second canister from a first shelf of the shelving system by positioning the second canister on the first platform, coupling the coupling bracket of the first platform to the second canister at a first end of the sliding portion, and/or extending the sliding portion of the first platform towards the first launcher cell to position the second canister within the launcher cell. In some embodiments, prior to extending the sliding portion of the first platform towards the first launcher cell, the method includes adjusting the vertical positioning of the first platform to align the first platform with the first launcher cell.

In certain embodiments, the method includes decoupling the coupling bracket of the first platform from the second canister, retracting the sliding portion of the first platform from the first cell, and/or retracting the coupling bracket to a stow position. In some embodiments, the method includes translating the first canister from the second platform to the first platform, translating the first canister from the first platform to the first shelf of the shelving system, and/or adjusting the vertical positioning of the first platform, and the second platform to a stow position.

In certain embodiments, prior to translating the first canister from the second platform to the first platform, the method includes adjusting the vertical positioning of the first platform to match the vertical positioning of the second platform. In some embodiments, prior to coupling the coupling bracket of the first platform to the first canister, the method includes extending the coupling bracket towards to the first end of the sliding portion.

According to the third embodiment, an automated missile launcher reloader system includes a shelving system. The shelving system includes a first platform including a first sliding portion and a coupling bracket, a second platform, one or more shelves, a launcher cell, and a control system configured to provide control signals to the shelving system to control the shelving system to perform actions. The actions include adjusting a vertical positioning of the first platform to align the first platform with the launcher cell, extending the sliding portion of the first platform towards the launcher cell, coupling the coupling bracket of the first platform to a first canister at a first end of the sliding portion, translating the coupling bracket to a second end of the sliding portion, opposite the first end, to remove the first canister from the first launcher cell, retracting the sliding portion of the first platform from the first launcher cell to further remove the first canister from the first launcher cell, decoupling the coupling bracket of the first platform from the first canister, adjusting a vertical positioning of the second platform to match the vertical positioning of the first platform, and/or translating the first canister from the first platform to the second platform.

According to the third embodiment, one or more computer-readable non-transitory storage media embody instructions that, when executed by a processor, cause the processor to perform operations. The operations include adjusting a vertical positioning of a first platform to align the first platform with a launcher cell, extending a sliding portion of the first platform toward the launcher cell, coupling a coupling bracket of the first platform to a first canister at a first end of the sliding portion, translating the coupling bracket to a second end of the sliding portion, opposite the first end, to remove the first canister from the first launcher cell, retracting the sliding portion of the first platform from the first launcher cell to further remove the first canister from the first launcher cell, decoupling the coupling bracket of the first platform from the first canister, adjusting a vertical positioning of the second platform to match the vertical positioning of the first platform, and/or translating the first canister from the first platform to the second platform.

According to a fourth embodiment, a method of automated missile launcher reloading includes aligning one or more collars of a shelving system with the path of a canister and activating one or more rollers of the shelving system to translate the canister into the one or more collars. The method also includes coupling a first collar of the one or more collars to the canister, adjusting the one or more collars to align the canister with a path of a launcher cell, and translating the one or more collars into the path of the launcher cell to feed the canister into the launcher cell.

In certain embodiments, aligning the one or more collars of the shelving system with the path of the canister includes adjusting a positioning of one or more linear actuators and one or more overhead load-moving devices of the shelving system. In some embodiments, coupling the first collar of the one or more collars to the canister includes engaging one or more clamps of the first collar or applying brakes to the one or more rollers. In certain embodiments, adjusting the one or more collars to align the canister with the path of the launcher cell includes rotating and tilting the one or more collars until the canister is aligned with an axis of the launcher cell.

In some embodiments, the method includes coupling one or more lifting lugs to the canister, lowering a push bar connected to a sliding beam of the shelving system to couple the push bar to the one or more lifting lugs, and/or translating the push bar along the sliding beam to fully position the canister within the launcher cell.

In certain embodiments, the method includes uncoupling the first collar from the canister after translating the one or more collars into the path of the launcher cell. In some embodiments, the method includes translating a sliding beam into the path of the launcher cell, wherein the sliding beam moves independently from the one or more collars and the canister.

According to the fourth embodiment, an automated missile launcher reloader system includes a shelving system that includes one or more collars and one or more rollers. The automated missile launcher reloader system also includes a canister, a launcher cell, and a control system. The control system is configured to provide control signals to the shelving system to control the one or more collars and the one or more rollers to perform actions. The actions include aligning the one or more collars of the shelving system with a path of the canister and activating the one or more rollers of the shelving system to translate the canister into the one or more collars. The actions also include coupling a first collar of the one or more collars to the canister, adjusting the one or more collars to align the canister with a path of the launcher cell, and translating the one or more collars into the path of the launcher cell to feed the canister into the launcher cell.

According to the fourth embodiment, one or more computer-readable non-transitory storage media embody instructions that, when executed by a processor, cause the processor to perform operations. The operations include aligning one or more collars of a shelving system with a path of a canister and activating one or more rollers of the shelving system to translate the canister into the one or more collars. The operations also include coupling a first collar of the one or more collars to the canister, adjusting the one or more collars to align the canister with a path of a launcher cell, and translating the one or more collars into the path of the launcher cell to feed the canister into the launcher cell.

Technical advantages of certain embodiments described herein may include one or more of the following. In certain embodiments, the automated missile launcher reloader described herein reduces the canister loading time. In some embodiments, the automated missile launcher reloader described herein reduces the crew required to facilitate reloading. In some embodiments, the automated missile launcher reloader described herein increases the safety of the crew by automating one or more actions. Certain embodiments of this disclosure improve reloading of a launcher cell on a ship at sea. Certain systems and methods described herein improve the efficiency of the missile launcher reloader.

Other technical advantages will be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

For a more complete understanding of the disclosed embodiments and their features and advantages, reference is now made to the following description, taken in conjunction with the accompanying drawings, in which.

DETAILED DESCRIPTION OF THE DISCLOSURE

To facilitate a better understanding of the present disclosure, the following examples of certain embodiments are given. In no way should the following examples be read to limit or define the scope of the disclosure. Embodiments of the present disclosure and its advantages may be best understood by referring to the included FIGS. 1 through 27, where like numbers are used to indicate like and corresponding parts.

Figure 1:
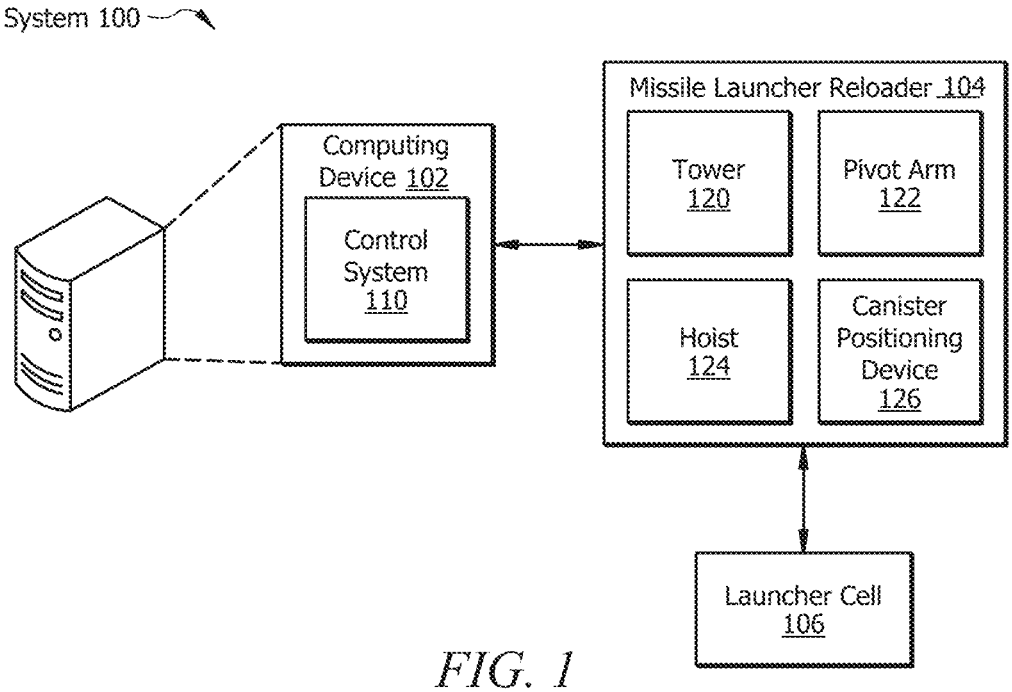
FIG. 1 illustrates a system for a missile launcher reloader, in accordance with a first embodiment.

FIG. 1 illustrates a system 100 for a missile launcher reloader 104, in accordance with a first embodiment. System 100 or portions thereof may be associated with an entity, which may include any entity, such as a business, company, or enterprise, that is associated with missile launcher reloaders. For example, system 100 may be associated with the United States Armed Forces (e.g., the Navy, the Army, the Air Force, etc.). The components of system 100 may include any combination of hardware, firmware, and software. For example, the components of system 100 may use one or more elements of the computer system of FIG. 28.

In the illustrated embodiment of FIG. 1, system 100 includes a computing device 102, missile launcher reloader 104, and a launcher cell 106. The computing device 102 of system 100 includes a control system 110. In certain embodiments, control system 110 is included by a memory of computing device 102. In some embodiments, control system 110 includes a computer-executable program (software) that is executed by a processor of computing device 102. In the illustrated embodiment of FIG. 1, computing device 102 is in communication with the missile launcher reloader 104. Missile launcher reloader 104 of system 100 includes a tower 120, a pivot arm 122, a hoist 124, and a canister positioning device 126. In certain embodiments, missile launcher reloader 104 of system 100 is automated. For example, missile launcher reloader 104 may perform certain actions in response to one or more signals received from computing device 102 without needing human control.

Control system 110 may be in communication with any portion of missile launcher reloader 104, including tower 120, pivot arm 122, hoist 124, and canister positioning device 126. In certain embodiments, control system 110 is configured to provide control signals to missile launcher reloader 104 to control the actions of missile launcher reloader 104. For example, control system 110 may be configured to provide control signals to pivot arm 122 and hoist 124 to control pivot arm 122 and hoist 124 to perform certain actions, as described further herein.

Figure 2:
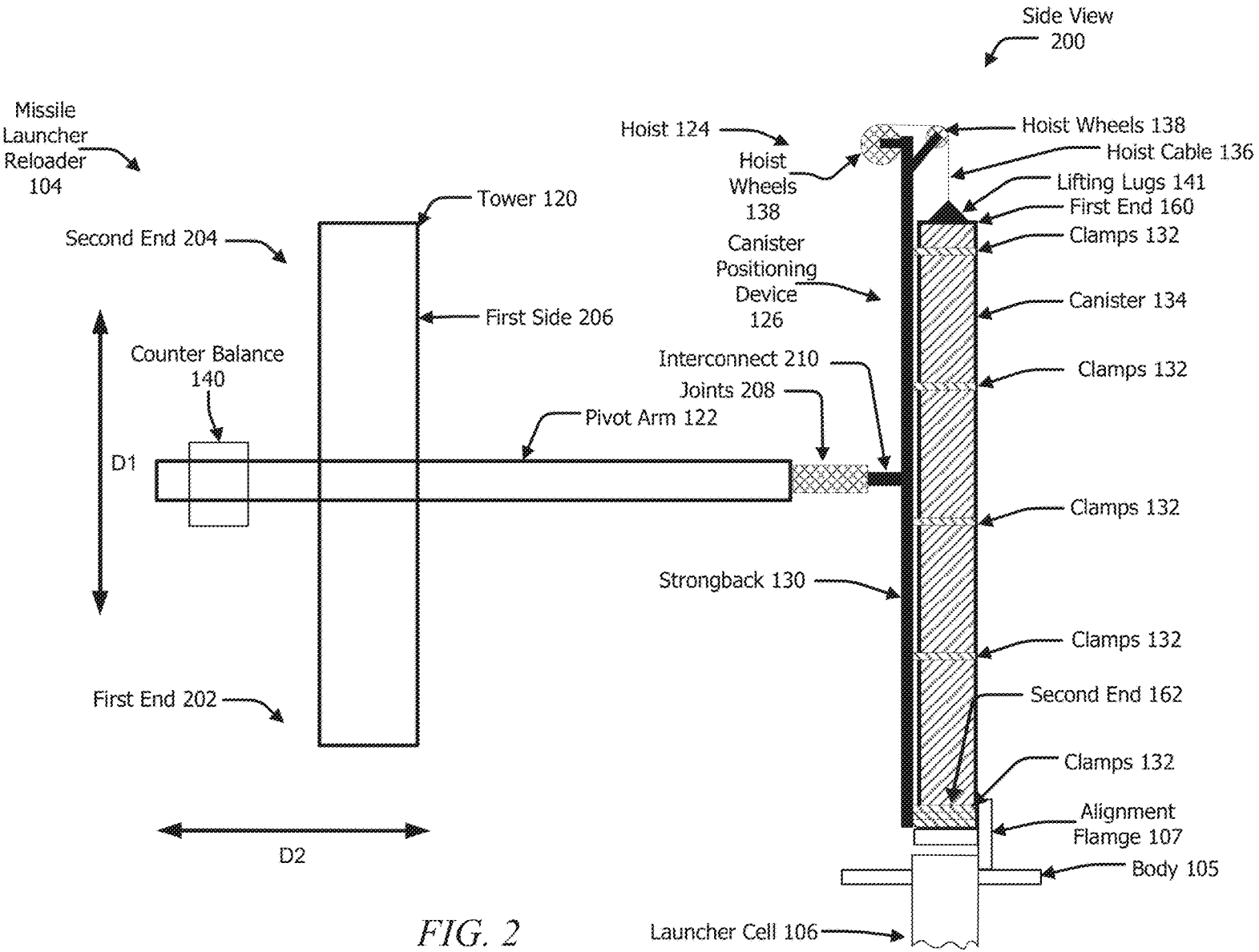
FIG. 2 illustrates a side view of a missile launcher reloader and a launcher cell, in accordance with the first embodiment.

FIG. 2 illustrates a side view 200 of missile launcher reloader 104 and launcher cell 106, in accordance with the first embodiment. Missile launcher reloader 104 of FIG. 2 includes tower 120, pivot arm 122, hoist 124, canister positioning device 126, and a counterbalance 140. Tower 120 includes a first end 202, a second end 204, and a first side 206. Hoist 124 includes a hoist cable 136 and hoist wheels 138. Canister positioning device 126 includes a strongback 130.

In the illustrated embodiment of FIG. 2, tower 120 of missile launcher reloader 104 extends between first end 202 and second end 204 positioned opposite to first end 202. Pivot arm 122 of missile launcher reloader 104 is coupled to tower 120. In certain embodiments, pivot arm 122 translates along a direction D1 between first end 202 and second end 204. In some embodiments, pivot arm 122 is extendable (e.g., telescoping) along a direction D2, which is orthogonal to direction D1. Pivot arm 122 may be extendable away from first side 206 of tower 120. In certain embodiments, pivot arm 122 includes one or more joints 208. In some embodiments, pivot arm 122 includes interconnect 210.

As illustrated in FIG. 2, canister positioning device 126 is coupled to pivot arm 122 by joints 208 and through interconnect 210. Strongback 130 of canister positioning device is coupled to interconnect 210. In certain embodiments, canister positioning device 126 includes one or more clamps 132. Clamps 132 may couple or be coupled to (hold) canister 134, as described further herein.

In certain embodiments, joints 208 of missile launcher reloader 104 include one or more joints that allow for the rotation of canister positioning device 126 while maintaining a desired strength and/or rigidity. In certain embodiments, joints 208 allow movement of canister positioning device 126 in one or more degrees of freedom. Hoist 124 of missile launcher reloader 104 includes hoist cable 136 that translates over hoist wheels 138. In certain embodiments, hoist cable 136 is connected to canister 134 by lifting lugs 141. Counterbalance 140 of missile launcher reloader 104 is positioned along pivot arm 122 opposite to canister positioning device 126. In certain embodiments, counterbalance 140 translates along pivot arm 122 along direction D2 to counter the weight of canister positioning device 126 and canister 134 when coupled with canister positioning device 126.

Figure 3:
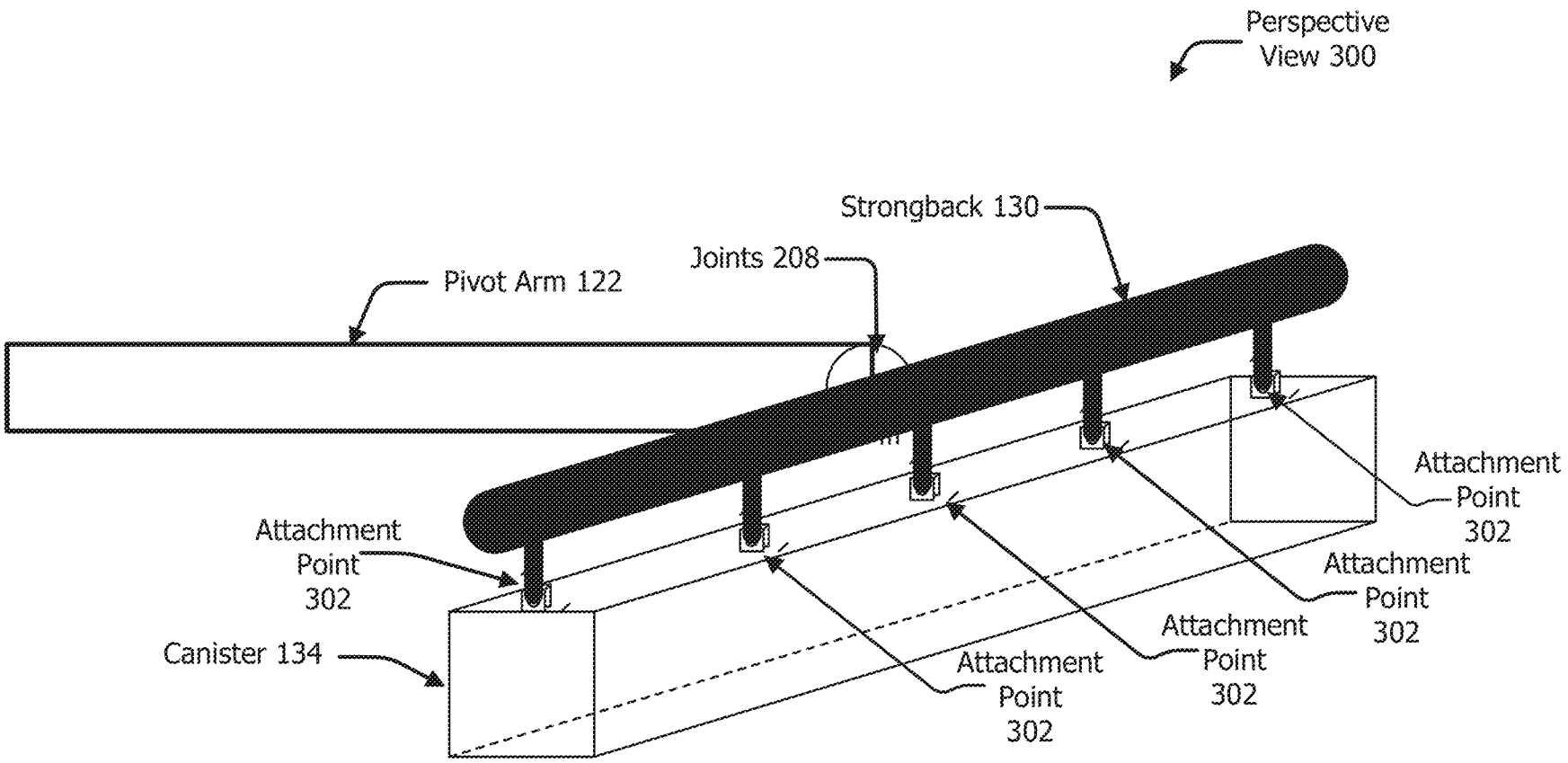
FIG. 3 illustrates a perspective view of a strongback of a canister positioning device, in accordance with the first embodiment.

FIG. 3 illustrates a perspective view 300 of strongback 130 of canister positioning device 126, in accordance with the first embodiment. Perspective view 300 of FIG. 3 includes pivot arm 122, joints 208, strongback 130, attachment points 302, and canister 134. In the illustrated embodiment of FIG. 3, strongback 130 is attached to canister 134 at one or more attachment points 302. In certain embodiments, strongback 130 is coupled (e.g., attached) to canister 134 through one or more attachment points 302. For example, strongback 130 may be manually or automatically bolted to canister 134 through attachment points 302. In some embodiments, strongback 130 includes sensors and/or other mechanisms for aligning, inserting, and/or tightening the fasteners (e.g., bolts) when the fasteners are automatically installed, coupling strongback 130 to canister 134.

Figure 4A:
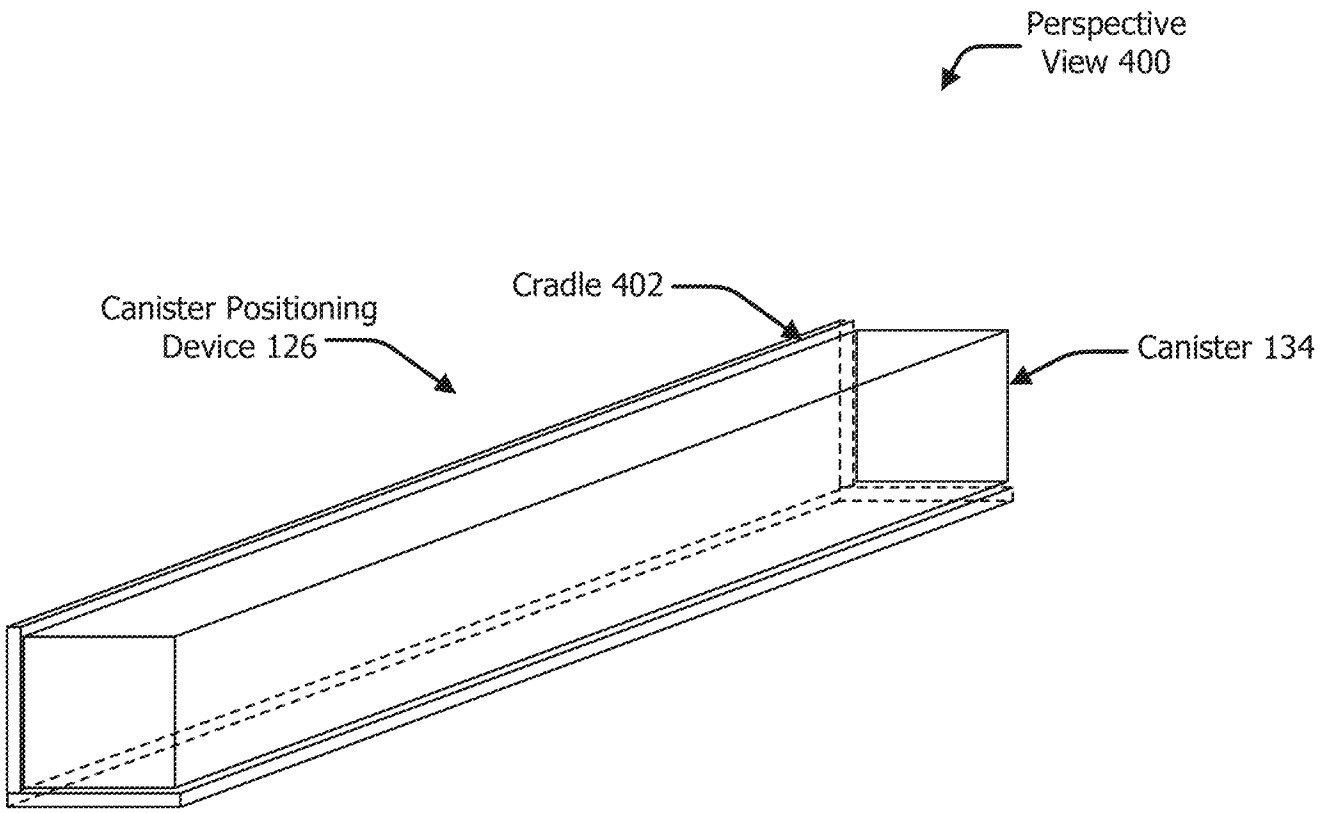
FIGS. 4A and 4B illustrate views of a cradle of a canister positioning device, in accordance with the first embodiment.
Figure 4B:
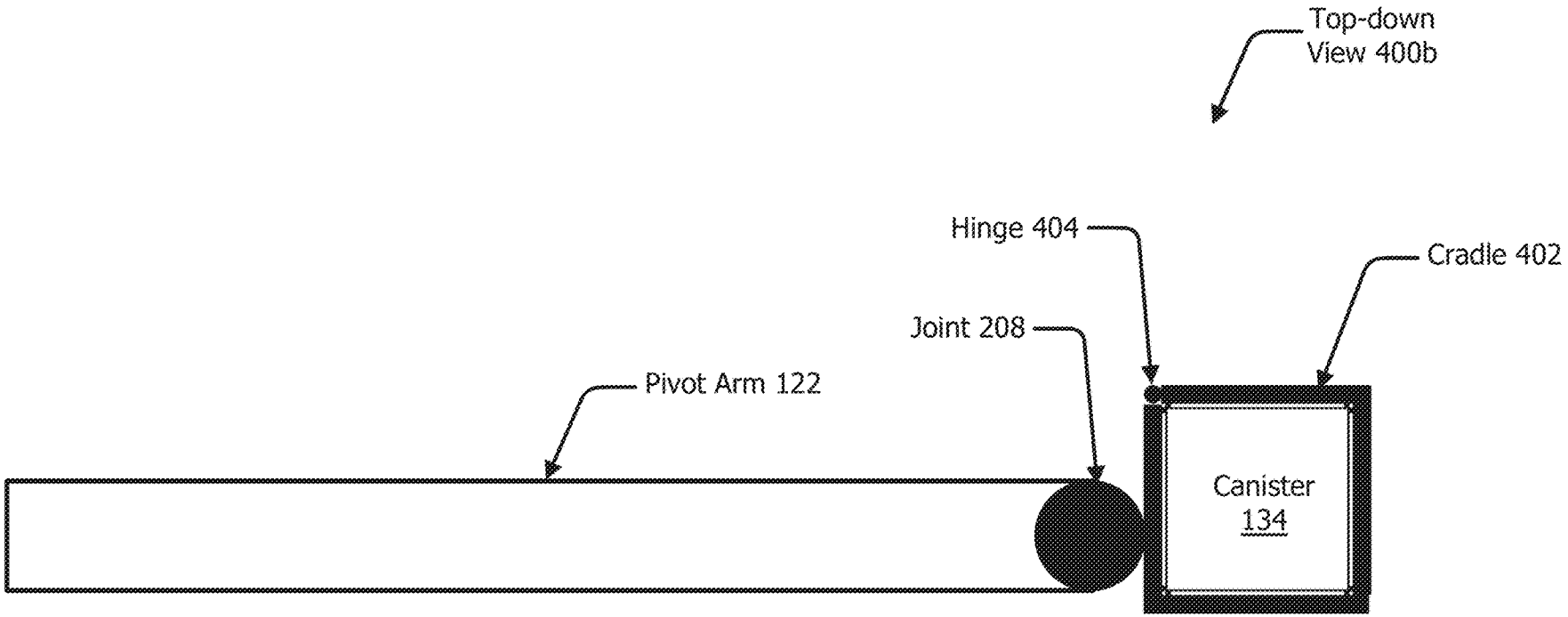

FIG. 4 (FIG. 4A and FIG. 4B) illustrate views 400 (view 400*a* and view 400*b*, respectively) of cradle 402 of a canister positioning device 126, in accordance with the first embodiment. In the illustrated embodiment of FIG. 4A, perspective view 400*a* includes cradle 402 surrounding a portion of canister 134 (e.g., two sides of canister 134). In the illustrated embodiment of FIG. 4B, top-down view 400*b* includes cradle 402 surrounding all four sides of canister 134. As illustrated in FIG. 4B, cradle 402 may include a hinge 404 that cradle 402 rotates about. Hinge 404 may extend a length of cradle 402 or a portion of the length of cradle 402. Cradle 402 may extend the length of canister 134 or a portion of the length of canister 134.

Figure 5:
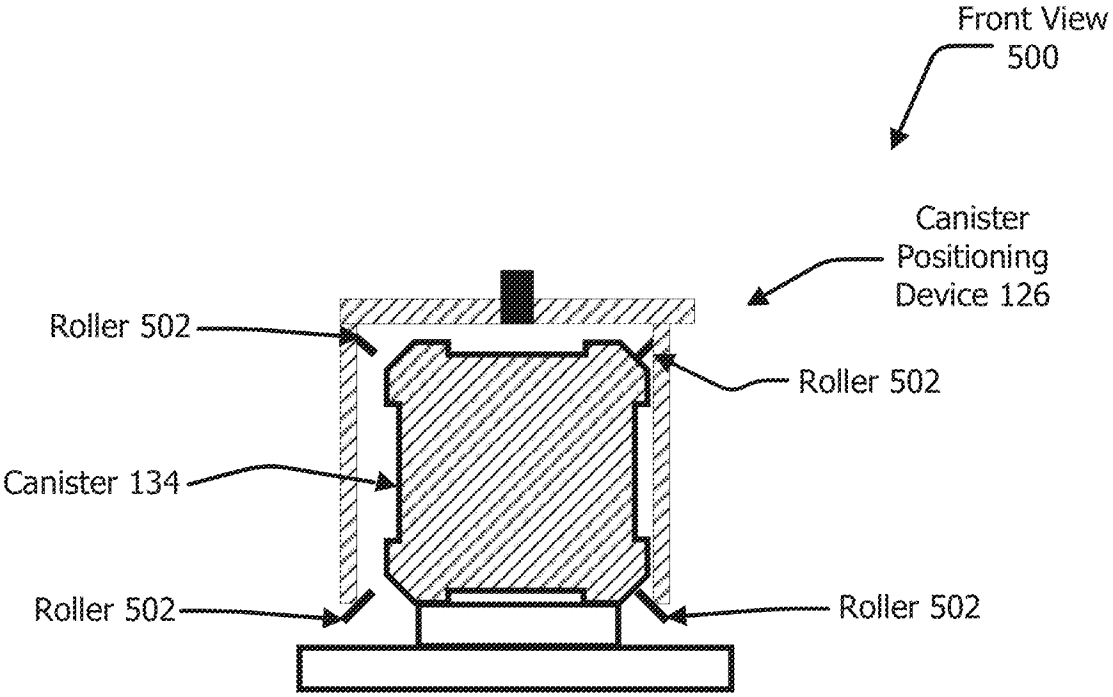
FIG. 5 illustrates a front view of a canister positioning device and a canister, in accordance with the first embodiment.

FIG. 5 illustrates a front view 500 of canister positioning device 126 and canister 134, in accordance with the first embodiment. In the illustrated embodiment of FIG. 5, canister positioning device 126 includes rollers 502 that contact canister 134 at one or more points. In certain embodiments, one or more rollers 502 hold canister 134 and/or guide movement of canister 134, as described further herein.

Figure 6:
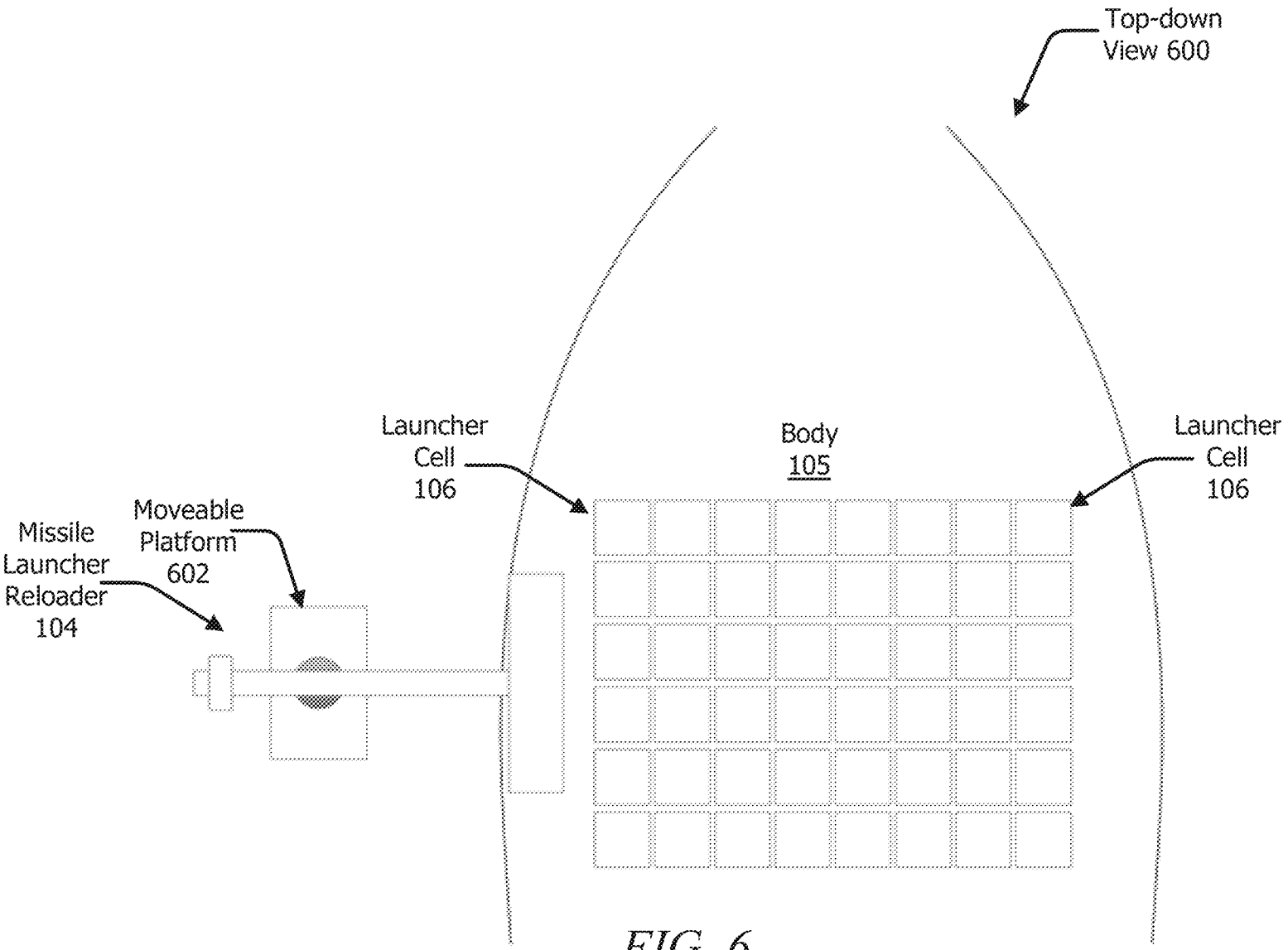
FIG. 6 illustrates a top-down view of a missile launcher reloader implemented at an ocean fairing vessel, in accordance with the first embodiment.

FIG. 6 illustrates a top-down view 600 of missile launcher reloader 104 implemented at an ocean fairing vessel, in accordance with the first embodiment. In the illustrated embodiment of FIG. 6, missile launcher reloader 104 is mounted on a moveable platform 602. Moveable platform 602 may include a trolly, a wheeled-platform, a track-based platform, an air-based platform (e.g., helicopter platform), or any other suitable type of platform that allows movement of missile launcher reloader 104 with respect to one or more launcher cells 106. In the illustrated embodiment of FIG. 6, launcher cells 106 are positioned within body 105 (e.g., a ship deck surface) and are associated with (e.g., include) an alignment flange 107 (as illustrated in FIG. 2).

Figure 7:
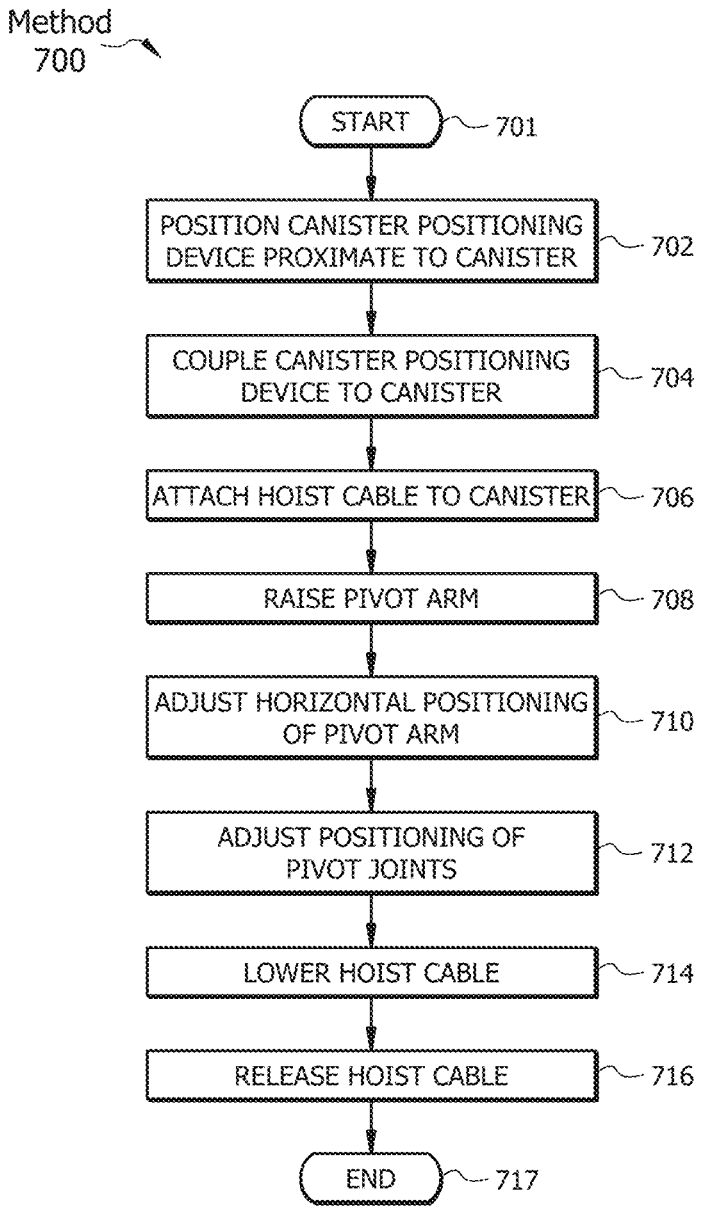
FIG. 7 illustrates a method for automated missile launcher reloading, in accordance with the first embodiment.
Figure 8B:
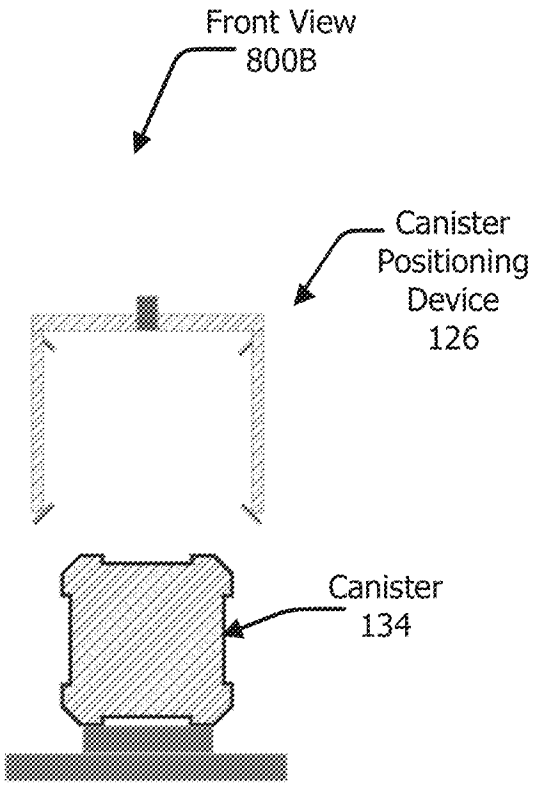
FIGS. 8A through 8P illustrate the stages of automated missile launcher reloading at a missile launcher reloader, in accordance with the first embodiment.
Figure 8A:
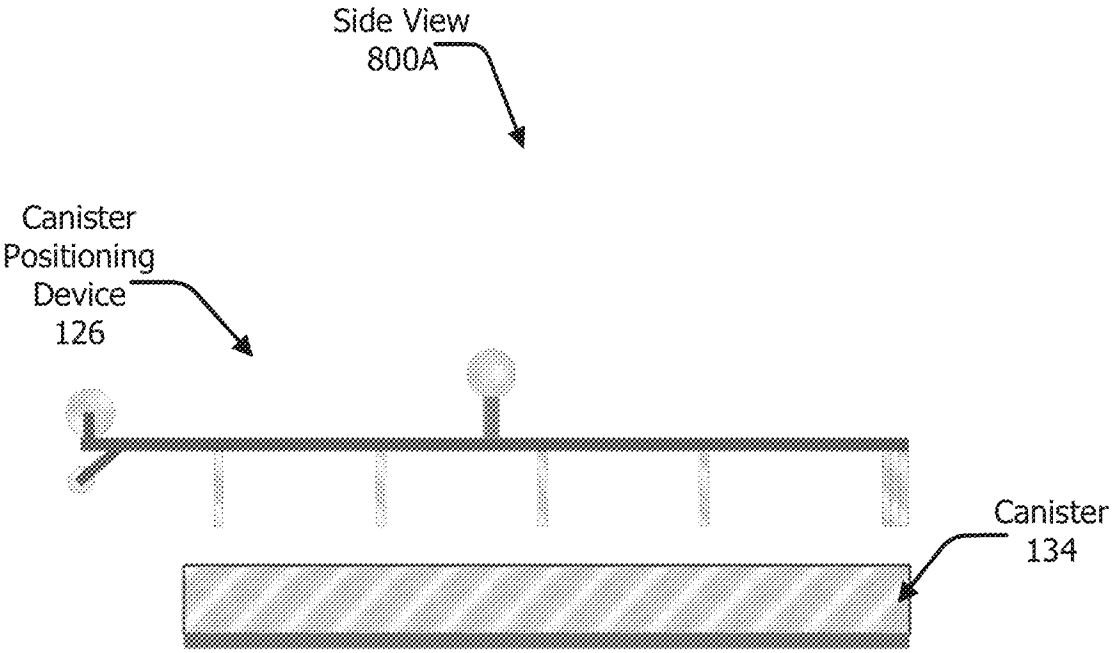
Figure 8C:
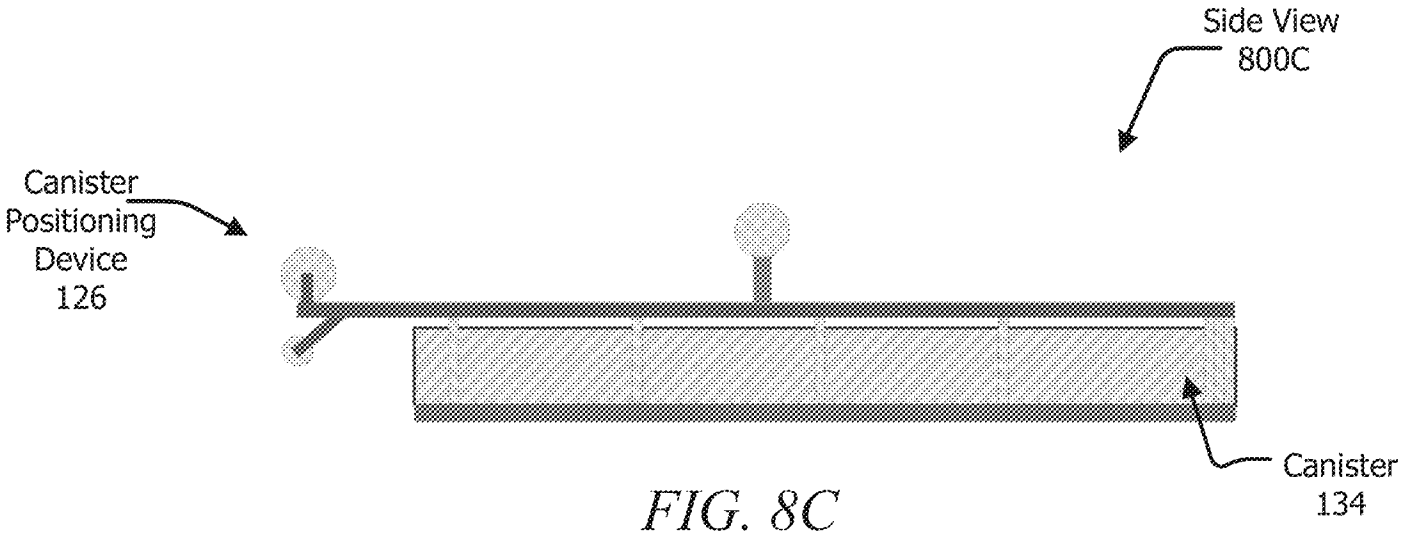
Figure 8D:
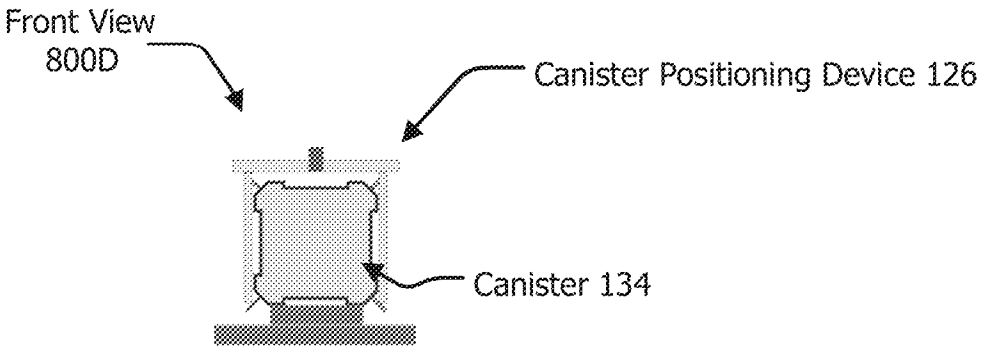
Figure 8E:
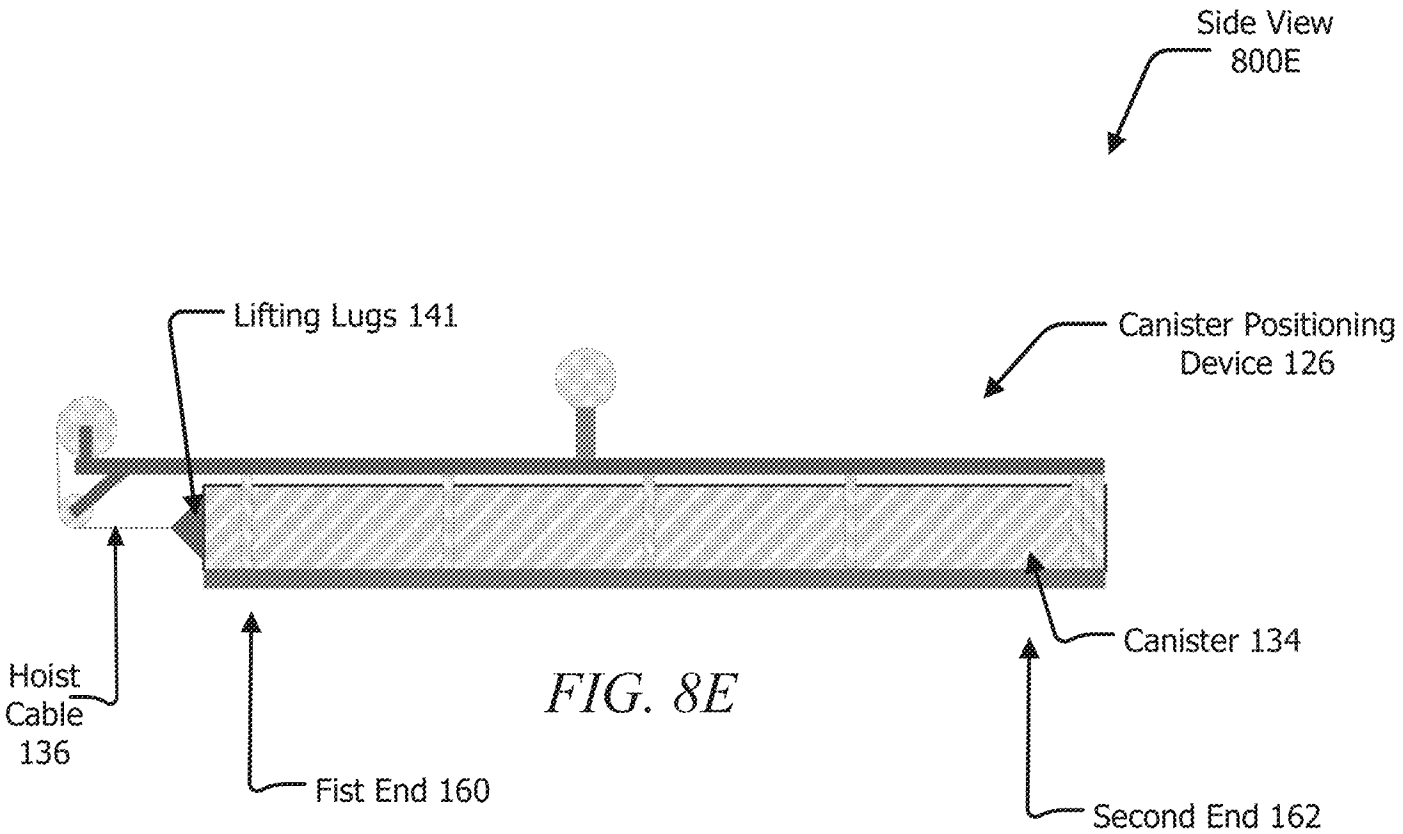
Figure 8F:
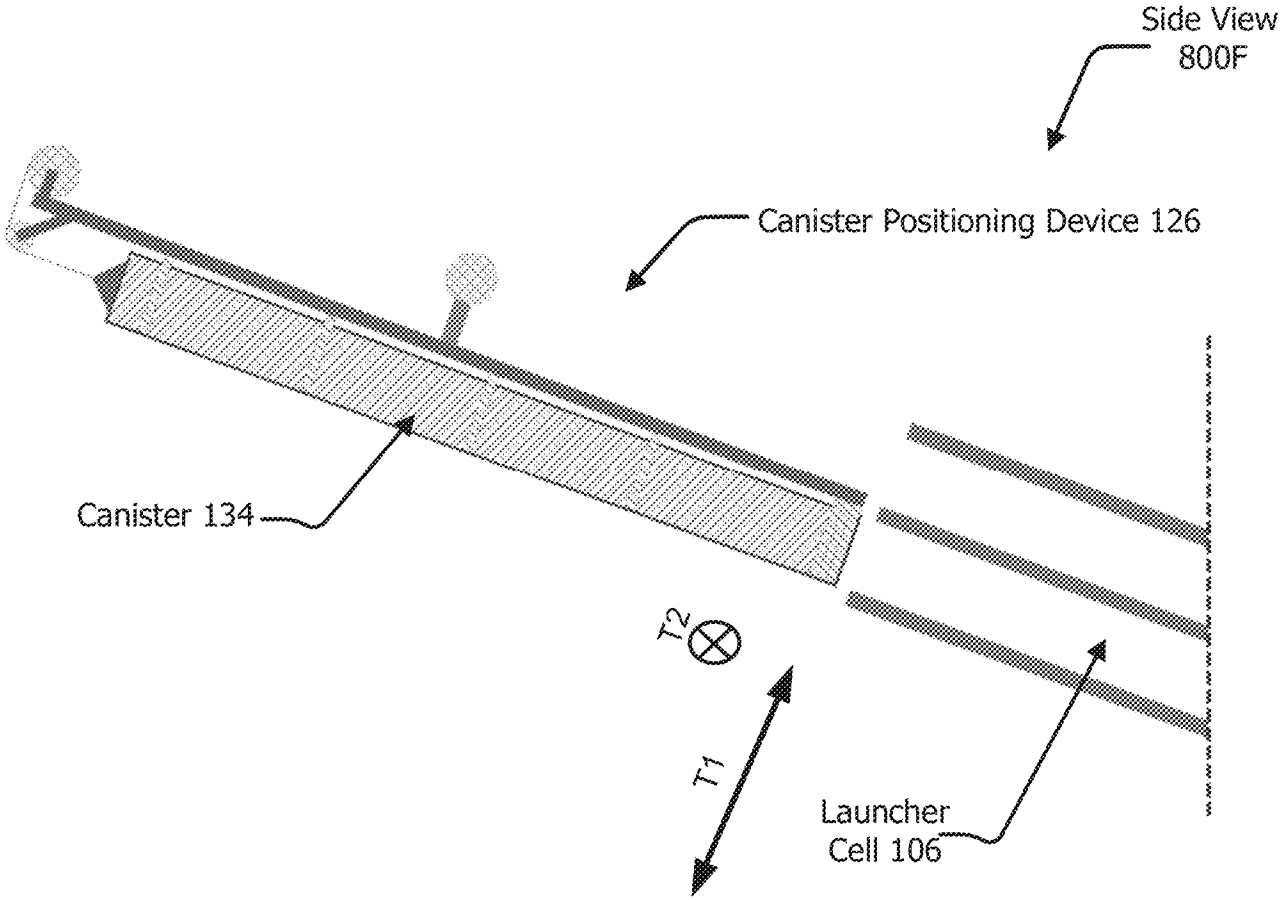
Figure 8G:
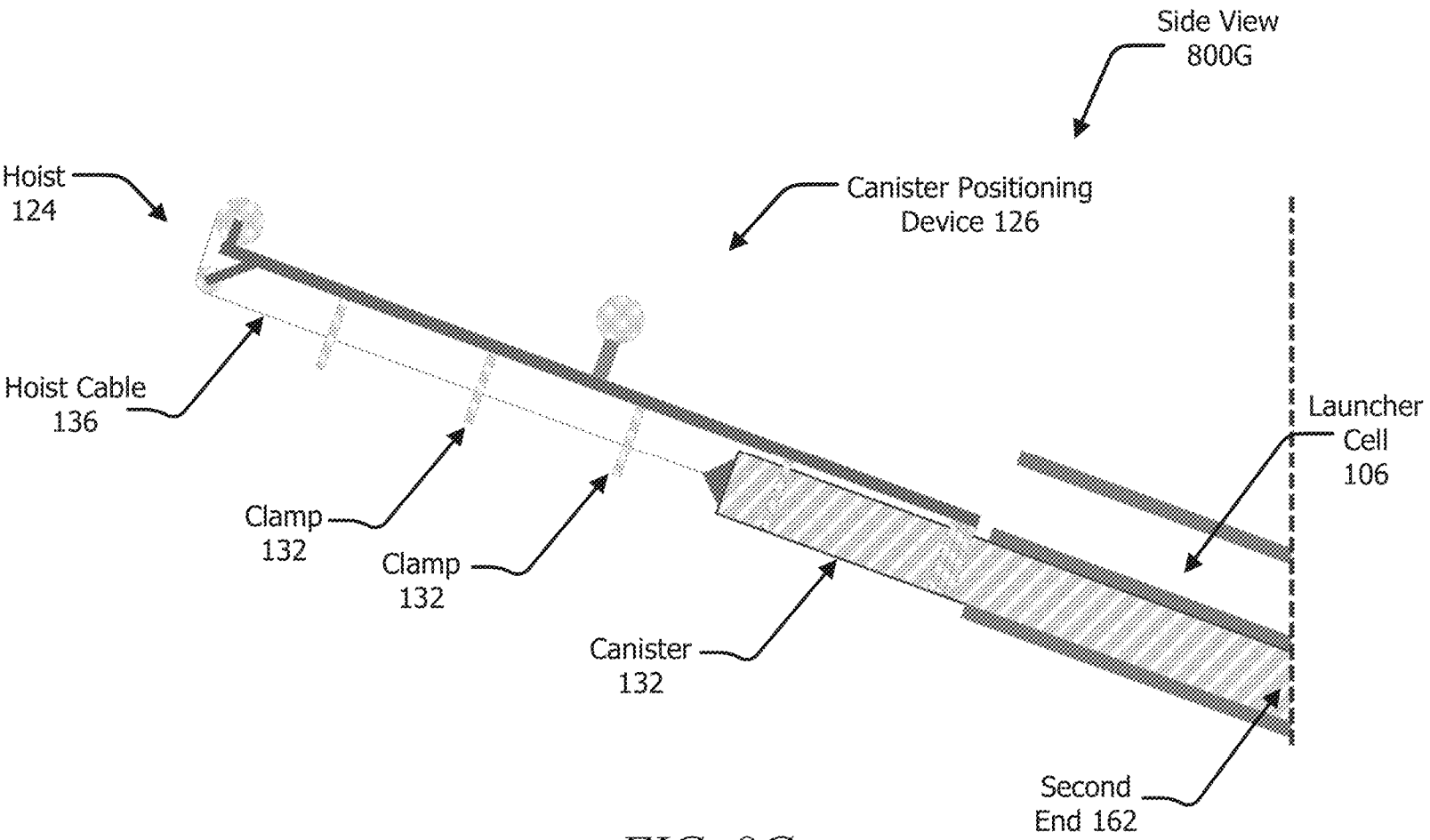
Figure 8H:
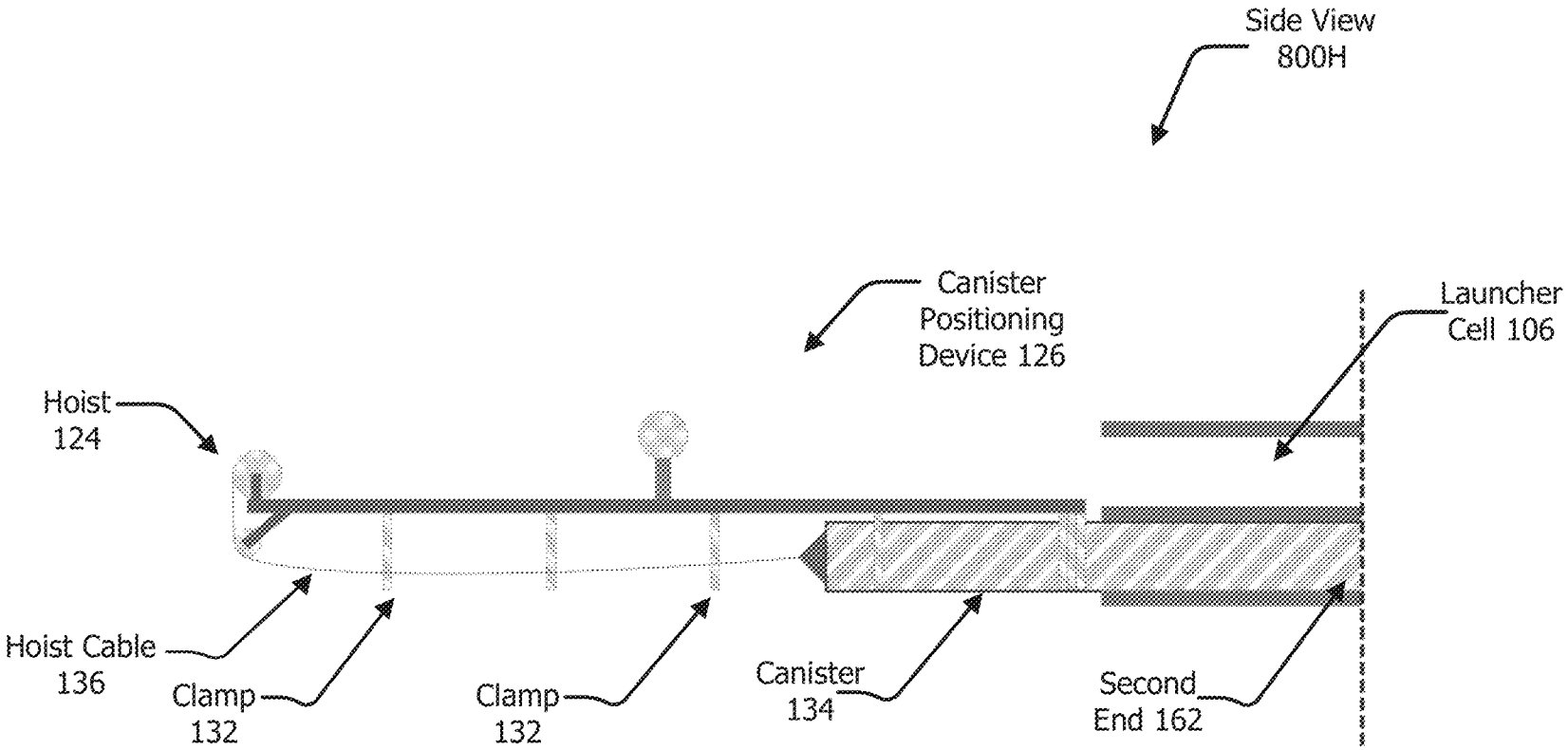
Figure 8I:
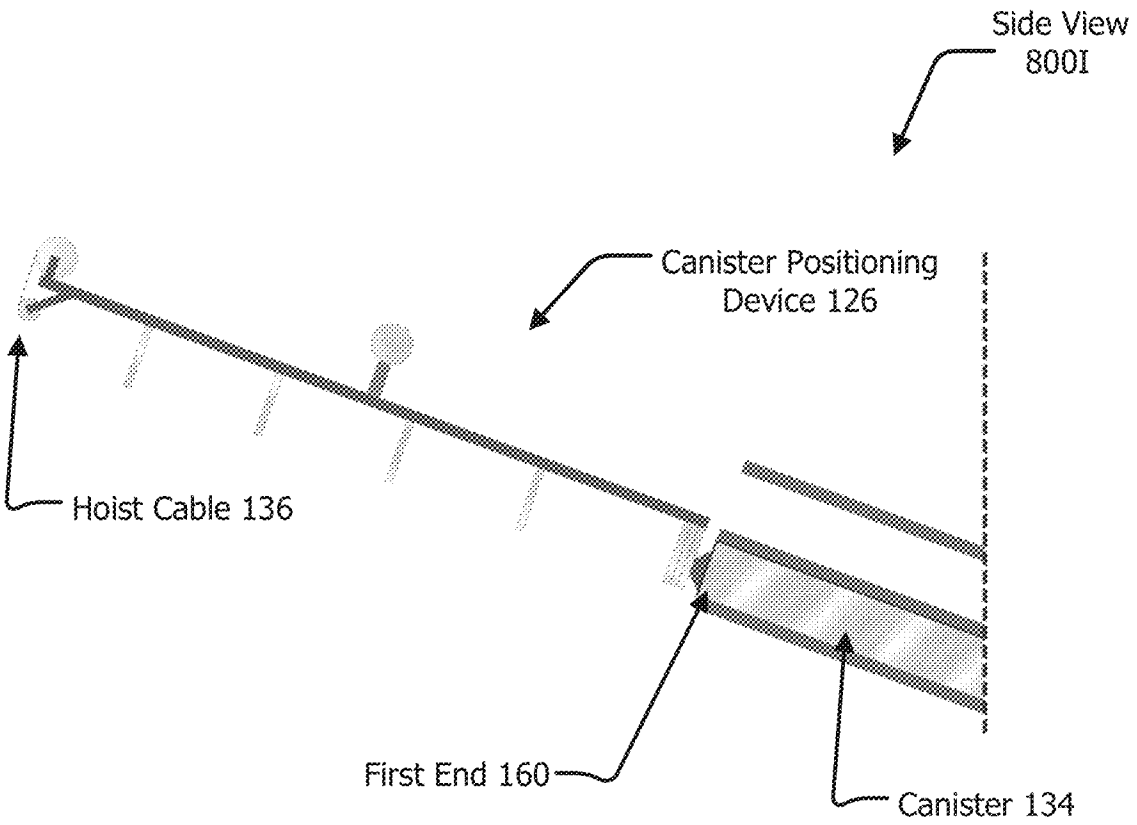
Figure 8J:
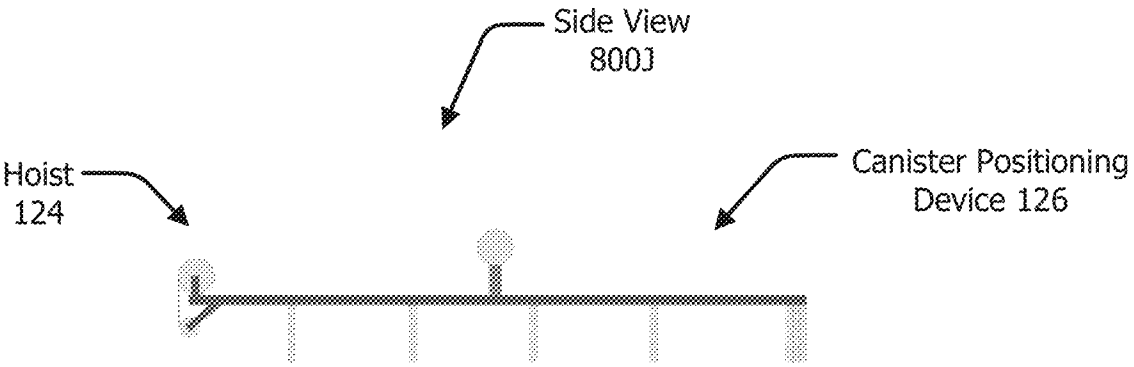
Figure 8K:
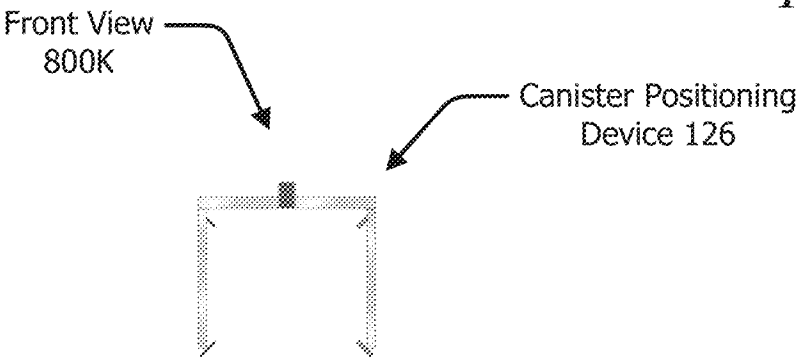
Figure 8L:
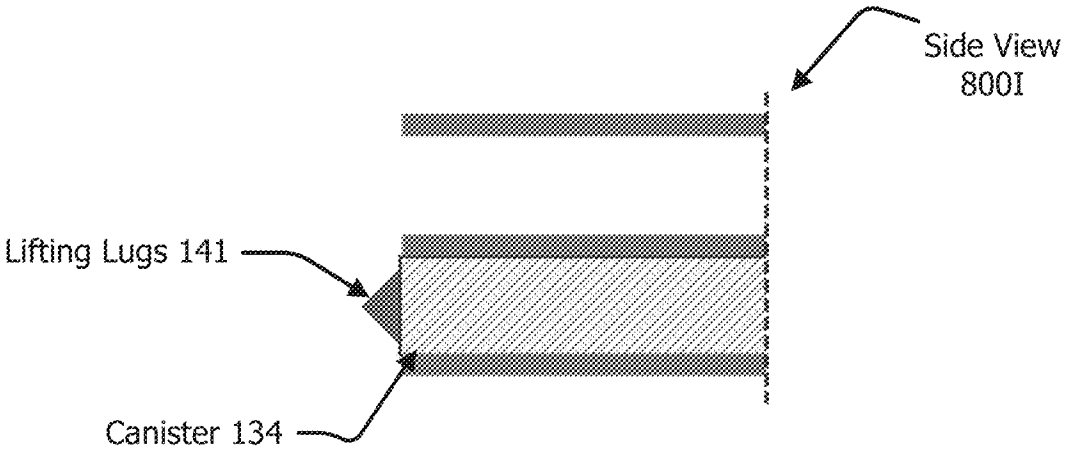
Figure 8M:
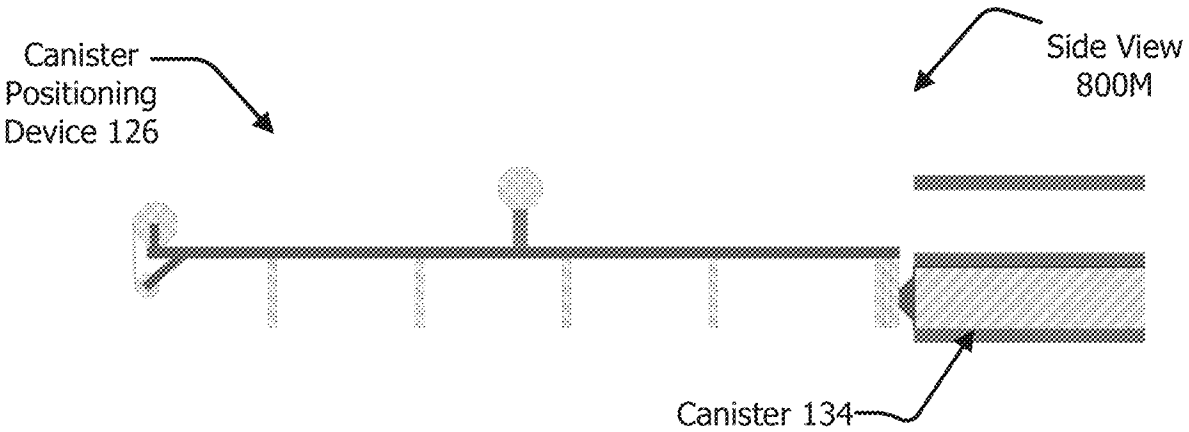
Figure 8N:
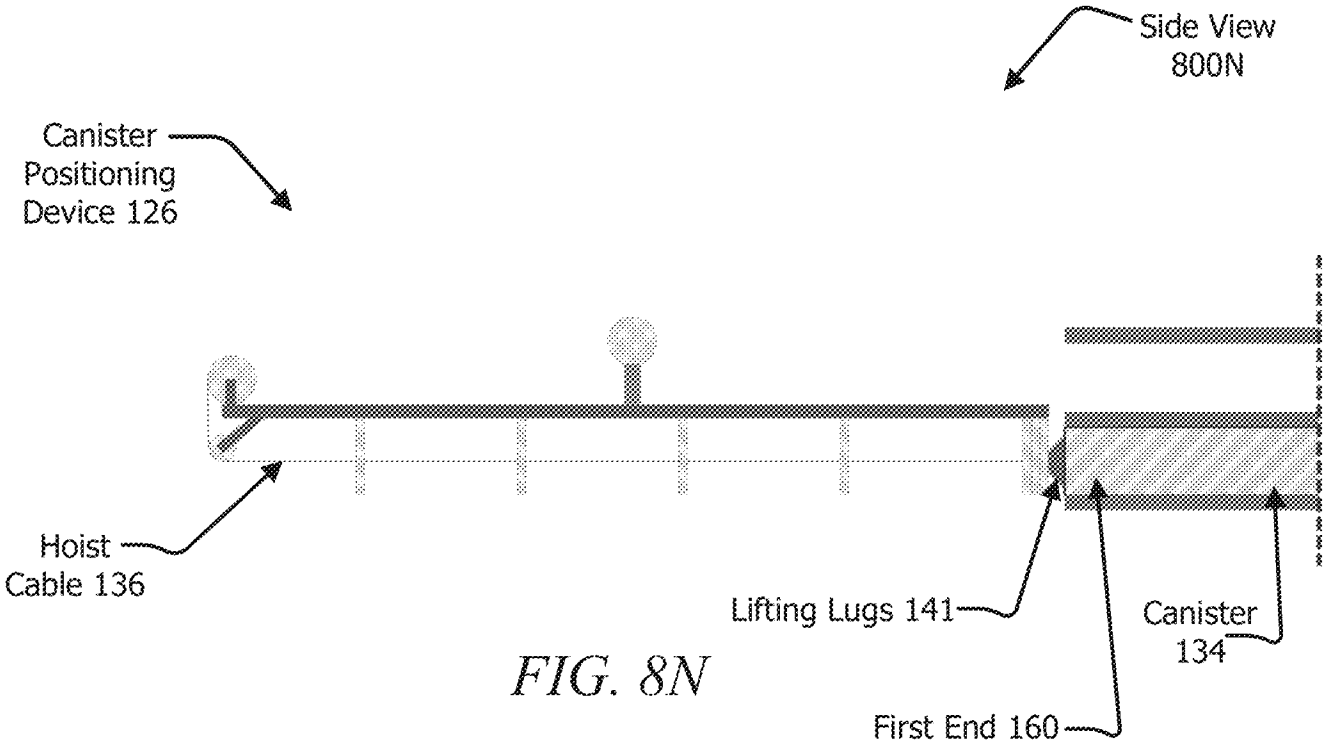
Figure 8O:
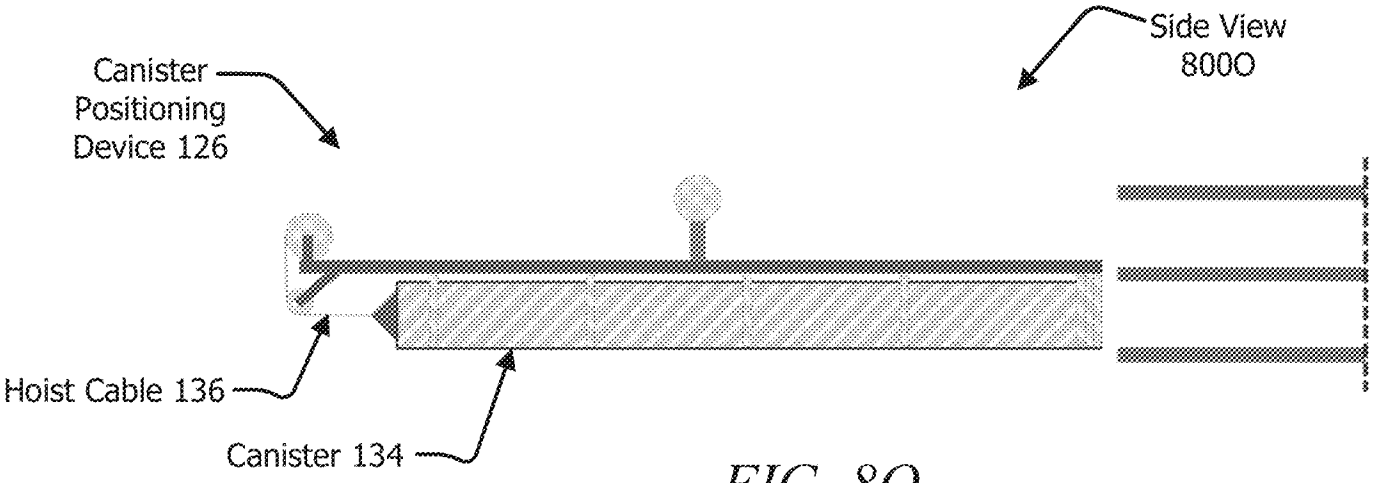
Figure 8P:
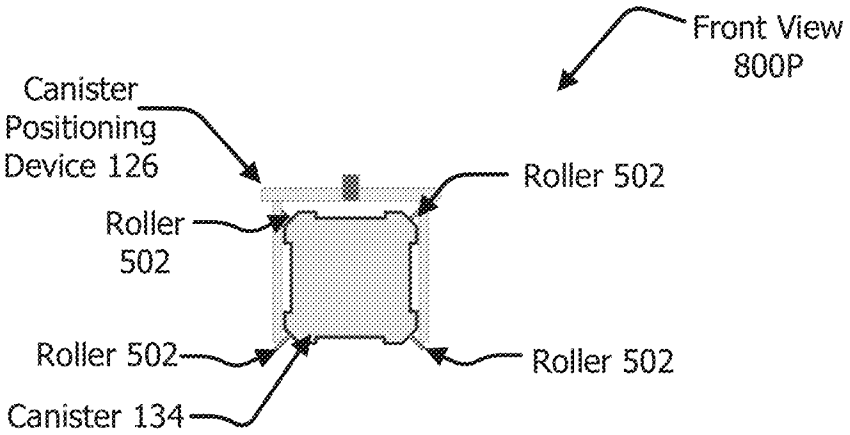

FIG. 7 illustrates a method 700 for automated missile launcher reloading, in accordance with the first embodiment. Method 700 may be performed by computing device 102, missile launcher reloader 104, and/or control system 110 of FIG. 1. FIG. 7 refers to FIGS. 8A through 8P, which illustrate the stages of automated missile launcher reloading at a missile launcher reloader, in accordance with the first embodiment. Certain operations described in method 700 may be optional or may be rearranged in different embodiments.

Method 700 begins at step 701. At step 702 of method 700, the canister positioning device is positioned proximate to the canister. For example, referring to FIGS. 1 and 2, control system 110 may provide a control signal to missile launcher reloader 104 such that pivot arm 122 is extended horizontally along direction D2 and vertically along tower 204 along the direction D1. As illustrated by side view 800*a* and front view 800*b* of FIG. 8A and FIG. 8B, respectively, canister positioning device 126 is positioned proximate to canister 134. In certain embodiments, the clamps (e.g., clamps 132 of FIG. 2) of the canister positioning device are in an "open" position to receive the canister. In some embodiments, the canister positioning device is in a horizontal position when coupling with the canister when the canister is horizontal. In certain embodiments, the canister positioning device is in a vertical position when coupling with the canister when the canister is vertical. Method 700 then moves from step 702 to step 704.

At step 704 of method 700, the canister positioning device is coupled to the canister. For example, referring to FIGS. 1 and 2, the control system 110 may provide a control signal to missile launcher reloader 104 such that canister positioning device 126 couples to canister 134. As shown by side view 800*c* and front view 800*d* of FIG. 8C and FIG. 8D, respectively, canister positioning device 126 is coupled to canister 134. In certain embodiments, the canister positioning device couples to the canister by engaging the clamps (e.g., clamps 132 of FIG. 2) of the canister positioning device. For example, the canister positioning device may couple to the canister by engaging the clamps with the canister to couple the canister positioning device with the canister. Method 700 then moves from step 704 to step 706.

At step 706 of method 700, the hoist cable is attached to a first end of the canister. For example, referring to FIGS. 1 and 2, control system 110 may provide a control signal to missile launcher reloader 104 such that hoist cable 136 is extended (or lowered) to attach to a first end 160 of canister 134 (opposite a second end 162 of canister 134). As illustrated by side view 800*e* of FIG. 8E, hoist cable 136 is attached to lifting lugs 141 that are attached to canister 134. In certain embodiments, a user can facilitate the coupling of the hoist cable to the first end of the canister. Method 700 then moves from step 706 to step 708.

At step 708 of method 700, the pivot arm is raised on the tower from a first position on the tower to a second position on the tower. For example, referring to FIGS. 1 and 2, control system 110 may provide a control signal to the missile launcher reloader 104 such that pivot arm 122 is raised on tower 120 along direction D1. In certain embodiments, the canister positioning device and the canister are rotated from a horizontal position to a vertical position or an angled position. As illustrated by side view 800*f* of FIG. 8F, canister positioning device 126 and canister 134 are in an angled position with respect to launcher cell 106. In certain embodiments, canister positioning device 126 and canister 134 are rotated from a horizontal position to a vertical position or an angled position. Method 700 then moves from step 708 to step 710.

At step 710 of method 700, the horizontal positioning of the pivot arm is adjusted to position the canister proximate to the launcher cell. For example, referring to FIGS. 1 and 2, control system 110 may provide a control signal to missile launcher reloader 104 such that pivot arm 122 extends or contracts with respect to tower 120 to adjust the horizontal positioning thereof to position canister 134 proximate to launcher cell 106. In some embodiments, the horizontal positioning of the pivot arm is adjusted to position the canister proximate to the alignment flange (e.g., alignment flange 107 of FIG. 2) of the launcher cell.

In certain embodiments, when the horizontal positioning of the pivot arm is adjusted (extended or contracted), the control system provides a control signal to the missile launcher reloader to adjust the positioning of the counterbalance (e.g., counterbalance 140 of FIG. 2). For example, the positioning of the counterbalance may be adjusted along the pivot arm based on the horizontal positioning of the pivot arm. In certain embodiments, the counterbalance is adjusted to counter the weight of the canister positioning device and the canister when coupled with the canister positioning device (e.g., to minimize torque on the tower). Method 700 then moves from step 710 to step 712.

At step 712 of method 700, the positioning of the pivot joints is adjusted to align the canister with the launcher cell. For example, referring to FIGS. 1 and 2, control system 110 may provide a control signal to missile launcher reloader 104 to adjust the positioning of pivot joints 208 (about one or more degrees of freedom) to align canister 134 with launcher cell 106. In certain embodiments, the control system provides a control signal to the missile launcher reloader to adjust the positioning of the pivot joints a predetermined number of degrees of freedom (e.g., 6 degrees of freedom) to prevent binding of the canister and the launcher cell.

In certain embodiments, the system includes sensors to facilitate determining an alignment between the canister and the launcher cell. For example, a positional alignment of the canister may be determined with respect to the launcher cell in a first direction and a second direction opposite to the first direction. As illustrated in a side view 800*f* of FIG. 8F, the positional alignment of canister 134 can be determined with respect to launcher cell 106 in a first direction T1 and a second direction T2 opposite to first direction T1. The sensors of missile launcher reloader 104 may determine the positional alignment between canister 134 and launcher cell 106 along direction T1 and/or direction T2.

In certain embodiments, an angular alignment of the canister is determined with respect to the launcher cell. The sensors of the system may determine the angular alignment of the canister with respect to the launcher cell. The positioning of the pivot joints may be adjusted to align the canister with the launcher cell based on the positional alignment of the canister with respect to the launcher cell and/or the angular alignment of the canister with respect to the launcher cell. For example, referring to FIGS. 1 and 2, control system 110 may receive signals from the sensors of canister 134 indicating the positional alignment of canister 134 with respect to launcher cell 106 and the angular alignment of canister 134 with respect to launcher cell 106. In response, control system 110 may provide a signal to missile launcher reloader 104 to adjust the positioning of pivot joints 208 (about one or more degrees of freedom) to align canister 134 with launcher cell 106 based on the signals received from the sensors. Method 700 then moves from step 712 to step 714.

At step 714 of method 700, after adjusting the positioning of the pivot joints, the pivot arm is lowered on the tower from the second position on the tower to the first position on the tower such that the canister positioning device contacts the launcher cell. For example, referring to FIGS. 1 and 2, control system 110 may provide a control signal to missile launcher reloader 104 to lower pivot arm 122 on tower 120 to a point where the canister positioning device 126 contacts launcher cell 106.

In certain embodiments, the hoist cable is lowered to lower the canister into the launcher cell at the second end of the canister. For example, referring to FIGS. 1 and 2, control system 110 may provide a control signal to missile launcher reloader 104 to lower hoist cable 136 such that canister 134 is lowered into launcher cell 106. As illustrated by side view 800*g* in FIG. 8G, for an angled or vertical launcher cell 106, clamps 132 are slowly released to guide canister 134 and lower canister 134 via hoist 124 into launcher cell 106. As shown by side view 800*h* in FIG. 8H, for a horizontal launcher cell 106 (or substantially horizontal), clamps 132 are released and rollers 502 (shown in FIG. 5) of canister positioning device 126 are engaged (e.g., powered) to push canister 134 into launcher cell 106. Method 700 then moves from step 714 to step 716.

At step 716 of method 700, after the canister is fully positioned within the launcher cell, the hoist cable is released from the first end of the canister. For example, referring to FIGS. 1 and 2, control system 110 may provide a control signal to missile launcher reloader 104 such that hoist cable 136 is released from being coupled with first end 160 of canister 134. As shown by side view 800*i* of FIG. 8I, canister 134 is fully positioned within launcher cell 106, and hoist cable 136 is released from canister 134. In certain embodiments, a user may facilitate releasing (e.g., decoupling) hoist cable 136 from first end 160 of canister 134.

In certain embodiments, after the hoist cable is released, the pivot arm is raised on the tower from the first position on the tower to the second position on the tower such that the canister positioning device clears the alignment flange of the launcher cell. As illustrated by side view 800*j* and front view 800*k* of FIG. 8J and FIG. 8K, respectively, canister positioning device 126 is decoupled from canister 134.

In certain embodiments, after the canister is fully positioned within the launcher cell, the canister is removed from the launcher cell (e.g., after deployment of the payload of the canister). For example, as illustrated by side view 800*l* in FIG. 8L, lifting lugs 141 may be coupled (e.g., installed) on canister 134. In some embodiments, the canister positioning device is positioned proximate to the canister positioned within the launcher cell. For example, referring to FIGS. 1 and 2, control system 110 may provide a control signal to missile launcher reloader 104 such that pivot arm 122 is extended horizontally appropriately along direction D2 and vertically along tower 120 along direction D1. As illustrated by side view 800*m* in FIG. 8M, canister positioning device 126 is positioned proximate to canister 134. In certain embodiments, the clamps of the canister positioning device are in an "open" position to receive the canister. In some embodiments, the canister positioning device is in a substantially horizontal position when coupling with the canister when the canister is substantially horizontal. In certain embodiments, the canister positioning device is in a substantially vertical position when coupling with the canister when the canister is substantially vertical.

In certain embodiments, the hoist cable is attached to a first end of the canister. For example, referring to FIGS. 1 and 2, control system 110 may provide a control signal to missile launcher reloader 104 such that hoist cable 136 is extended (or lowered) to attach to first end 160 of canister 134 (opposite second end 162 of canister 134). As illustrated by side view 800*n* of canister positioning device 126 of FIG. 8N, hoist cable 136 is attached to lifting lugs 141 that are attached to canister 134. In some embodiments, a user may facilitate coupling the hoist cable to the first end of the canister.

In certain embodiments, the hoist cable is raised to raise the canister from the launcher cell to remove the canister from the launcher cell. For example, referring to FIGS. 1 and 2, control system 110 may provide a control signal to missile launcher reloader 104 to raise hoist cable 136 such that canister 134 is removed into launcher cell 106. As illustrated by side view 800*o* and front view 800*p* in FIG. 8O and FIG.

8P, respectively, hoist cable 136 retracts and pulls used canister 134 through rollers 502 (shown in FIG. 5) of canister positioning device 126 such that canister 134 is coupled with canister positioning device 126. In certain embodiments, the canister positioning device is coupled to the canister by engaging the clamps of the canister positioning device. For example, referring to FIGS. 1 and 2, canister positioning device 126 may be coupled to canister 134 by engaging clamps 132 with canister 134 to couple canister positioning device 126 with canister 134. Method 700 then moves from step 716 to step 717, where method 700 ends.

Although this disclosure describes and illustrates particular steps method 700 of FIG. 7 as occurring in a particular order, this disclosure contemplates any suitable steps of method 700 of FIG. 7 occurring in any suitable order. Although this disclosure describes and illustrates an example method for an automated missile launcher reloading including the particular steps of the method of FIG. 7, this disclosure contemplates any suitable method for automated launcher reloading including any suitable steps, which may include all, some, or none of the steps of the method of FIG. 7, where appropriate. Furthermore, although FIG. 7 describes and illustrates particular components, devices, or systems carrying out particular actions, this disclosure contemplates any suitable combination of any suitable components, devices, or systems carrying out any suitable actions.

Although FIGS. 1 through 6 and FIGS. 8A through 8P illustrate particular number of components, devices, or systems, this disclosure contemplates any suitable number of components, devices, or systems. Although FIGS. 1 through 6 and FIGS. 8A through 8P illustrate particular arrangements of certain components, devices, or systems, this disclosure contemplates any suitable arrangement of components, devices, or systems. Furthermore, although FIGS. 1 through 6 and FIGS. 8A through 8P describe and illustrate particular components, devices, or systems carrying out particular actions, this disclosure contemplates any suitable combination of any suitable components, devices, or systems carrying out any suitable actions.

Figure 9:
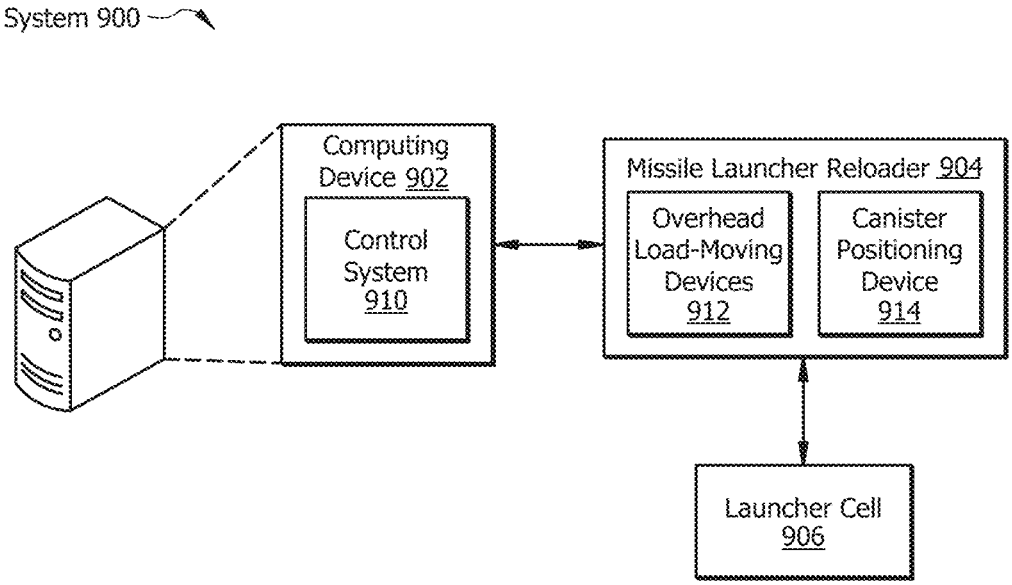
FIG. 9 illustrates a system for a missile launcher reloader, in accordance with a second embodiment.

FIG. 9 illustrates a system 900 for a missile launcher reloader 904, in accordance with a second embodiment. System 900 or portions thereof may be associated with an entity, which may include any entity, such as a business, company, or enterprise, that is associated with missile launcher reloaders. For example, system 900 may be associated with the United States Armed Forces (e.g., the Navy, the Army, the Air Force, etc.). The components of system 900 may include any combination of hardware, firmware, and software. For example, the components of system 900 may use one or more elements of the computer system of FIG. 28.

In the illustrated embodiment of FIG. 9, system 900 includes a computing device 902, a missile launcher reloader 904, and a launcher cell 906. Computing device 902 of system 900 includes a control system 910. In certain embodiments, control system 910 is included by a memory of computing device 902. In some embodiments, control system 910 includes a computer-executable program (software) that is executed by a processor of computing device 902. In the illustrated embodiment of FIG. 9, computing device 902 is in communication with missile launcher reloader 904. In certain embodiments, missile launcher reloader 104 of system 100 is automated. For example, missile launcher reloader 904 may perform certain actions in response to one or more signals received from computing device 902 without needing human control.

In the illustrated embodiment of FIG. 9, missile launcher reloader 904 includes overhead load-moving devices 912 and a canister positioning device 914. In certain embodiments, overhead load-moving devices 912 are cranes (e.g., bridge cranes). Control system 910 may be in communication with any portion of missile launcher reloader 904, including overhead load-moving devices 912 and/or canister positioning device 914. Control system 910 may be configured to provide control signals to missile launcher reloader 904 to control the actions of missile launcher reloader 904. In certain embodiments, control system 910 is configured to provide control signals to overhead load-moving devices 912 to control overhead load-moving devices 912 to perform certain actions, as described further herein.

Figure 10:
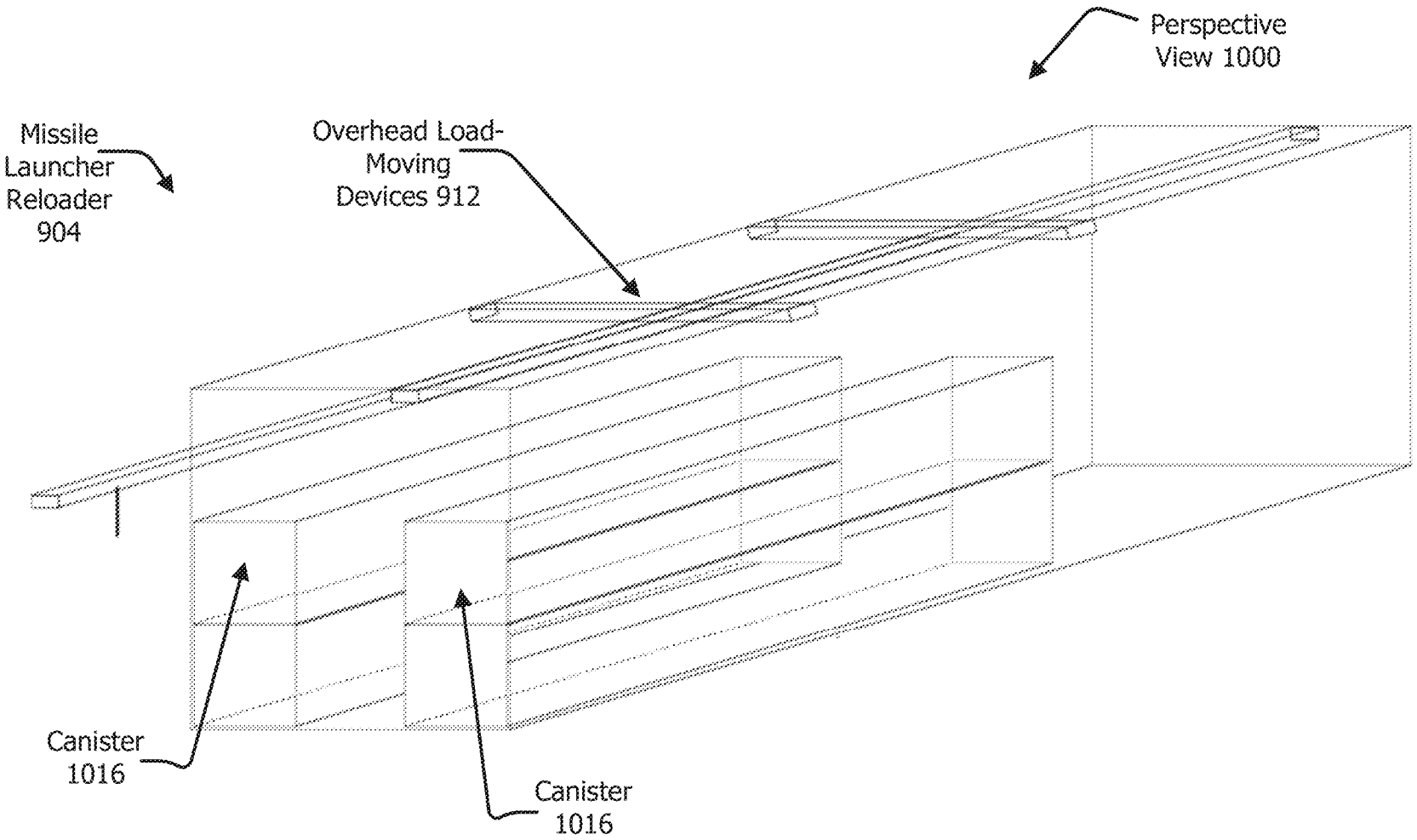
FIG. 10 illustrates a perspective view of a missile launcher reloader, in accordance with the second embodiment.

FIG. 10 illustrates a perspective view 1000 of missile launcher reloader 904, in accordance with the second embodiment. The illustrated embodiment of FIG. 10 includes missile launcher reloader 904, overhead load-moving devices 912, and canisters 1016.

Figure 11:
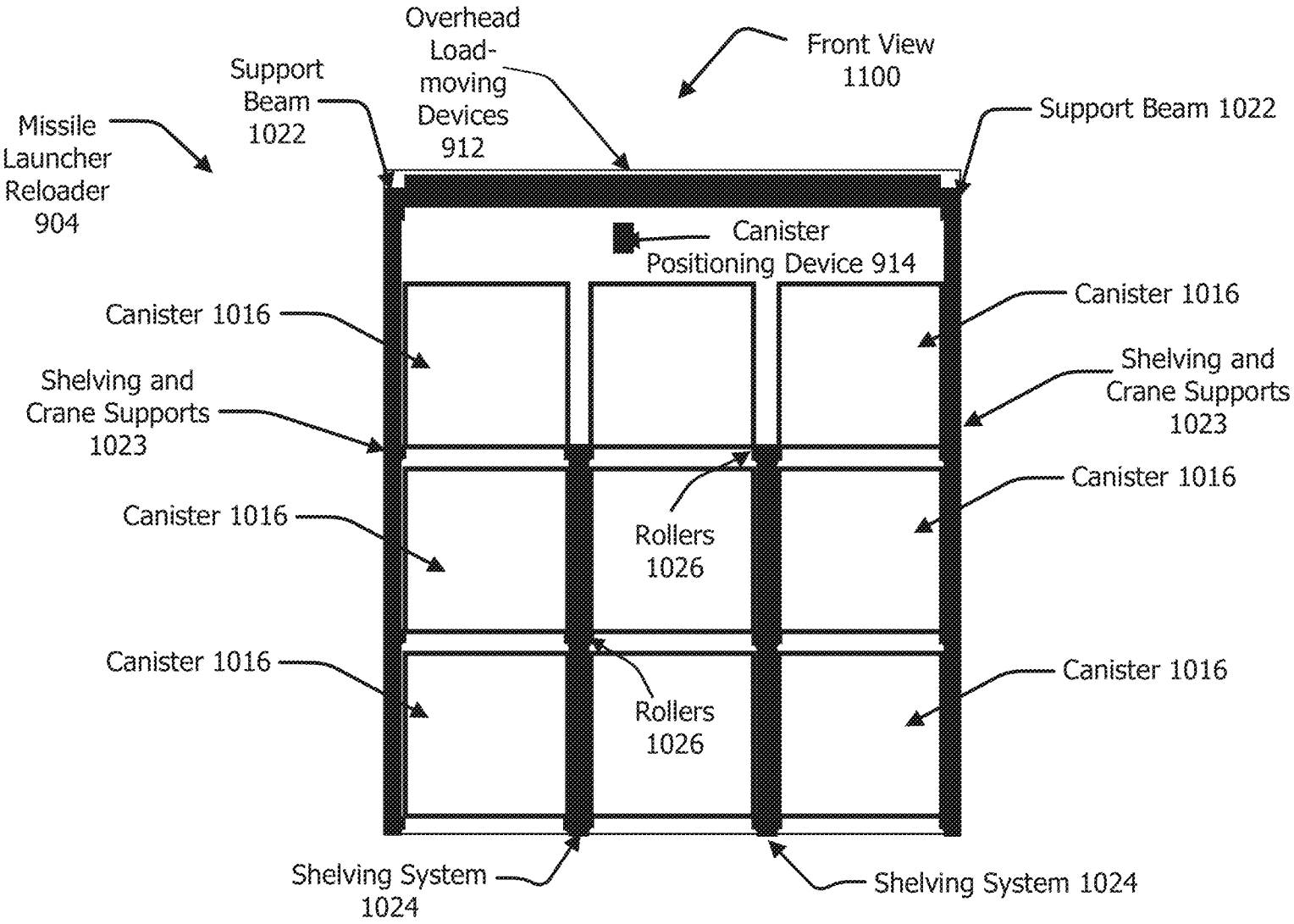
FIG. 11 illustrates a front view of a missile launcher reloader, in accordance with the second embodiment.

FIG. 11 illustrates a front view 1100 of missile launcher reloader 904, in accordance with the second embodiment. In certain embodiments, canister positioning device 914 of FIG. 11 includes a strongback (e.g., strongback 130 of FIG. 2) coupled to one or more overhead load-moving devices 912. As illustrated in FIG. 11, missile launcher reloader 904 includes support beams 1022, shelving and crane supports 1023, shelving systems 1024, and rollers 1026.

Figure 12:
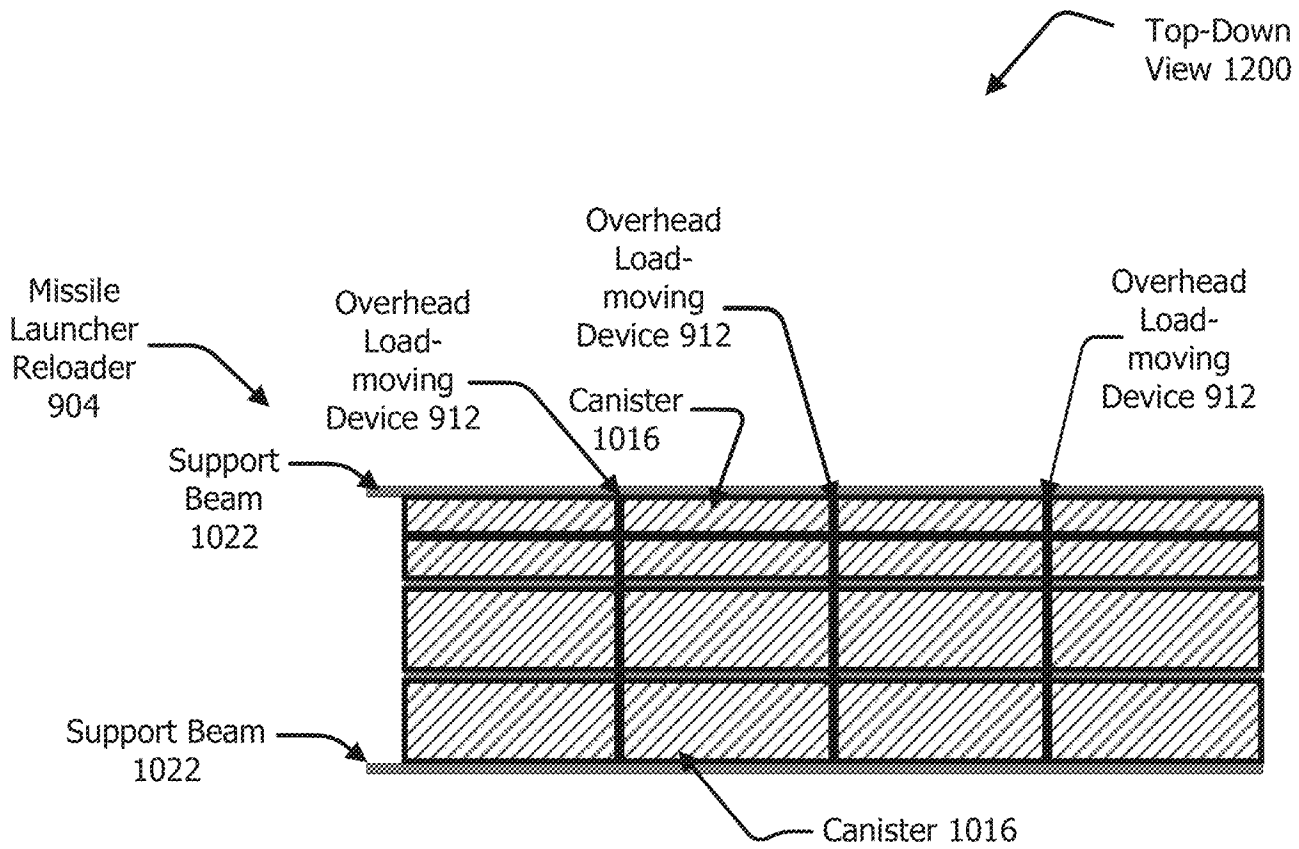
FIG. 12 illustrates a top-down view of a missile launcher reloader, in accordance with the second embodiment.

FIG. 12 illustrates a top-down view 1200 of missile launcher reloader 904, in accordance with the second embodiment. Missile launcher reloader 904 of FIG. 12 includes overhead load-moving devices 912, canisters 1016, and support beams 1022.

Figure 13:
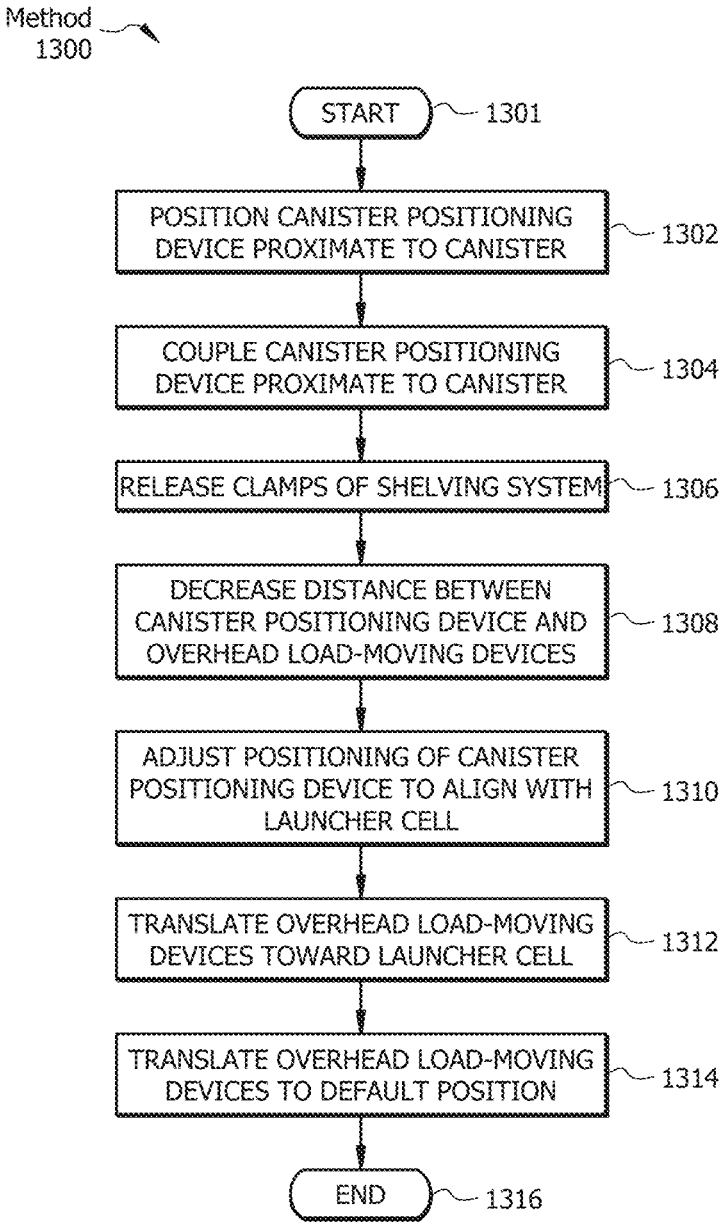
FIG. 13 illustrates a method for automated missile launcher reloading, in accordance with the second embodiment.

FIG. 13 illustrates a method 1300 for automated missile launcher reloading, in accordance with the second embodiment. Method 1300 may be performed by computing device 902, missile launcher reloader 904, and/or control system 910 of FIG. 9. FIG. 13 refers to FIGS. 14A through 14J, which illustrate the stages of automated missile launcher reloading at a missile launcher reloader, in accordance with the second embodiment. Certain operations described in method 1300 may be optional or may be rearranged in different embodiments.

Figure 14A:
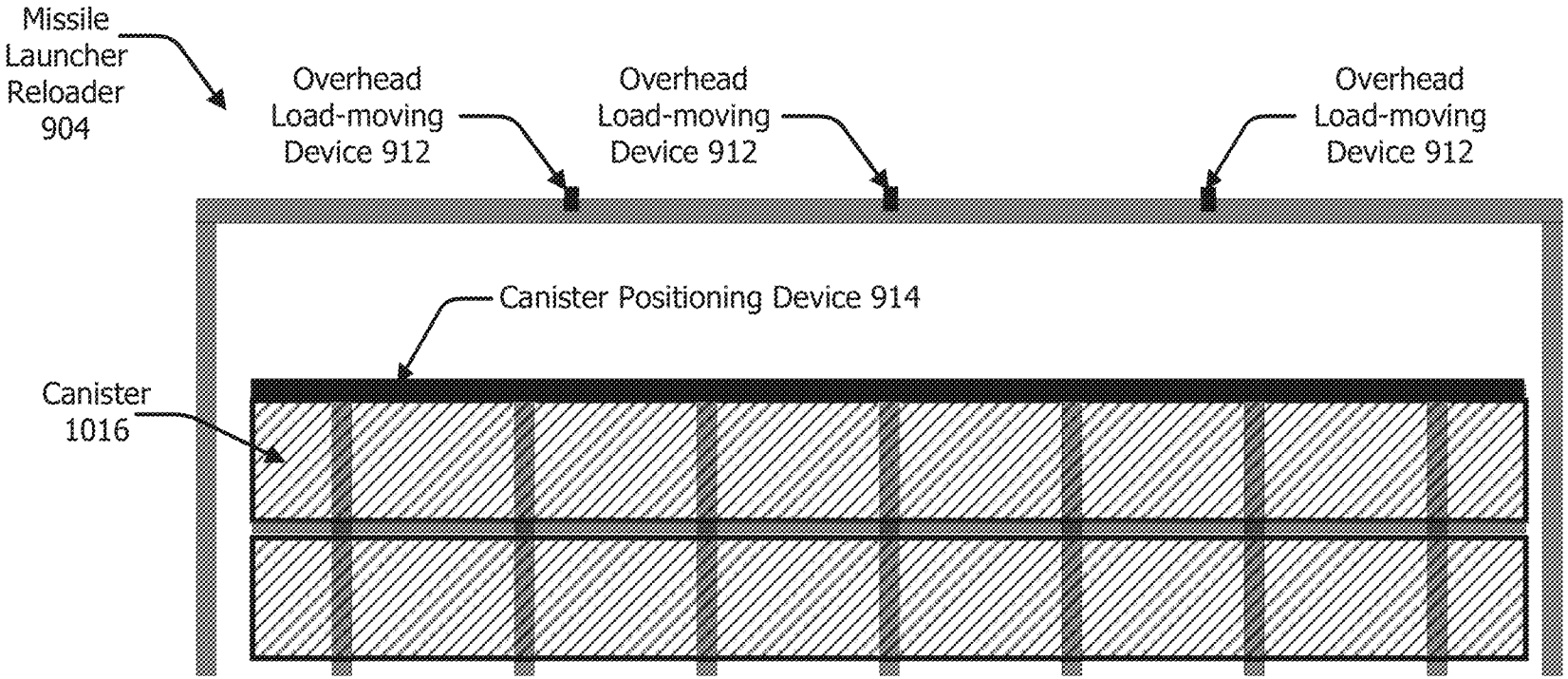
FIGS. 14A through 14J illustrate the stages of automated missile launcher reloading at the missile launcher reloader, in accordance with the second embodiment.
Figure 14B:
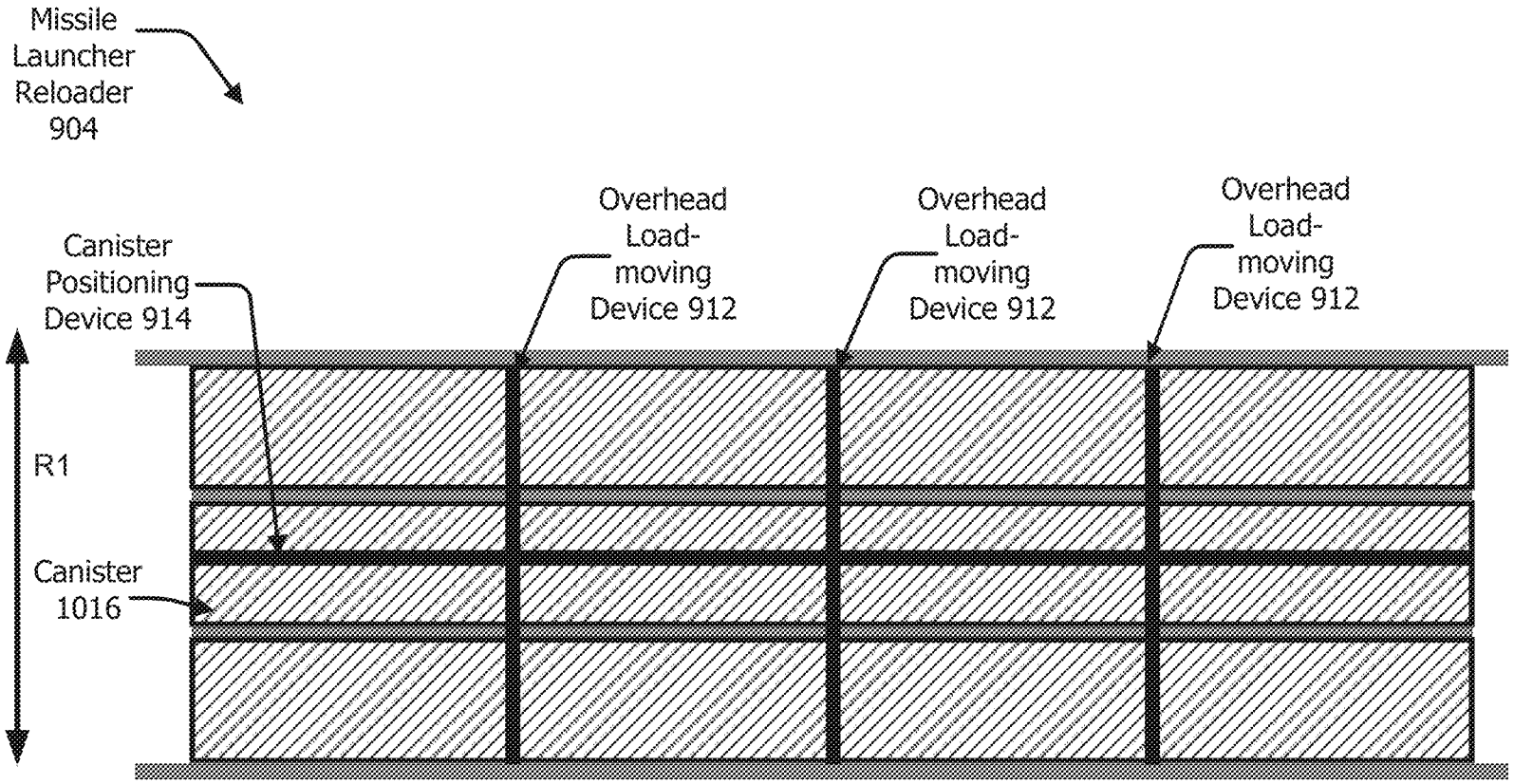

Method 1300 begins at step 1301. At step 1302, the canister positioning device is positioned proximate to the canister. For example, referring to FIGS. 9 through 12, control system 910 may provide a control signal to missile launcher reloader 904 such that overhead load-moving devices 1012 traverse canister positioning device 914 along a direction to be proximate to canister 1016. As illustrated in FIG. 14A and FIG. 14B, canister positioning device 914 is positioned proximate to the canister 1016. In the illustrated embodiment of FIG. 14B, overhead load-moving devices 1012 traverse canister positioning device 914 along direction R1 to be proximate to canister 1016. Method 1300 then moves from step 1302 to step 1304.

At step 1304 of method 1300, the canister positioning device is coupled to the canister. For example, referring to FIGS. 9 through 12, control system 910 may provide a control signal to missile launcher reloader 904 such that canister positioning device 914 couples to canister 1016. In certain embodiments, the canister positioning device is coupled to the canister by engaging clamps (see, e.g., clamps 132 of FIG. 2) of the canister positioning device. For example, referring to FIGS. 9 through 12, canister positioning device 914 may be coupled to canister 1016 by engaging the clamps with canister 1016 to couple canister positioning device 914 with canister 1016. Method 1300 then moves from step 1304 to step 1306.

At step 1306 of method 1300, one or more clamps of the shelving system may be released that previously coupled the canister with the shelving system. For example, referring to FIGS. 9 through 12, control system 910 may provide a control signal to missile launcher reloader 904 such that the clamps of shelving system 1024 release to uncouple canister 1016 from shelving system 1024. Method 1300 then moves from step 1306 to step 1308.

Figure 14C:
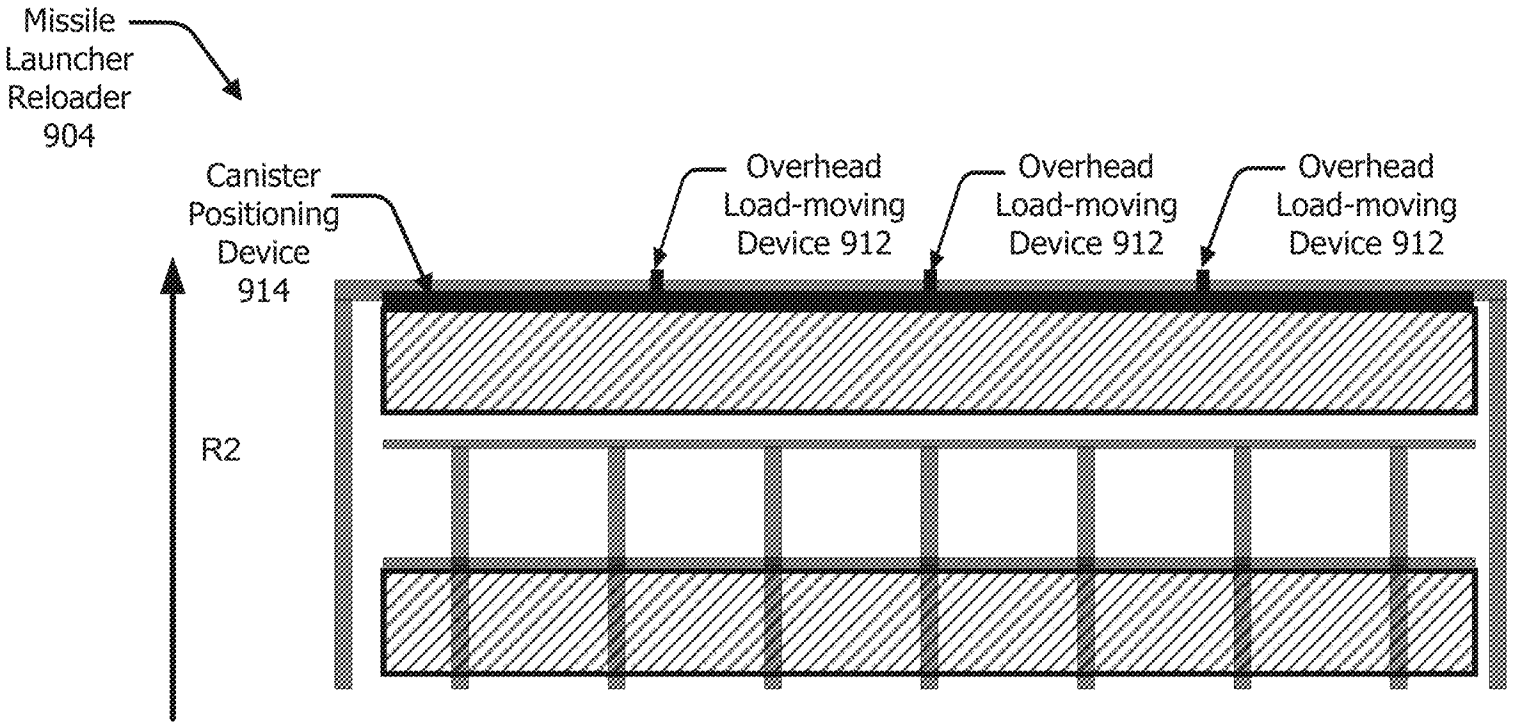

At step 1308 of method 1300, a distance between the canister positioning device and the overhead load-moving devices is decreased. For example, referring to FIGS. 9 through 12, control system 910 may provide a control signal to missile launcher reloader 904 such that overhead load-moving devices 912 translate (e.g., raise) canister positioning device 914 toward overhead load-moving devices 912. As illustrated in FIG. 14C, overhead load-moving devices 912 move (e.g., raise) canister positioning device 914 toward overhead load-moving devices 912 to decrease the distance therebetween. Method 1300 then moves from step 1308 to step 1310.

At step 1310 of method 1300, a positioning of the canister positioning device is adjusted to align the canister with the launcher cell. For example, referring to FIGS. 9 through 12 and FIGS. 14A through 14C, control system 910 may provide a control signal to missile launcher reloader 904 such that overhead load-moving devices 912 traverse canister positioning device 914 along a direction R1 to align canister 1016 with launcher cell 906. In certain embodiments, the launcher cell includes sensors to facilitate determining an alignment between the canister and the launcher cell. For example, referring to FIGS. 9 through 12, a positional alignment of canister 1016 may be determined with respect to launcher cell 906 in a first direction and a second direction. In certain embodiments, referring to FIG. 14B and FIG. 14C, the positional alignment of canister 1016 is determined with respect to launcher cell 906 in first direction R1 and second direction R2. The sensors of missile launcher reloader 904 may determine the positional alignment between canister 1016 and launcher cell 906 along direction R1 and/or direction R2.

In some embodiments, the positioning of the canister positioning device is adjusted to align the canister with the launcher cell based on the positional alignment of the canister with respect to the launcher cell. For example, referring to FIGS. 9 through 12, control system 910 associated with missile launcher reloader 904 may receive signals from the sensors of missile launcher reloader 904 indicating the positional alignment of canister 1016 with respect to launcher cell 906. In response, control system 910 may provide a signal to missile launcher reloader 904 to adjust the positioning of canister positioning device 1014 to align canister 1016 with launcher cell 906 based on the signals received from the sensors. Method 1300 then moves from step 1310 to step 1312.

Figure 14D:
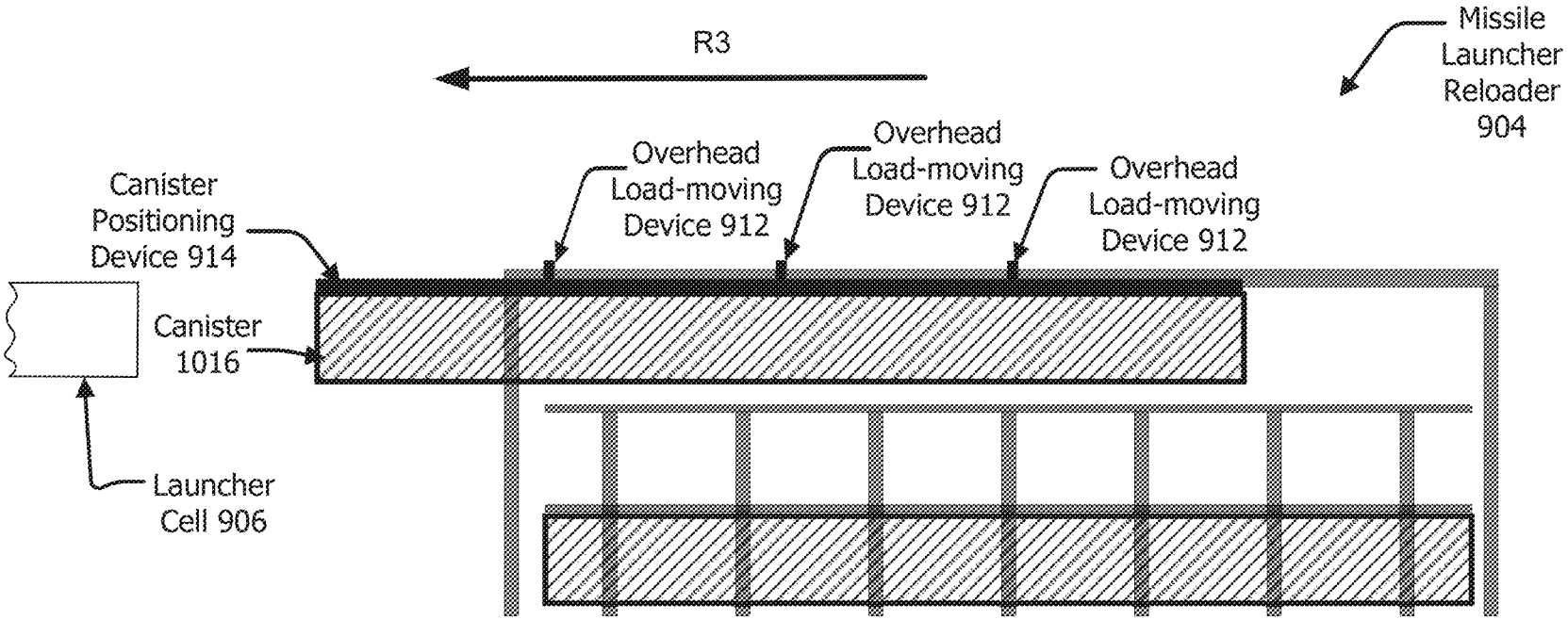
Figure 14E:
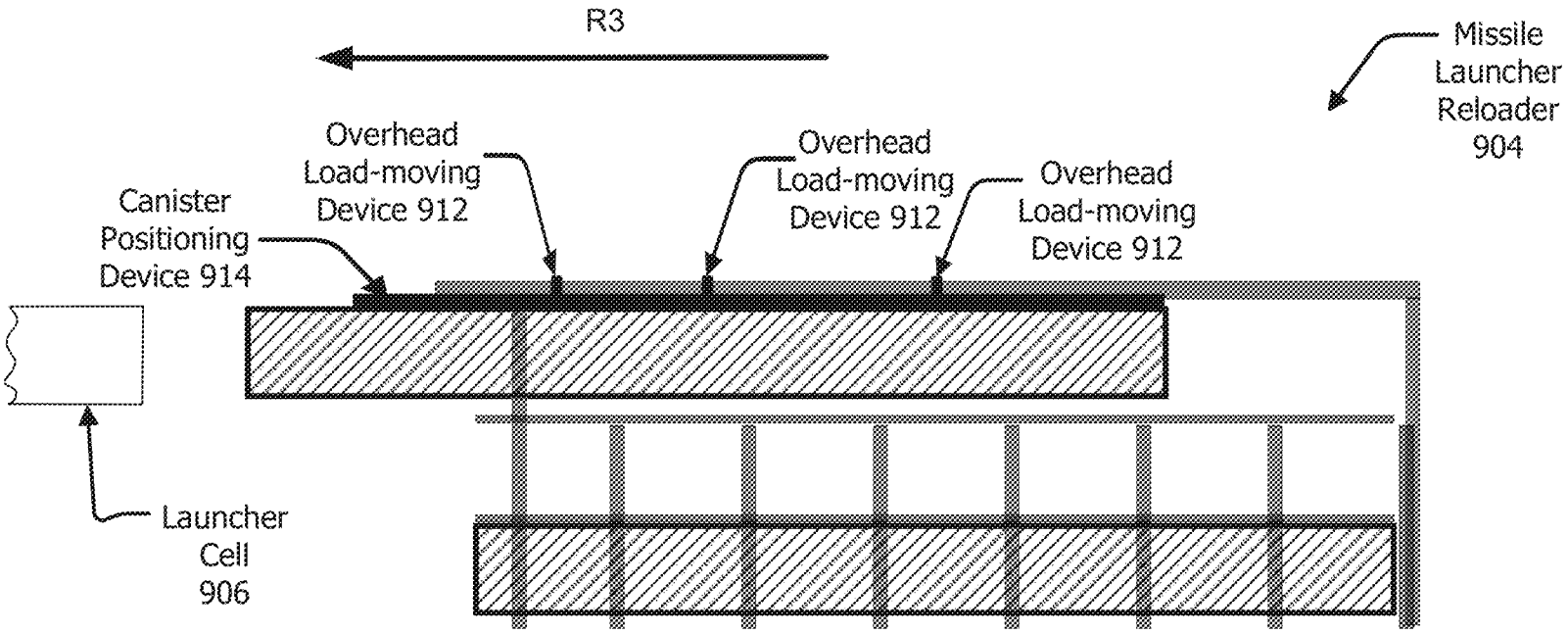
Figure 14F:
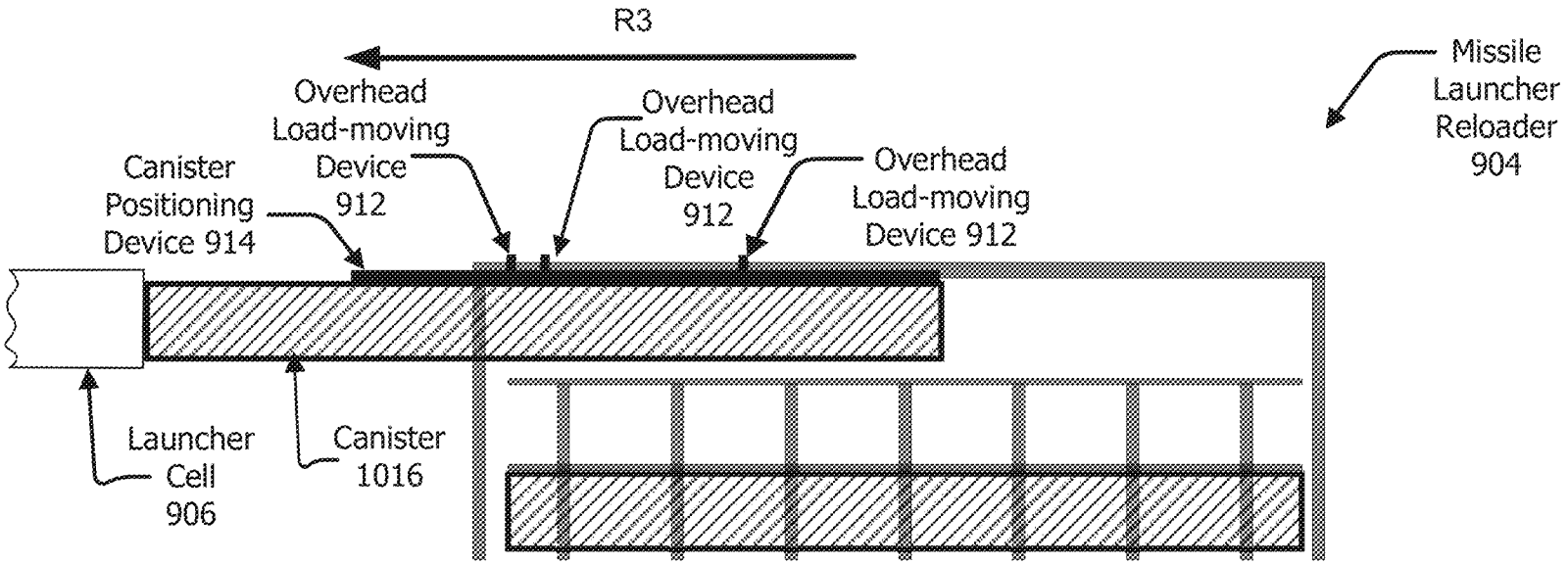

At step 1312 of method 1300, the overhead load-moving devices are translated toward the launcher cell to position the canister within the launcher cell. For example, referring to FIGS. 9 through 12, control system 910 may provide a control signal to missile launcher reloader 904 such that overhead load-moving devices 912 translate toward launcher cell 906. As illustrated in FIG. 14D, overhead load-moving devices 1012 translate along direction R3, and in turn translate canister 1016 from within missile launcher reloader 904 (and ultimately within launcher cell 906). In certain embodiments, overhead load-moving devices 1012 translate in unison along direction R3. As shown in FIG. 14E and FIG. 14F, as canister 1016 approaches launcher cell 906, a spacing between overhead load-moving devices 912 decreases as canister positioning device 914 begins to retract (telescopic) and disconnect from canister 916 as canister 1016 begins to be positioned within launcher cell 906.

In certain embodiments, coupling elements (e.g., clamps 132 of FIG. 2) of the canister positioning device are retracted to disconnect the canister positioning device when the canister becomes positioned within the launcher cell. For example, referring to FIGS. 9 through 12, control system 910 may provide a control signal to missile launcher reloader 904 such that the coupling elements (clamps) of canister positioning device 914 retract. In certain embodiments, the clamps of the canister positioning device begin to disengage from the canister that are proximate to the launcher cell. As the canister becomes more fully positioned within the launcher cell, additional clamps of the canister positioning device holding the canister at positions further away from the launcher cell may disengage.

Figure 14G:
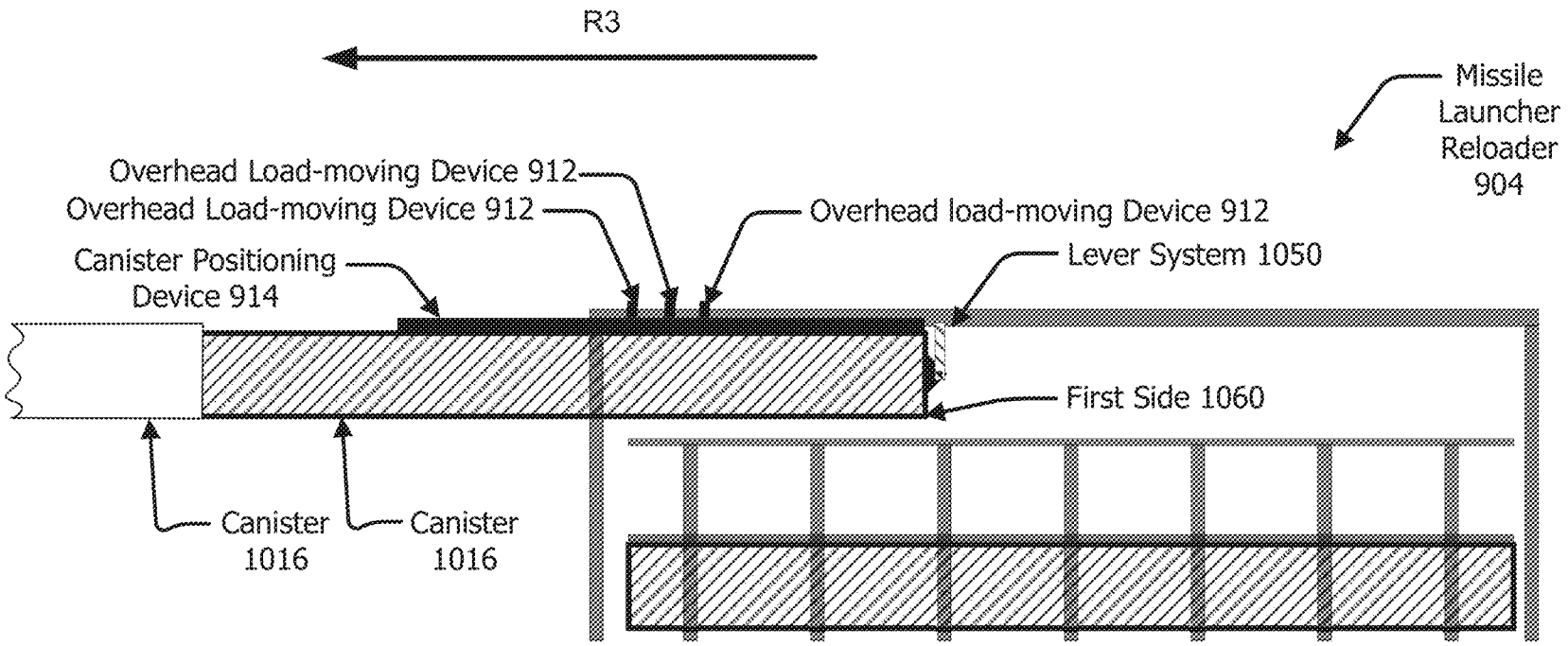
Figure 14H:
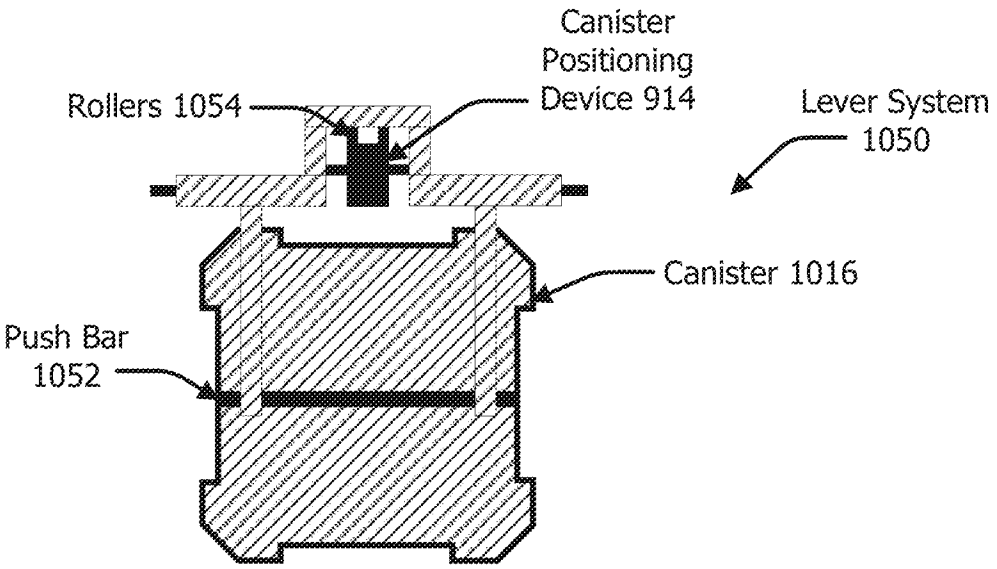

In certain embodiments, as each of overhead load-moving devices 912 reach their full travel (as illustrated in FIG. 14G), canister positioning device 914 is fully decoupled from canister 1016. In some embodiments, a lever system 1050 (e.g., a manual lever system) facilitates translating canister 1016 the remaining distance to complete the positioning of canister 1016 within launcher cell 906. After the coupling elements of canister positioning device 1014 are retracted, lever system 1050 may exert a force on a first side 1060 of canister 1016 to further position canister 1016 within launcher cell 906 (first side 1060 of canister 1016 being opposite to a side of canister 1016 that is initially positioned within launcher cell 906). In certain embodiments, lever system 1050 of FIG. 14G includes an automated winch, rail, or any other suitable system for completing the positioning of canister 1016 within launcher cell 906. FIG. 14H illustrates lever system 1050 in relation to canister 1016. As illustrated in FIG. 14H, lever system 1050 may be coupled to a push bar 1052 of canister 1016 and/or include rollers 1054 in contact with canister positioning device 914. Method 1300 then moves from step 1312 to step 1314.

Figure 14I:
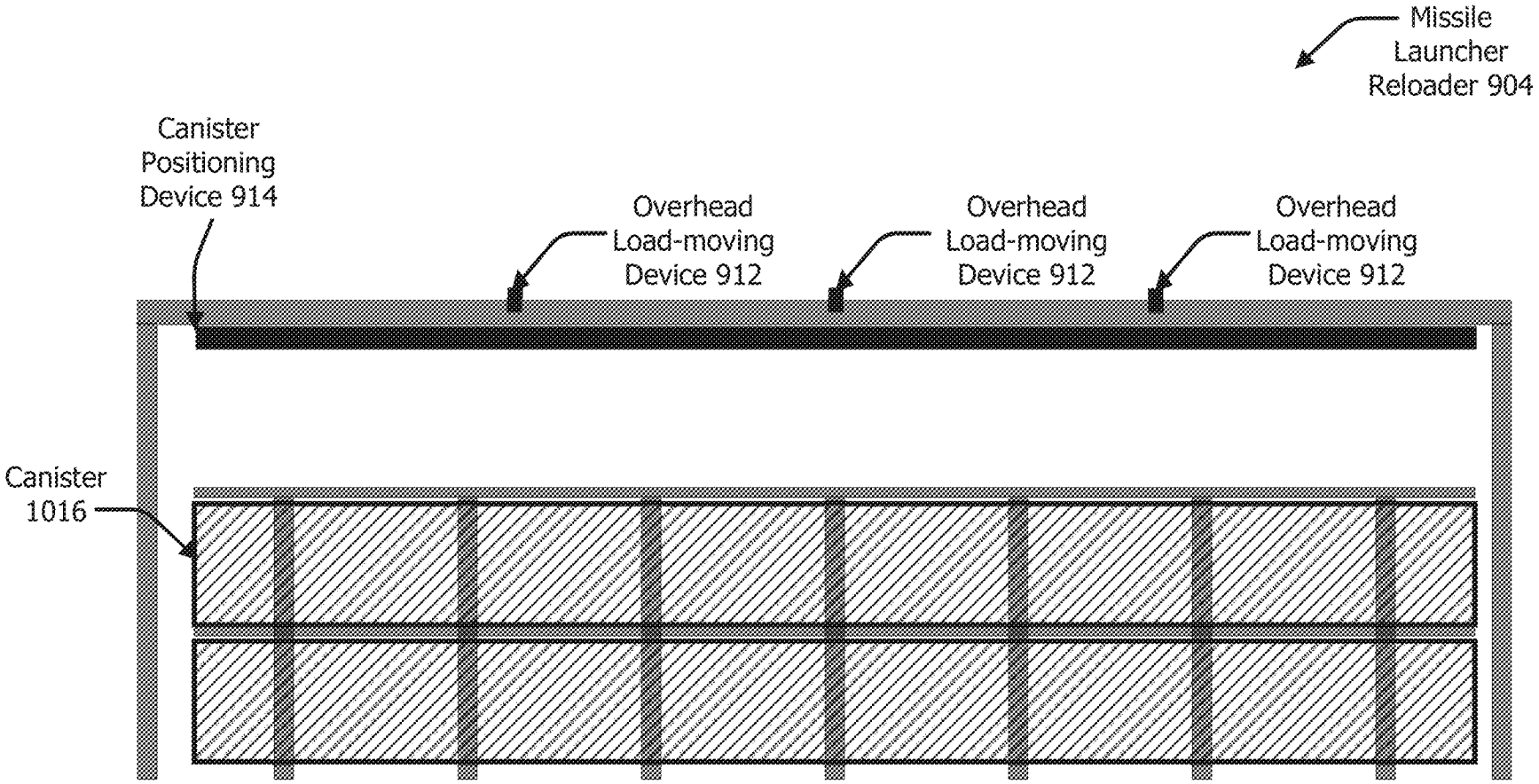

At step 1314 of method 1300, the overhead load-moving devices are translated to a default position and/or the overhead load-moving devices translate the canister positioning device to a default position. For example, referring to FIGS. 9 through 12, control system 910 may provide a control signal to missile launcher reloader 904 such that overhead load-moving devices 912 traverse to a default position, and overhead load-moving devices 912 traverse canister positioning device 914 to a default position. FIG. 14I illustrates overhead load-moving devices 912 and canister positioning device 914 in default positions.

Figure 14J:
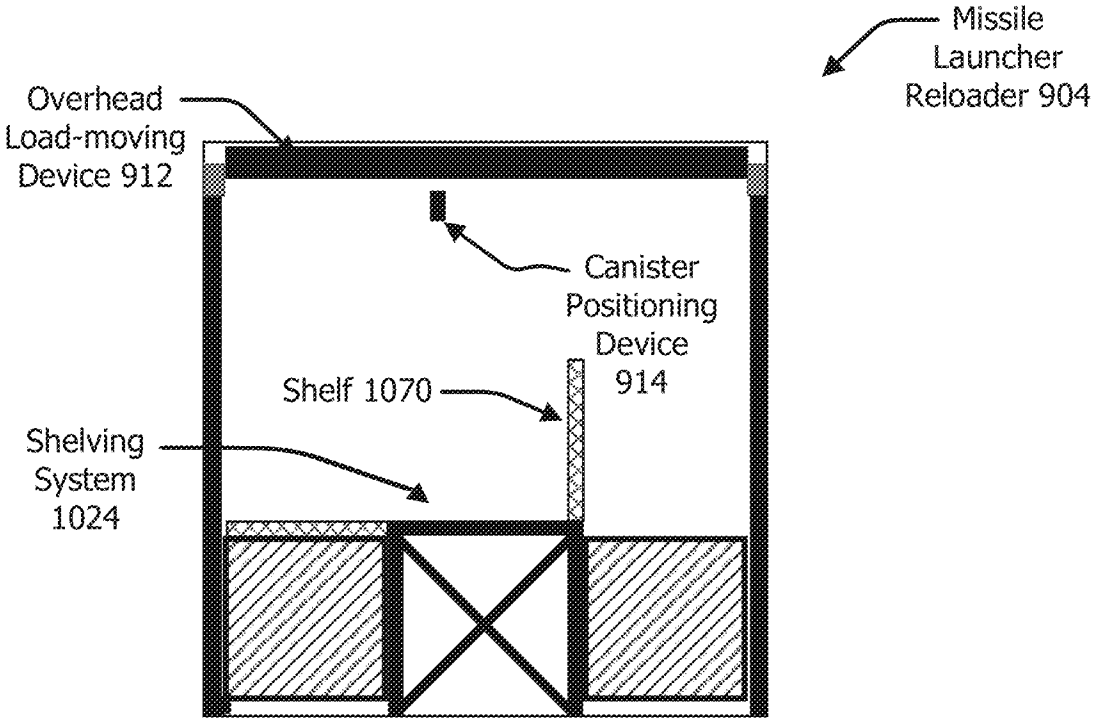

In certain embodiments, as illustrated in FIG. 14J, when canister 1016 is cleared of shelving system 1024, a shelf 1070 previously holding canister 1016 is raised for access to an underlying canister. For example, referring to FIGS. 9 through 12, control system 910 may provide a control signal to shelving system 1024 to rotate shelf 1070 (e.g., via a hinge) from a horizontal position to a vertical position. Method 1300 then moves from step 1314 to step 1316, where method 1300 ends.

Although this disclosure describes and illustrates particular steps method 1300 of FIG. 13 as occurring in a particular order, this disclosure contemplates any suitable steps of method 1300 of FIG. 13 occurring in any suitable order. Although this disclosure describes and illustrates an example method for automated missile launcher reloading including the particular steps of the method of FIG. 13, this disclosure contemplates any suitable method for automated launcher reloading including any suitable steps, which may include all, some, or none of the steps of the method of FIG. 13, where appropriate. Furthermore, although FIG. 13 describes and illustrates particular components, devices, or systems carrying out particular actions, this disclosure contemplates any suitable combination of any suitable components, devices, or systems carrying out any suitable actions.

Although FIGS. 9 through 12 and FIGS. 14A through 14J illustrate particular number of components, devices, or systems, this disclosure contemplates any suitable number of components, devices, or systems. Although FIGS. 9 through 12 and FIGS. 14A through 14J illustrate particular arrangements of certain components, devices, or systems, this disclosure contemplates any suitable arrangement of components, devices, or systems. Furthermore, although 9 through 12 and FIGS. 14A through 14J describe and illustrate particular components, devices, or systems carrying out particular actions, this disclosure contemplates any suitable combination of any suitable components, devices, or systems carrying out any suitable actions.

Figure 15:
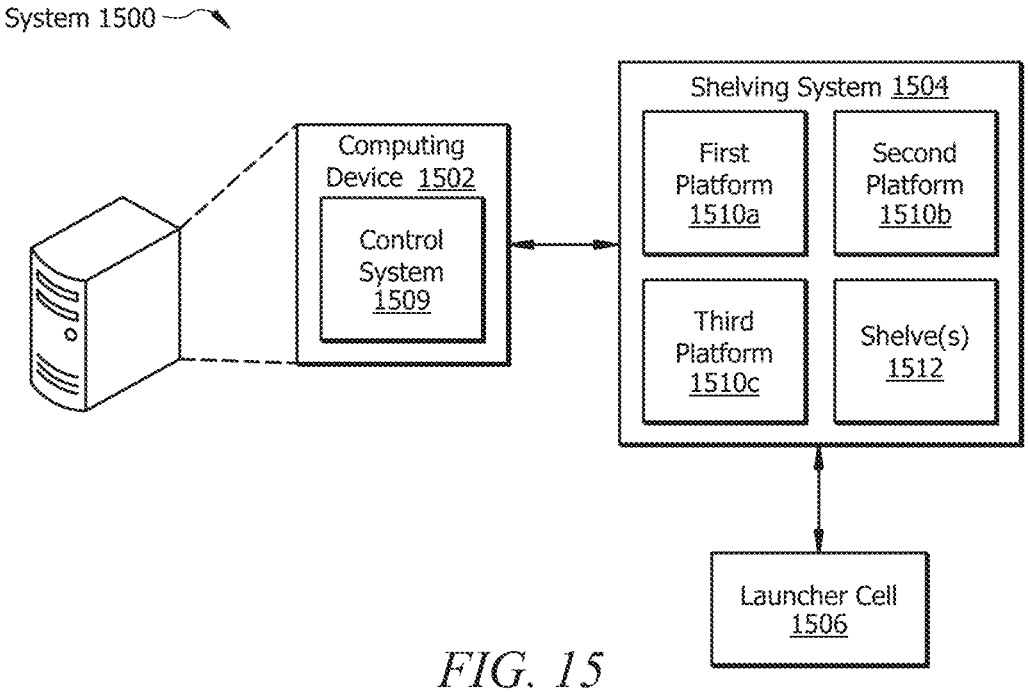
FIG. 15 illustrates a system for a computing device, a shelving system, and a launcher cell, in accordance with a third embodiment.

FIG. 15 illustrates a system 1500 for a computing device 1502, a shelving system 1504, and a launcher cell 1506, in accordance with a third embodiment. System 1500 or portions thereof may be associated with an entity, which may include any entity, such as a business, company, or enterprise, that is associated with missile launcher reloaders. For example, system 150 may be associated with the United States Armed Forces (e.g., the Navy, the Army, the Air Force, etc.). The components of system 1500 may include any combination of hardware, firmware, and software. For example, the components of system 1500 may use one or more elements of the computer system of FIG. 28.

In the illustrated embodiment of FIG. 15, computing device 1502 includes a control system 1509. In certain embodiments, control system 1509 is included by a memory of computing device 1502. In some embodiments, control system 1509 includes a computer-executable program (software) that is executed by a processor of computing device 1502. Computing device 1502 can be in communication with shelving system 1504. In certain embodiments, shelving system 1504 of system 100 is automated. For example, shelving system 1504 may perform certain actions in response to one or more signals received from computing device 1502 without needing human control.

In the illustrated embodiment of FIG. 15, shelving system 1504 includes platforms 1510 (a first platform 1510*a*, a second platform 1510*b*, and a third platform 1510*c*) and one or more shelves 1512. Control system 1509 may be in communication with any portion of shelving system 1504, including one or more platforms 1510. In certain embodiments, control system 1509 is configured to provide control signals to shelving system 1504 to control the actions of shelving system 1504. For example, control system 1509 may be configured to provide control signals to platforms 1510 to control platform 1510 to perform certain actions, as described further herein.

Figure 16:
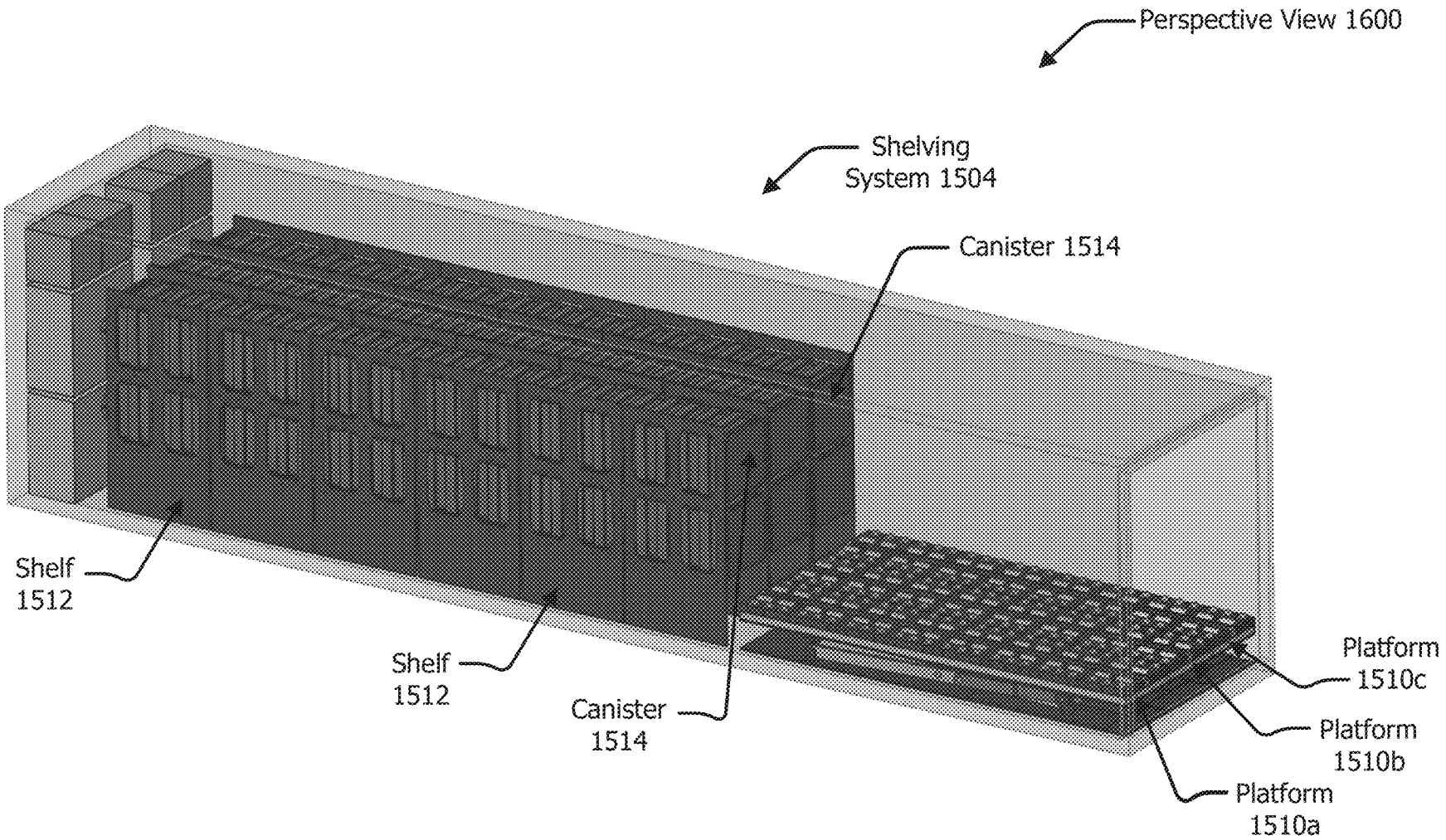
FIG. 16 illustrates a perspective view of a shelving system, in accordance with the third embodiment.
Figures 17, 18:
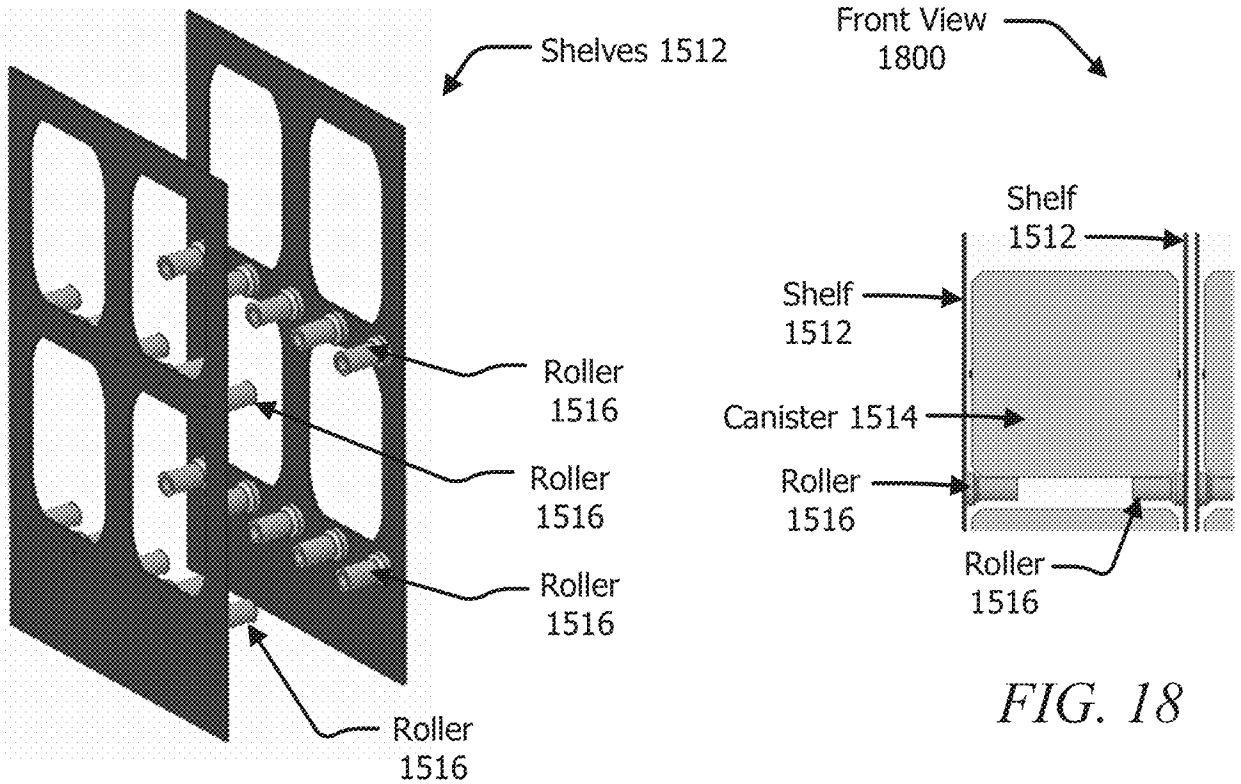
FIG. 17 illustrates a perspective view of shelves of a shelving system, in accordance with the third embodiment.
FIG. 18 illustrates a front view of the shelf of a shelving system, in accordance with the third embodiment.

FIG. 16 illustrates a perspective view 1600 of shelving system 1504, in accordance with the third embodiment. Shelving system 1504 includes platforms 1510, shelves 1512, and canisters 1514. FIG. 17 illustrates a perspective view 1700 of shelves 1512 of shelving system 1504, in accordance with the third embodiment. FIG. 18 illustrates a front view 1800 of shelves 1512 of shelving system 1504, in accordance with the third embodiment. As illustrated in FIGS. 17 and 18, one or more shelves 1512 may include one or more rollers 1516 for facilitating movement of canisters 1514 from storage to the launcher cell. In certain embodiments, rollers 1516 may include a chamfered profile.

Figure 19:
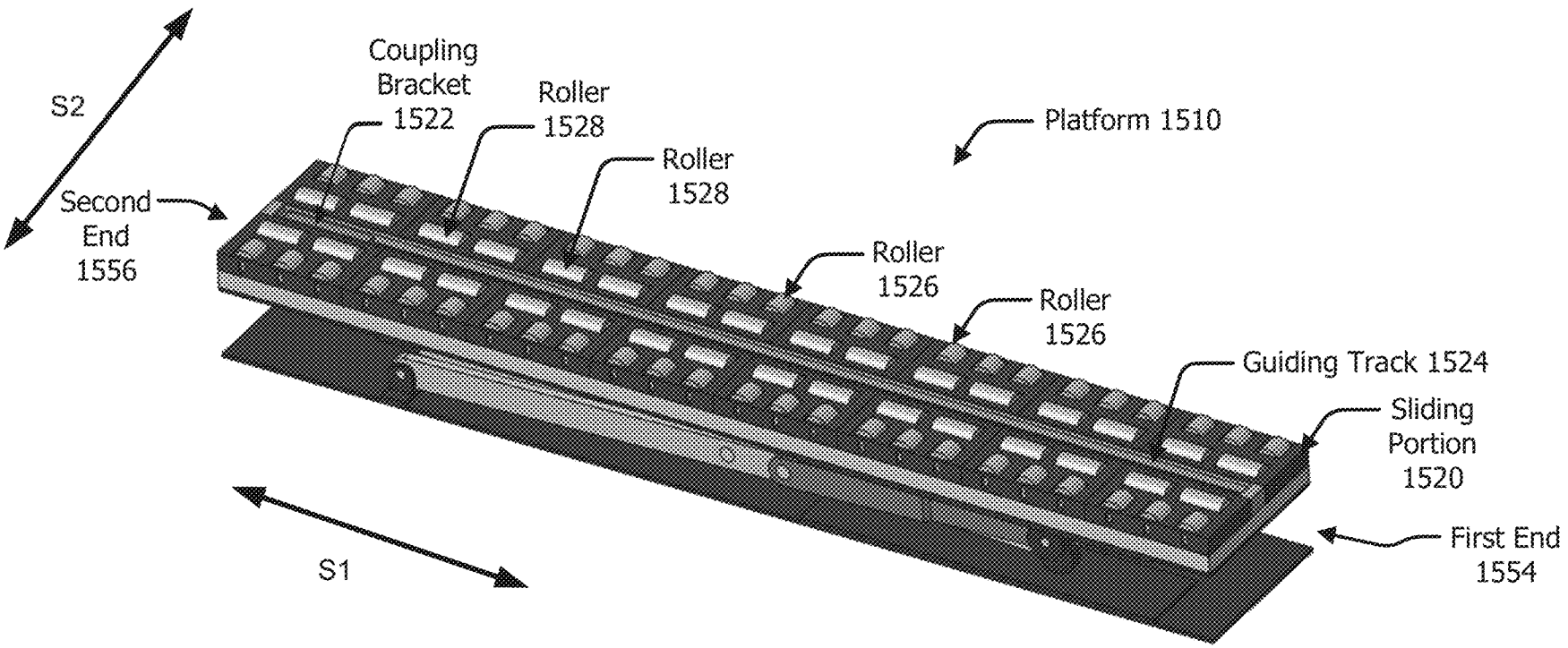
FIG. 19 illustrates a perspective view of a platform of a shelving system, in a first position, in accordance with the third embodiment.

FIG. 19 illustrates a perspective view 1900 of platform 1510 of shelving system 1504, in accordance with the third embodiment. In the illustrated embodiment of FIG. 19, platform 1510 of shelving system 1504 is in a first position (or first state). Platform 1510 includes a sliding portion 1520 and a coupling bracket 1522 positioned within a guiding track 1524. In certain embodiments, platform 1510 includes rollers 1526 enabling translation of a canister in a first direction S1. In some embodiments, platform 1510 includes rollers 1528 that enable translation of the canister in a second direction S2 orthogonal to the first direction S1. In some embodiments, rollers 1526 and rollers 1528 are powered. In the illustrated embodiment of FIG. 19, sliding portion 1520 includes a first end 1554 and a second end 1556.

Figure 20:
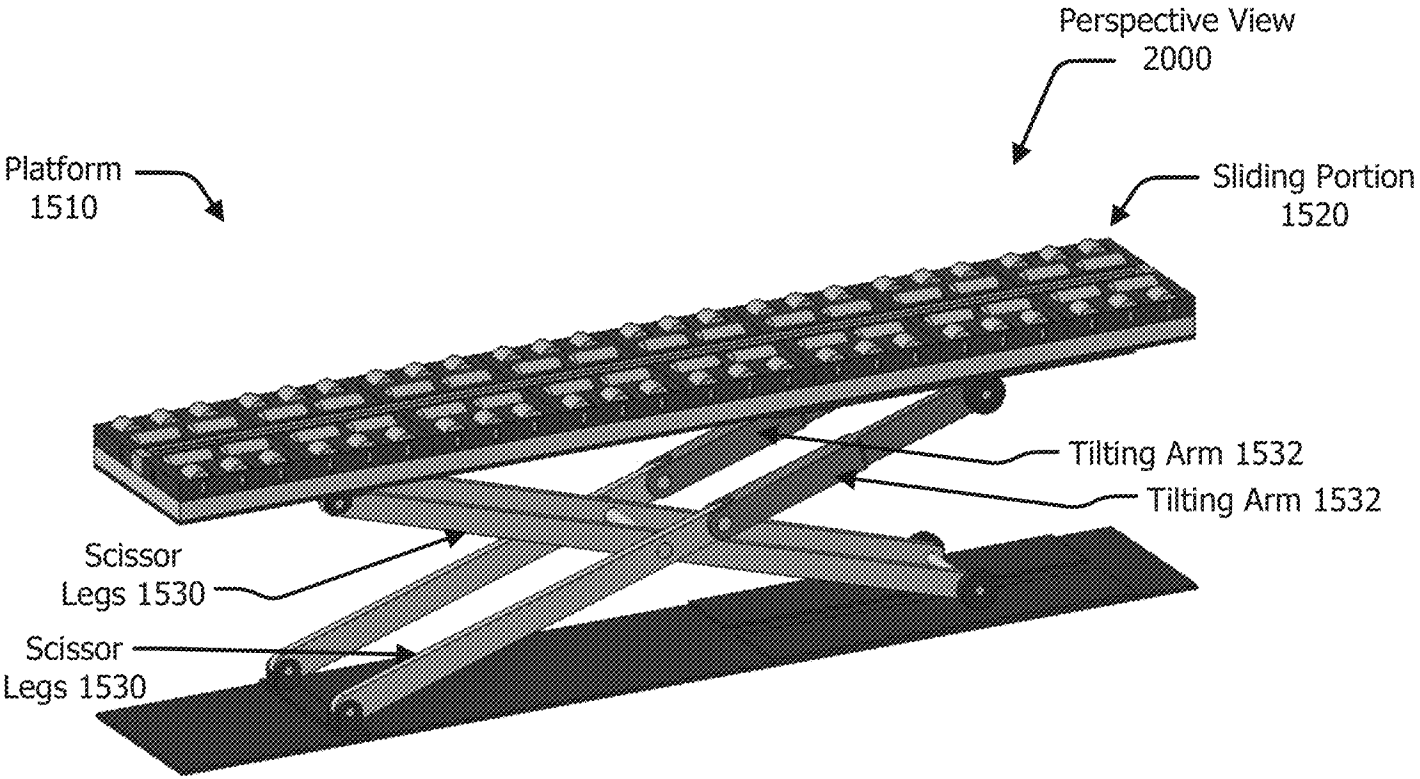
FIG. 20 illustrates a perspective view of a platform of a shelving system, in accordance with the third embodiment.

FIG. 20 illustrates a perspective view 2000 of platform 1510 of shelving system 1504, in accordance with the third embodiment. In the illustrated embodiment of FIG. 20, platform 1510 of shelving system 1504 is in a second position (or second state). Platform 1510 includes scissor legs 1530 and tilting arms 1532. Scissor legs 1530 may be used to adjust the vertical positioning of platform 1510 between the first and the second positions. Tilting arms 1532 may be used to adjust a pitch or angle of sliding portion 1520.

Figure 21:
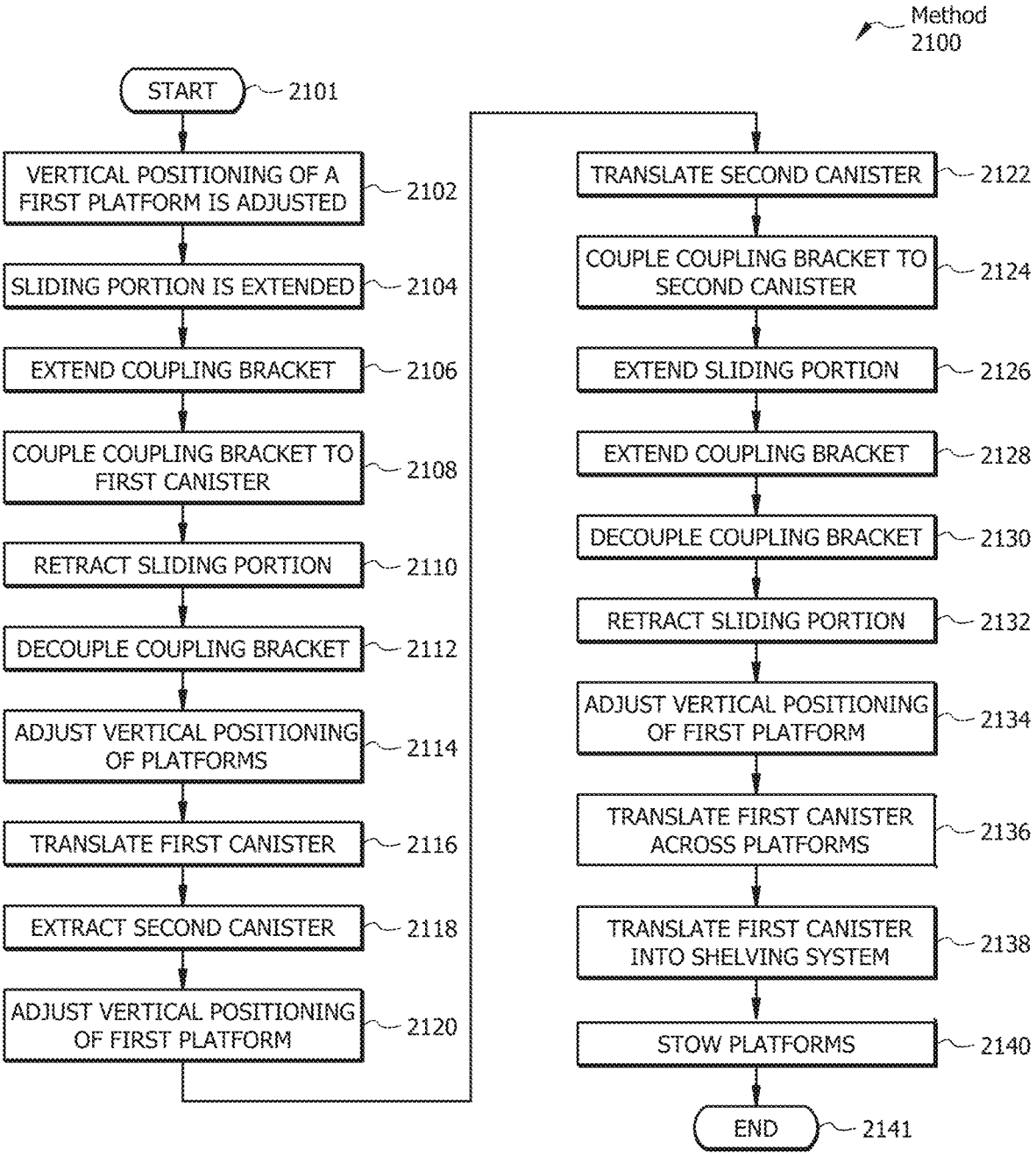
FIG. 21 illustrates a method for automated missile launcher reloading, in accordance with the third embodiment.

FIG. 21 illustrates a method for automated missile launcher reloading, in accordance with the third embodiment. Method 2100 may be performed by computing device 1502, shelving system 1504, and/or control system 1509, and with reference to FIGS. 15 through 20. FIG. 21 refers to FIGS. 22A through 22ZB, which illustrate the stages of automated missile launcher reloading at a missile launcher reloader, in accordance with the third embodiment. Certain operations described in method 2100 may be optional or may be rearranged in different embodiments.

Figure 22A:
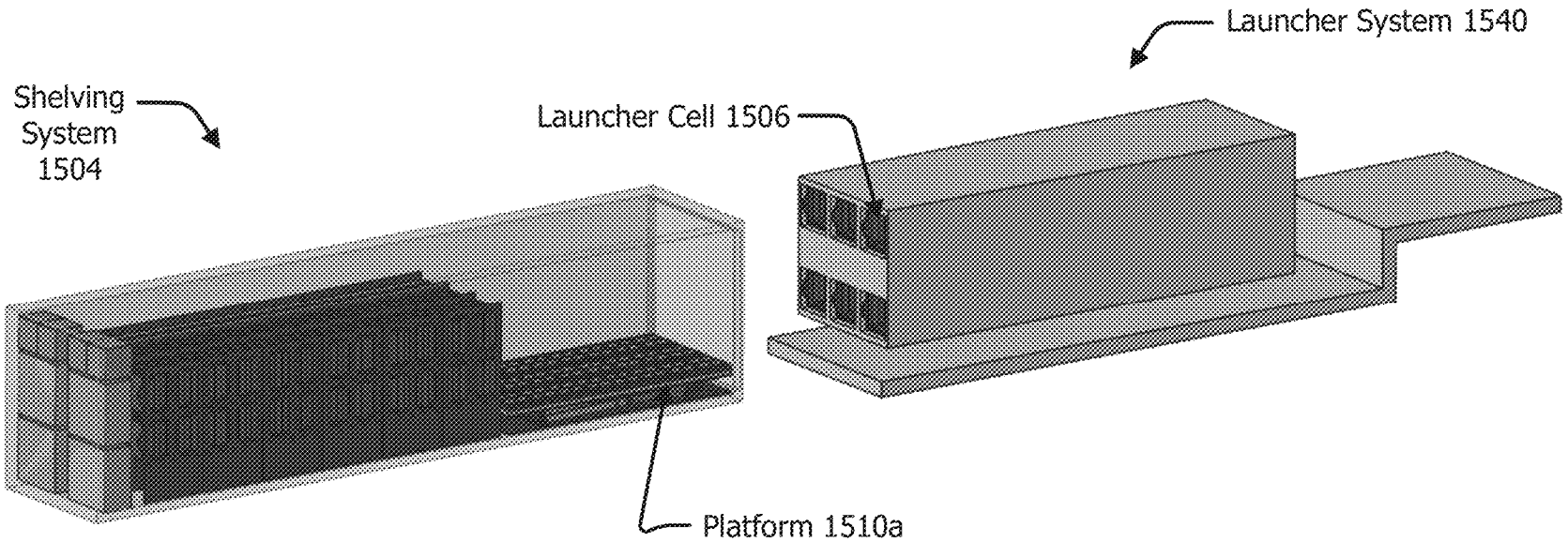
FIGS. 22A through 22ZB illustrate stages of automated missile launcher reloading at the missile launcher reloader, in accordance with the third embodiment.
Figure 22B:
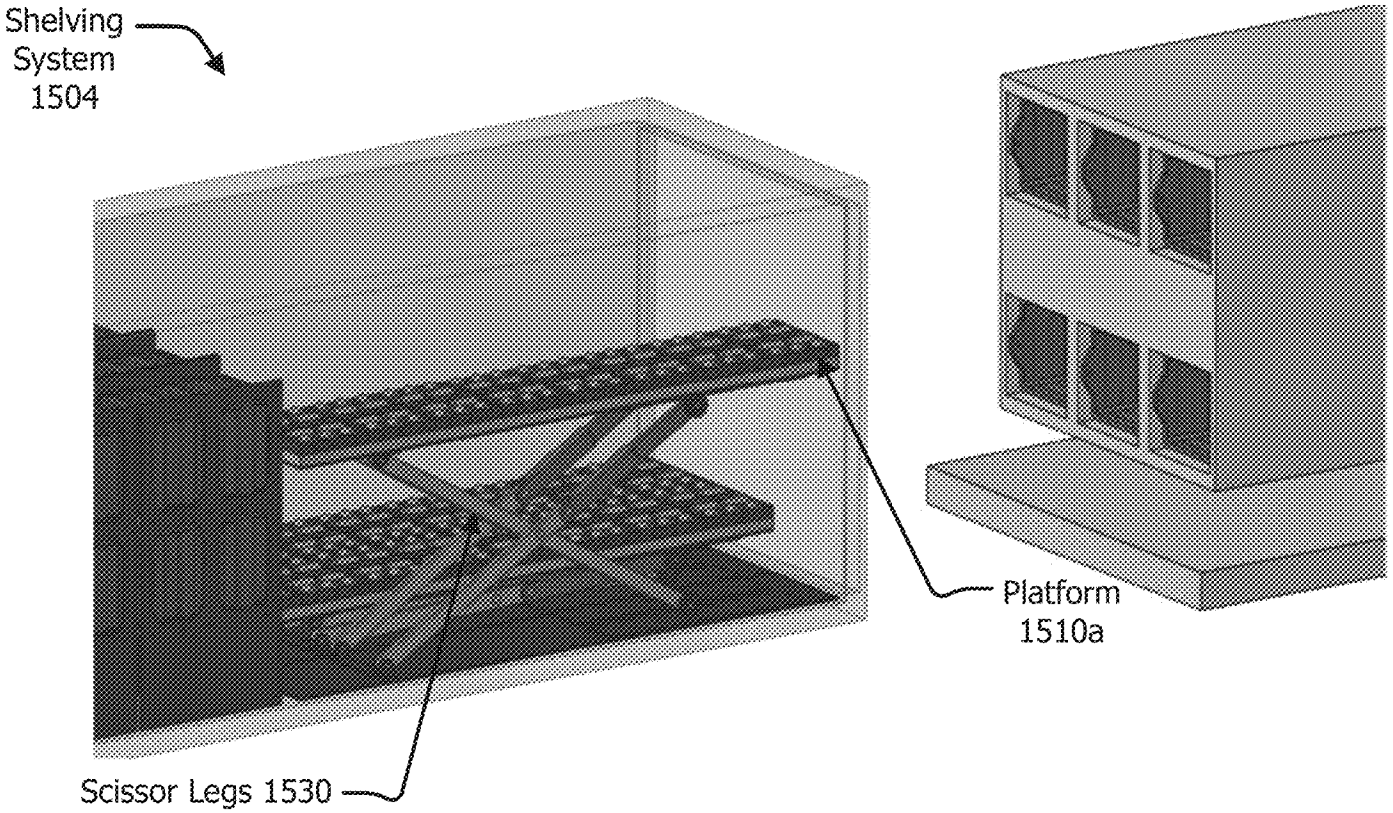

Method 2100 begins at step 2101. At step 2102 of method 2100, a vertical positioning of the first platform is adjusted to align with the launcher cell. For example, referring to FIGS. 15 through 20, control system 1509 may provide a control signal to shelving system 1504 to extend scissor legs 1530 of first platform 1510*a* to raise first platform 1510*a* from the first position to the second position. FIG. 22A illustrates shelving system 1504 in a first position, in accordance with certain embodiments. In FIG. 22A, shelving system 1502 is proximate to launcher cell 1506 (of a launch system), with first platform 1510*a* in the first position. FIG. 22B illustrates first platform 1510*a* in a second position, in accordance with certain embodiments. In FIG. 22B, scissor legs 1530 have raised first platform 1510*a* from the first position to the second position. Method 2100 then moves from step 2102 to step 2104.

Figure 22C:
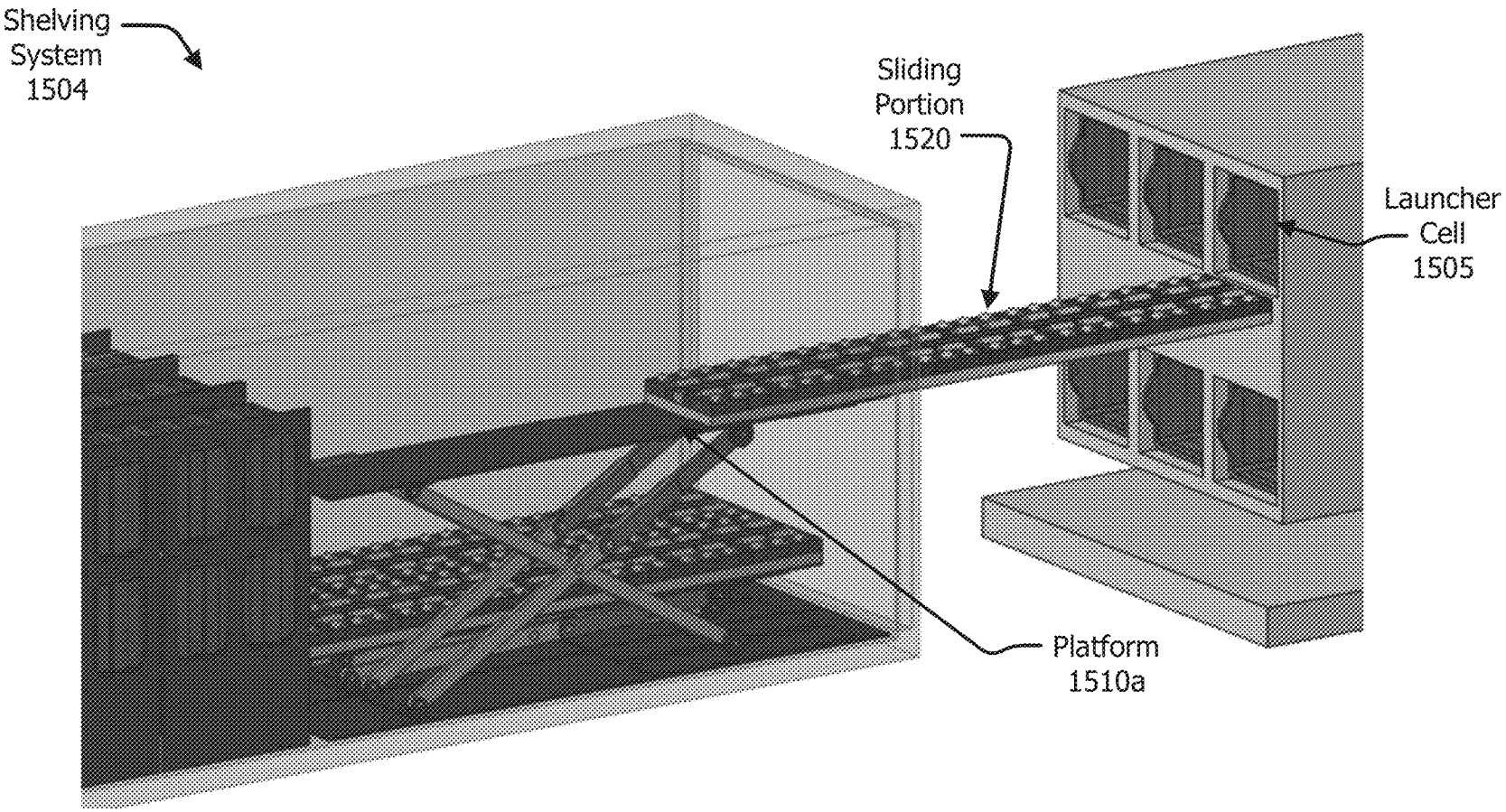

At step 2104 of method 2100, the sliding portion of the first platform is extended toward the launcher cell. For example, referring to FIGS. 15 through 20, control system 1509 may provide a control signal to shelving system 1504 to extend sliding portion 1520 of first platform 1510*a*. FIG. 22C illustrates sliding portion 1520 of first platform 1510*a*, in accordance with certain embodiments. As illustrated in FIG. 22C, sliding portion 1520 of first platform 1510*a* is extended toward launcher cell 1506. In certain embodiments, the tilting arms (e.g., tilting arms 1532 of FIG. 20) adjust a pitch or an angle of sliding portion 1520 to facilitate alignment between first platform 1510*a* and launcher cell 1506. Method 2100 then moves from step 2104 to step 2106.

Figure 22D:
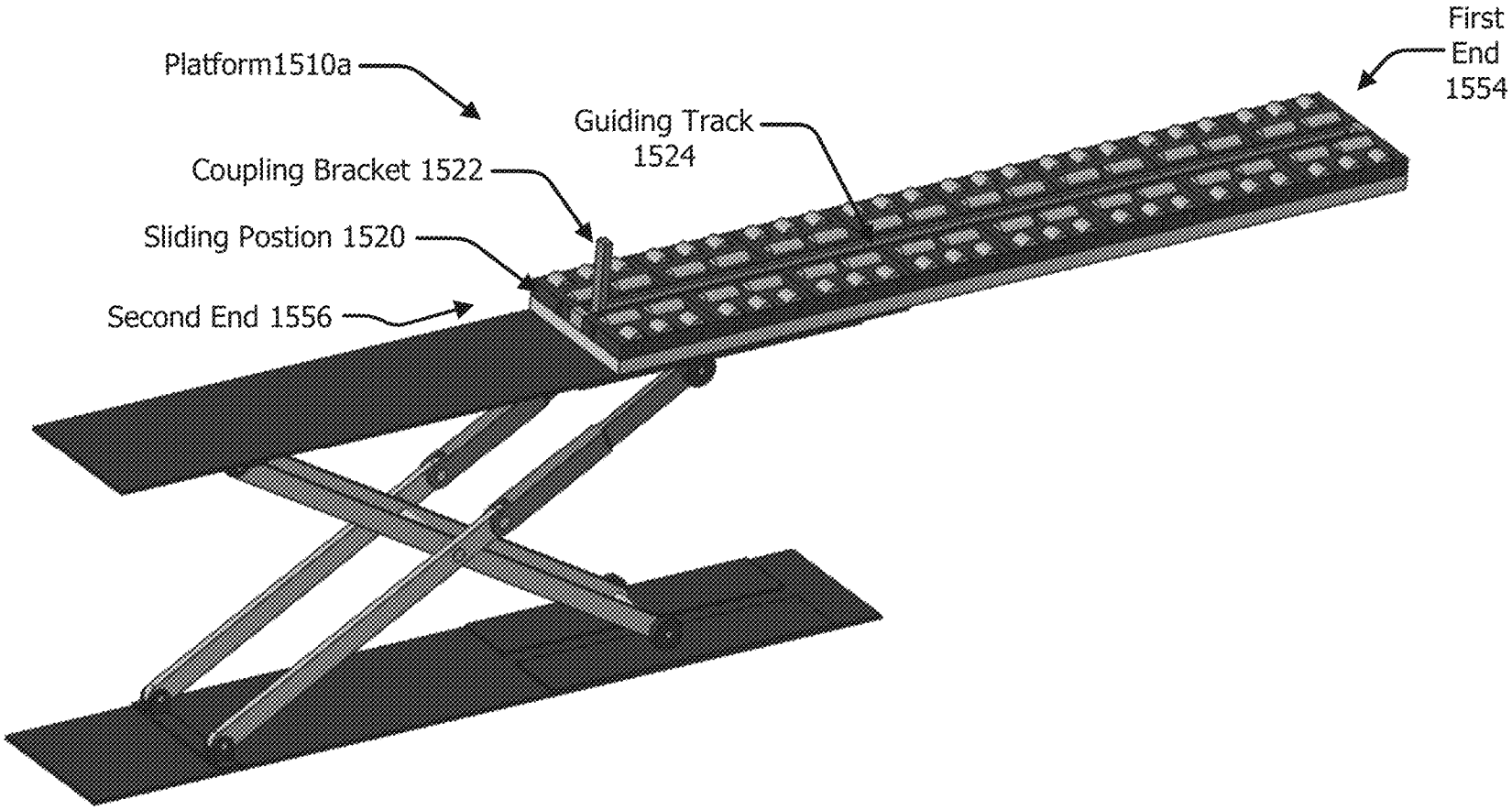
Figure 22E:
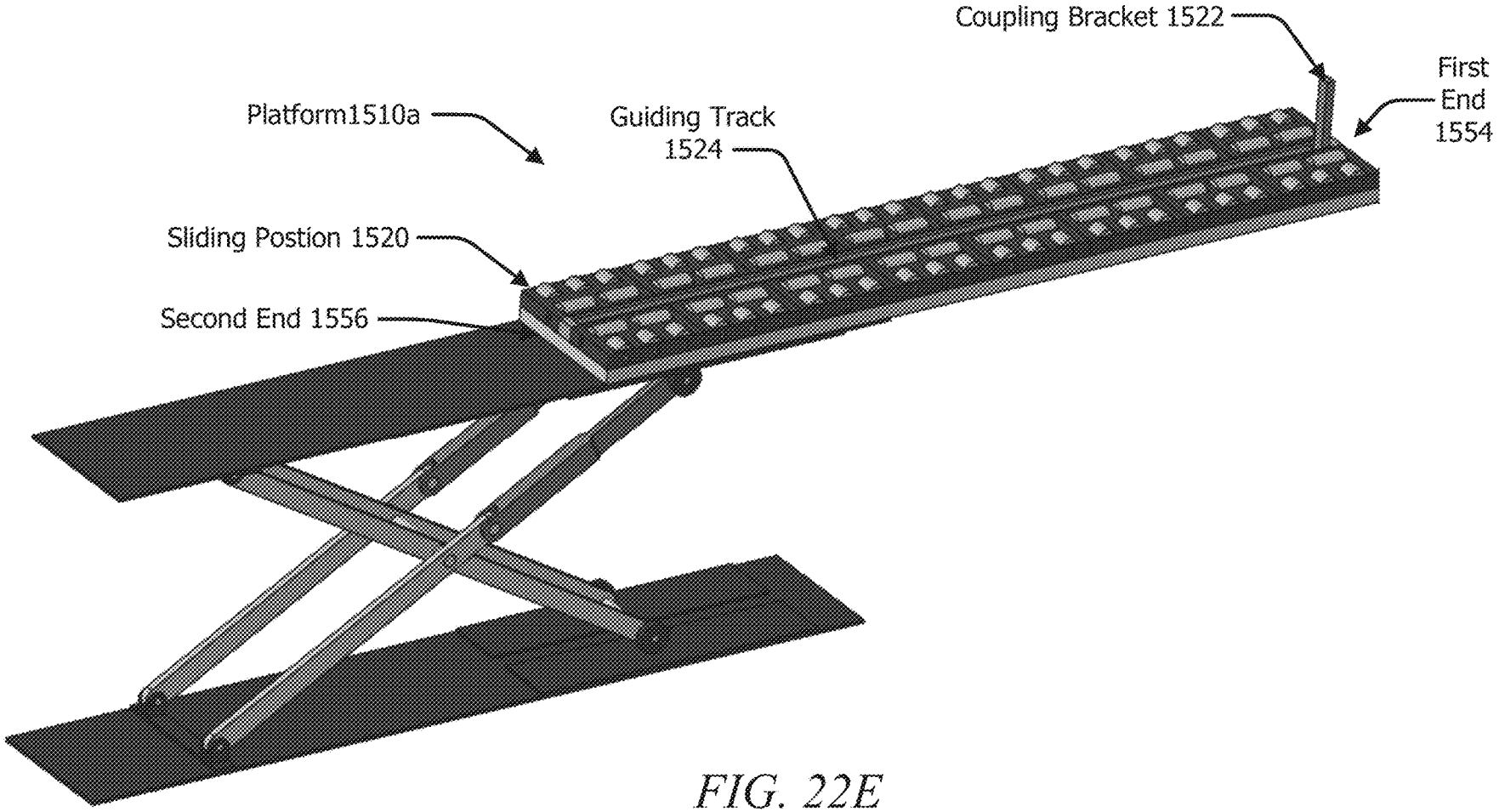
Figure 22F:
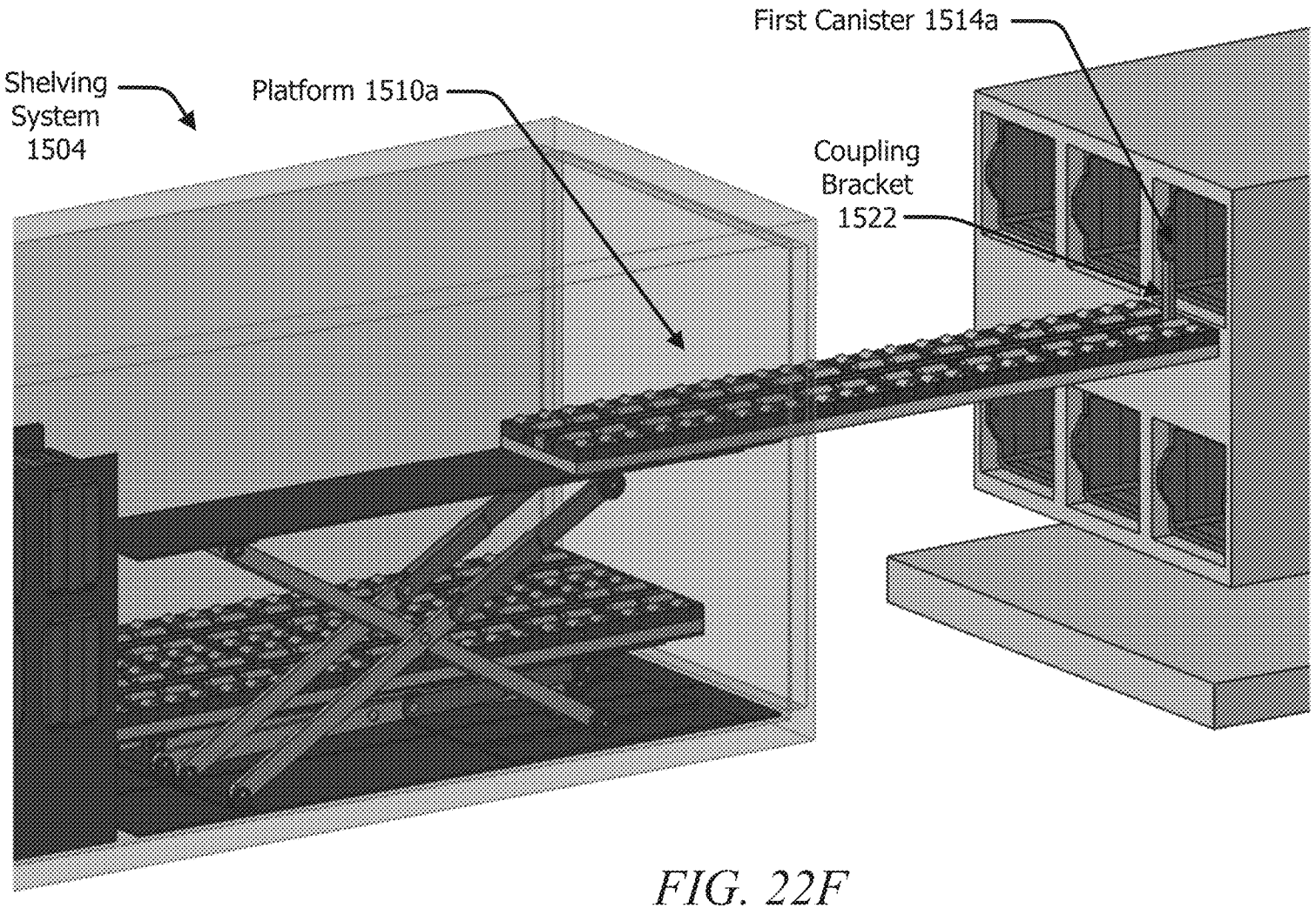

At step 2106 of method 2100, the coupling bracket is extended within the sliding portion. In certain embodiments, the coupling bracket extends toward a first end of the sliding portion of the first platform. For example, referring to FIGS. 15 through 20 and FIG. 22D, control system 1509 may provide a control signal to shelving system 1504 such that coupling bracket 1522 traverses a guiding track 1524 to be positioned proximate to a first end 1554 of sliding portion 1520. FIG. 22D illustrates a coupling bracket at an end of the sliding portion of the platform, in accordance with certain embodiments. For example, as illustrated in FIG. 22D, coupling bracket 1522 is located at second end 1556 of sliding portion 1520, prior to translation to first end 1554. FIG. 22E illustrates a coupling bracket at a first end of the sliding portion of the platform, in accordance with certain embodiments. For example, as illustrated in FIG. 22E, coupling bracket 1522 is located at first end 1554 of sliding portion 1520. FIG. 22F illustrates a coupling bracket proximate to a canister of the platform, in accordance with certain embodiments. For example, as shown in FIG. 22F, coupling bracket 1522 is located proximate to first canister 1514*a*. Method 2100 then moves from step 2106 to step 2108.

Figure 22G:
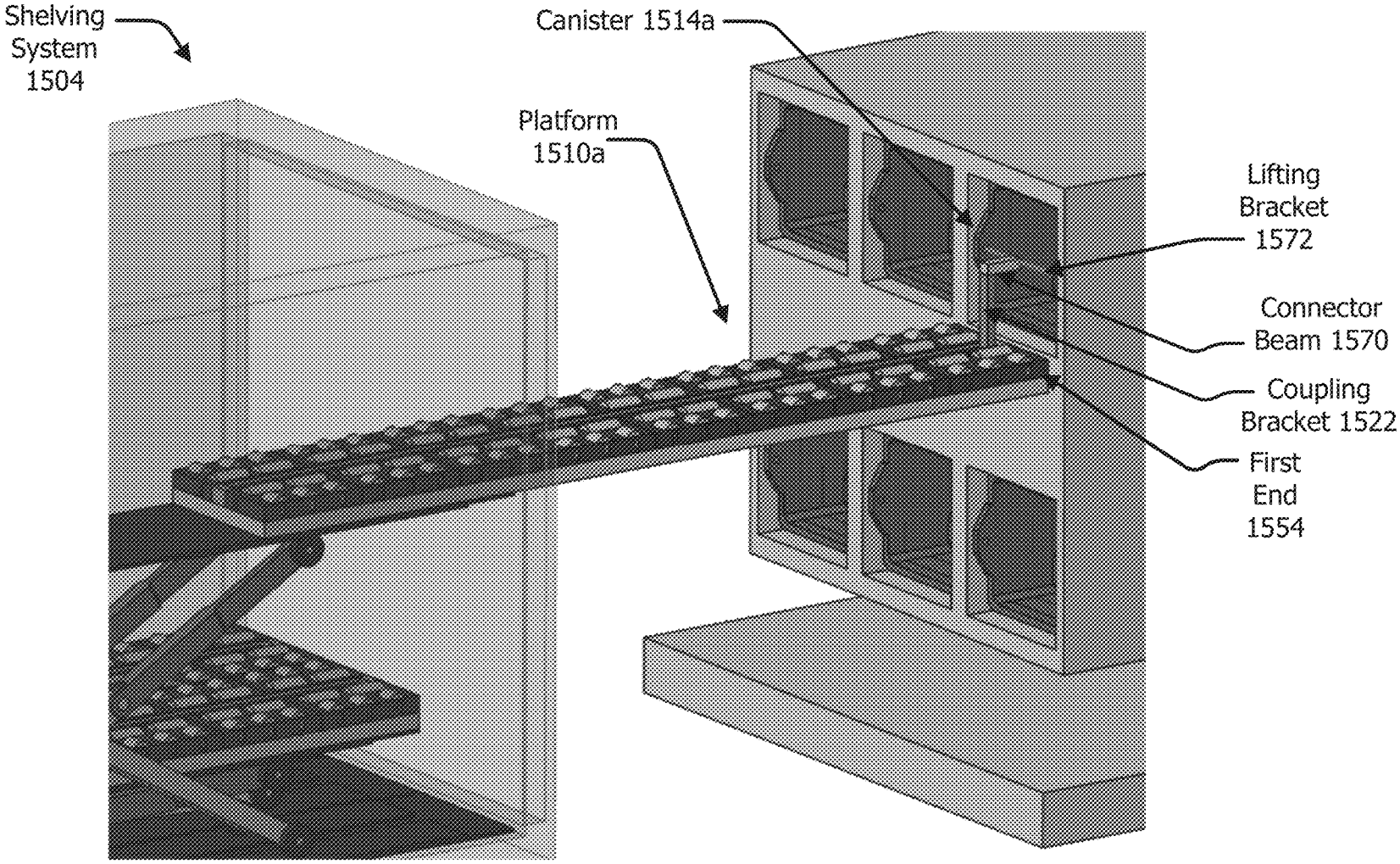

At step 2108 of method 2100, the coupling bracket of the first platform is coupled to the first canister at the first end of the sliding portion. In certain embodiments, a user can attach a connector beam of the coupling bracket to the first canister. FIG. 22G illustrates a connector beam of the coupling bracket attached to first canister, in accordance with certain embodiments. For example, referring to FIG. 22G, a connector beam 1570 of coupling bracket 1522 is attached to first canister 1514*a*, and more specifically, to a lifting bracket 1572 of first canister 1514*a*.

Figure 22H:
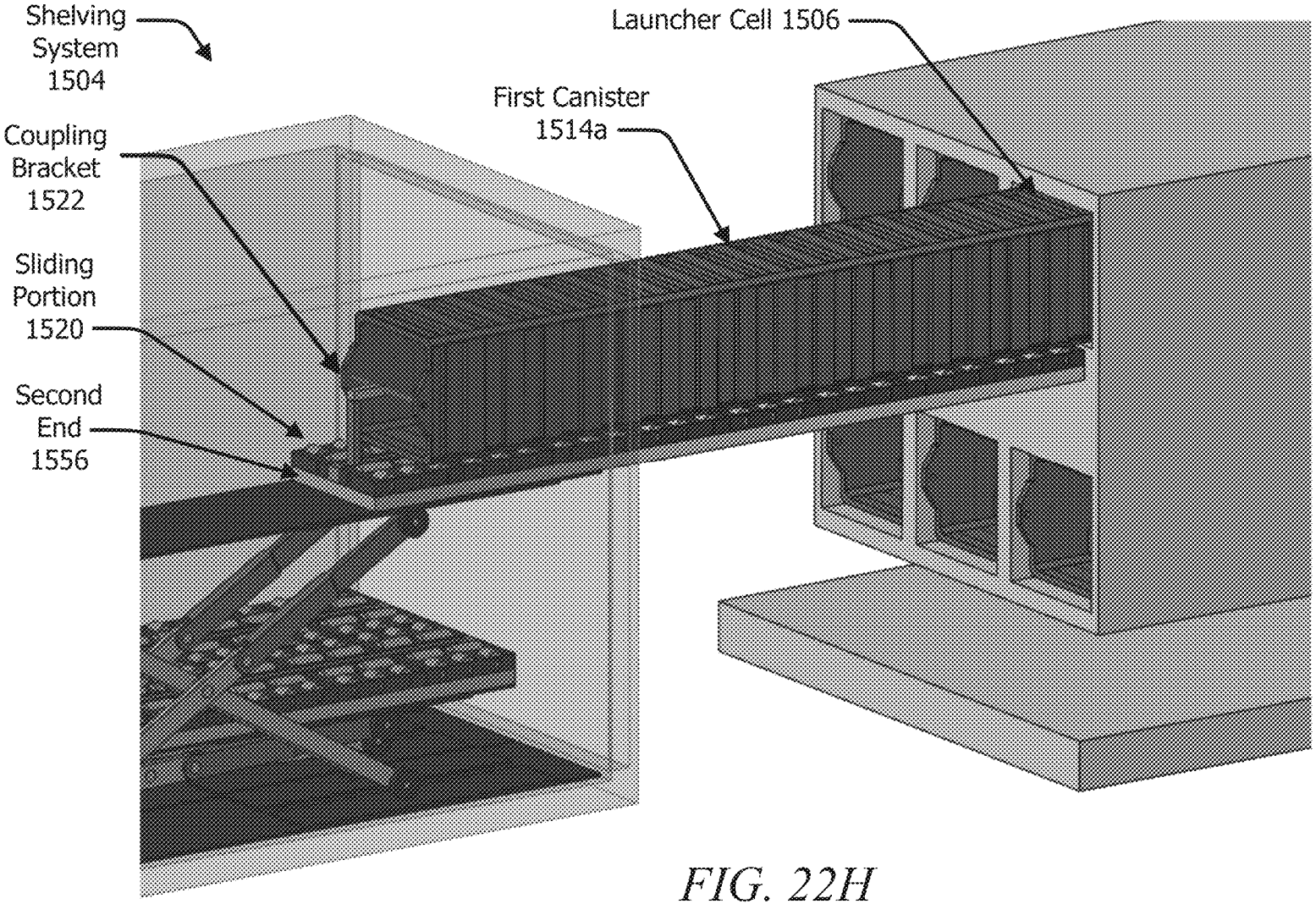

In certain embodiments, the coupling bracket is translated to the second end of the sliding portion to remove the first canister from the launcher cell. For example, referring to FIGS. 15 through 20 and 22H, control system 1509 may provide a control signal to shelving system 1504 to translate coupling bracket 1522 to second end 1556 of the sliding portion 1520. As shown in FIG. 22H, coupling bracket 1522 is positioned at second end 1556 of sliding portion 1520 (after translation of coupling bracket 1522) with first canister 1514*a* removed from launcher cell 1506. In certain embodiments, the control system provides a control signal to the shelving system to activate the rollers to facilitate translating the first canister toward the second end of the sliding portion. Method 2100 then moves from step 2108 to step 2110.

Figure 22I:
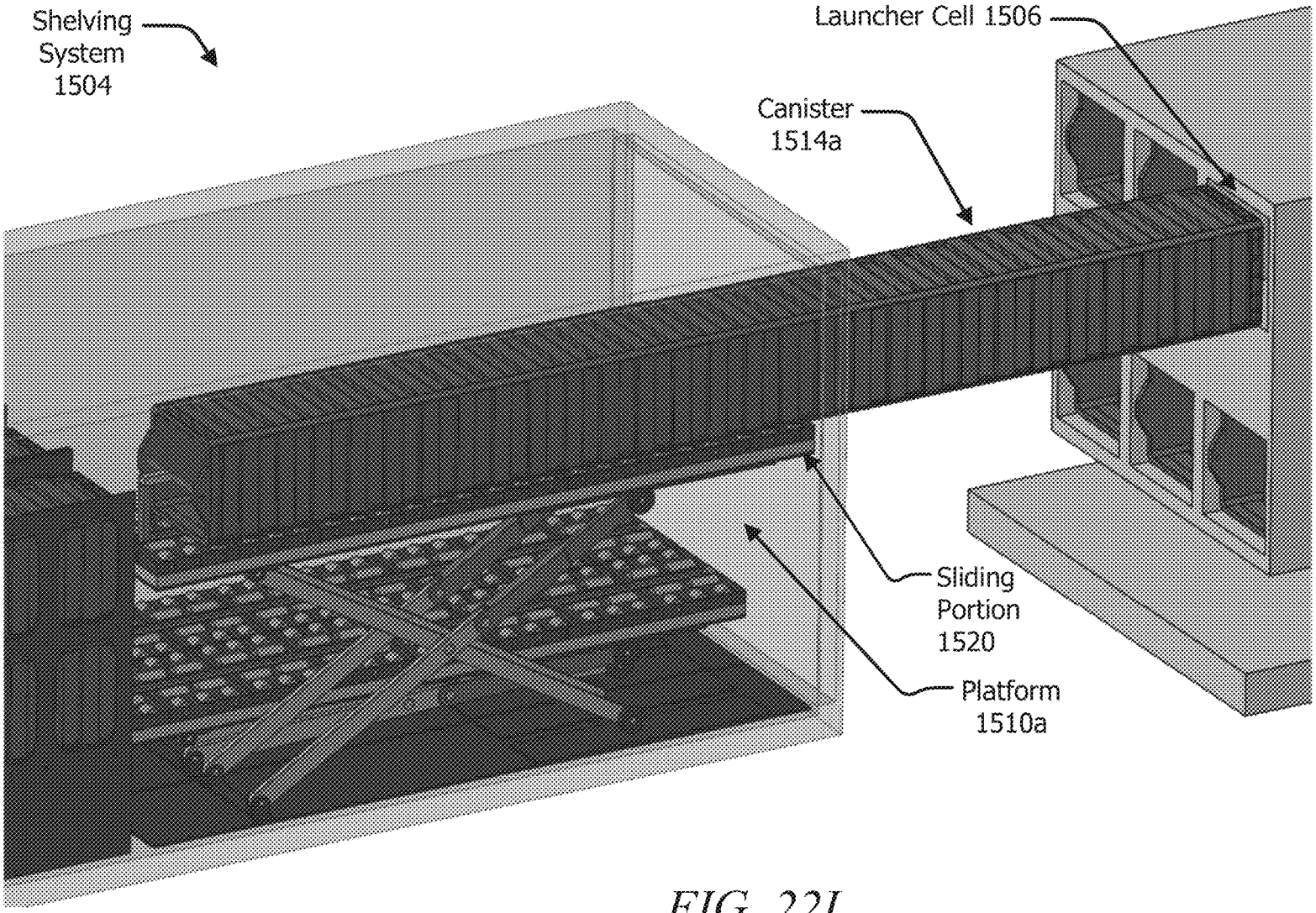

At step 2110 of method 2100, the sliding portion of the first platform is retracted from the launcher cell to further remove the first canister from the launcher cell. For example, referring to FIGS. 15 through 20 and FIG. 22I, control system 1509 may provide a control signal to shelving system 1504 to retract sliding portion 1520 toward shelving system 1504. FIG. 22I illustrates sliding portion 1520 of first platform 1510*a* retracted. Method 2100 then moves from step 2110 to step 2112.

At step 2112 of method 2100, the coupling bracket of the first platform is decoupled from the first canister and retracted within the sliding portion. For example, referring to FIGS. 15 through 20 and FIG. 22J, coupling bracket 1522 of first platform 1510*a* may be decoupled from first canister 1514*a* and retracted within sliding portion 1520. In certain embodiments, a user can detach (or decouple) connector beam 1570 of coupling bracket 1522 from lifting bracket 1572 to decouple coupling bracket 1522 from first canister 1514*a*. In some embodiments, the user can remove connector beam 1570 from being coupled to coupling bracket 1522.

Figure 22J:
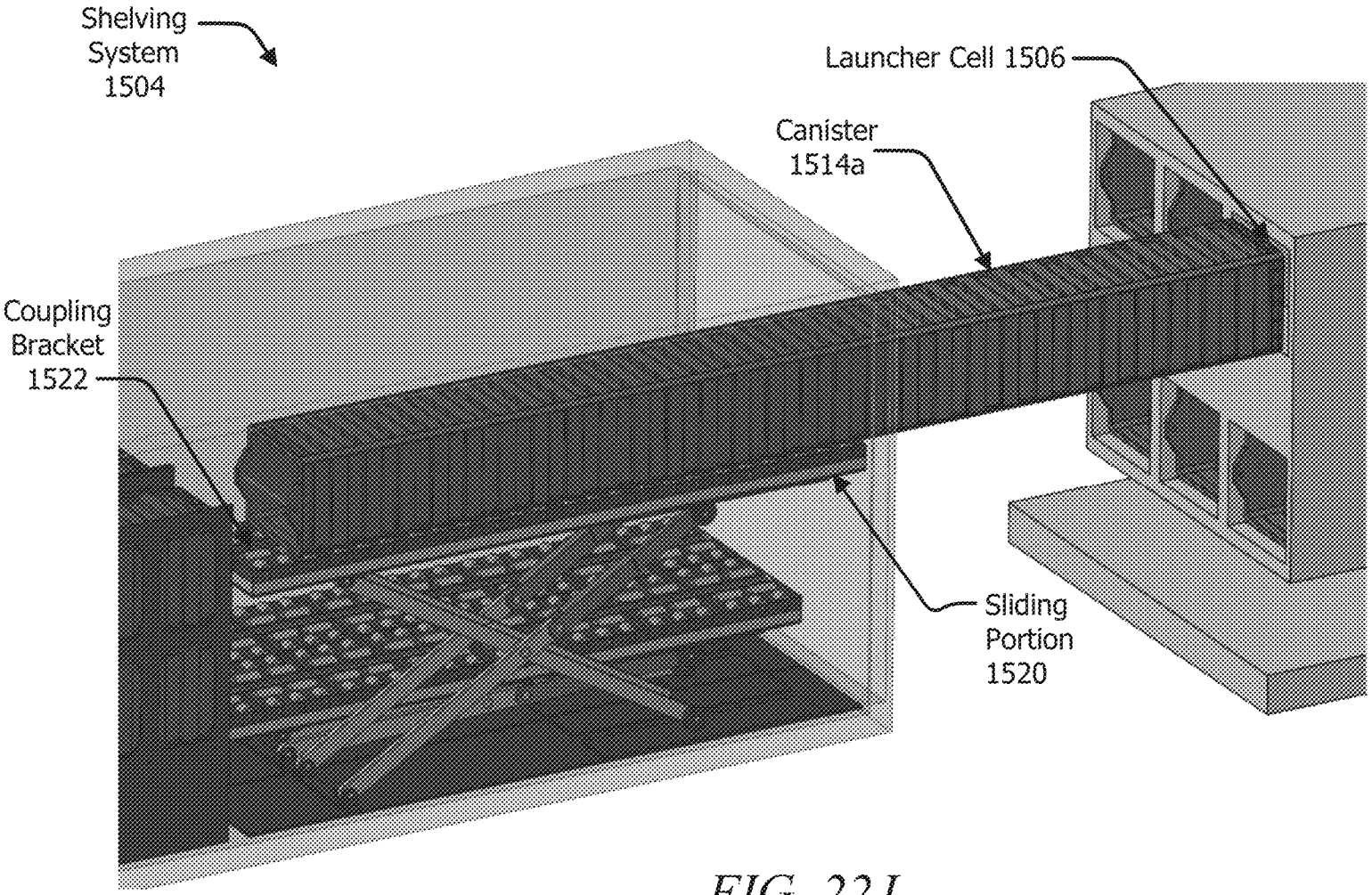
Figure 22K:
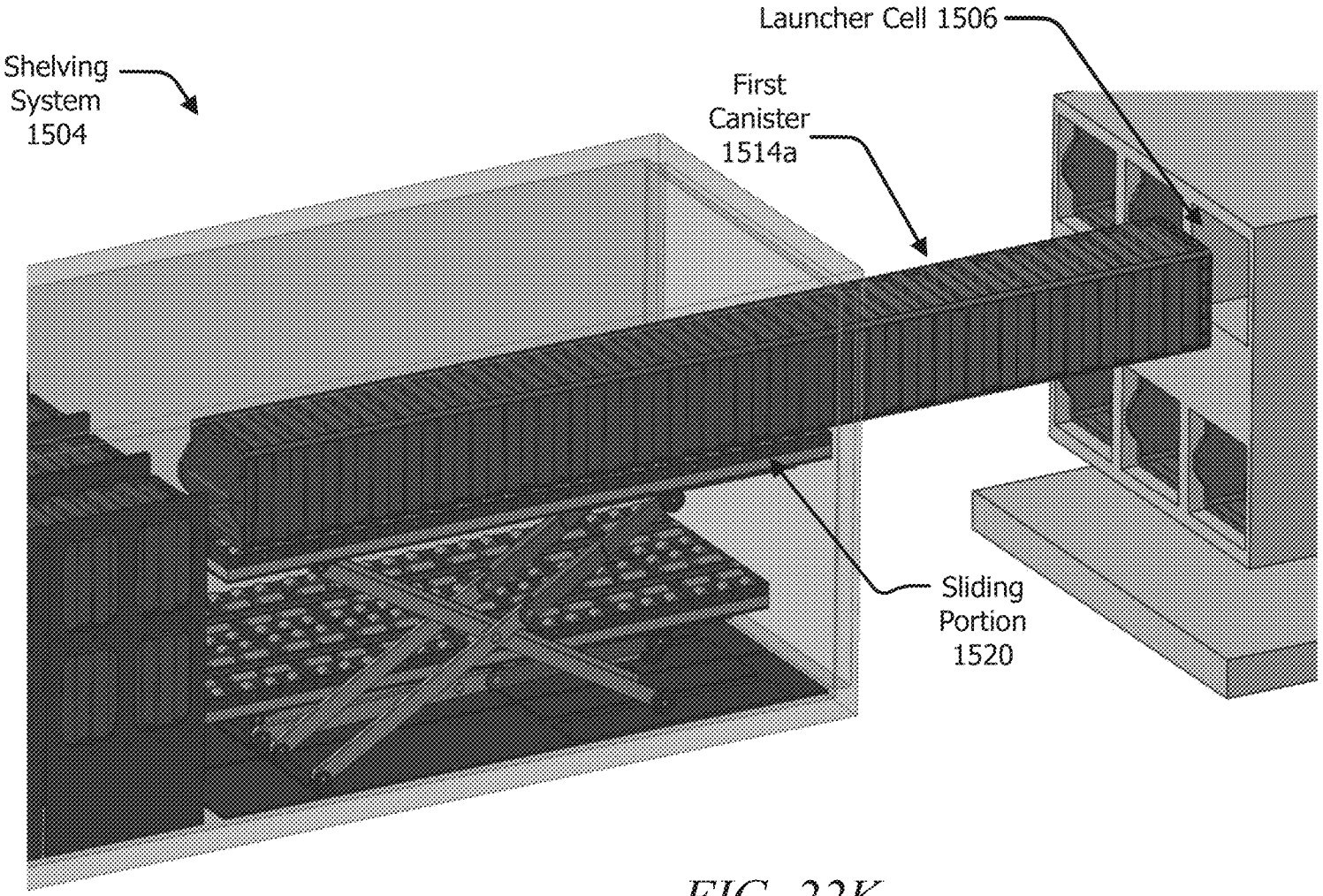

In certain embodiments, the coupling bracket is retracted to a stow position. As illustrated in FIG. 22J, coupling bracket 1522 of first platform 1510*a* is in the stow position. In certain embodiments, the control system provides a control signal to the shelving system to activate the rollers (see FIG. 19) to facilitate translating the first canister toward the second end of the sliding portion. FIG. 22K illustrates first canister 1514*a* translated toward the second end of sliding portion 1520. Method 2100 then moves from step 2112 to step 2114.

Figure 22L:
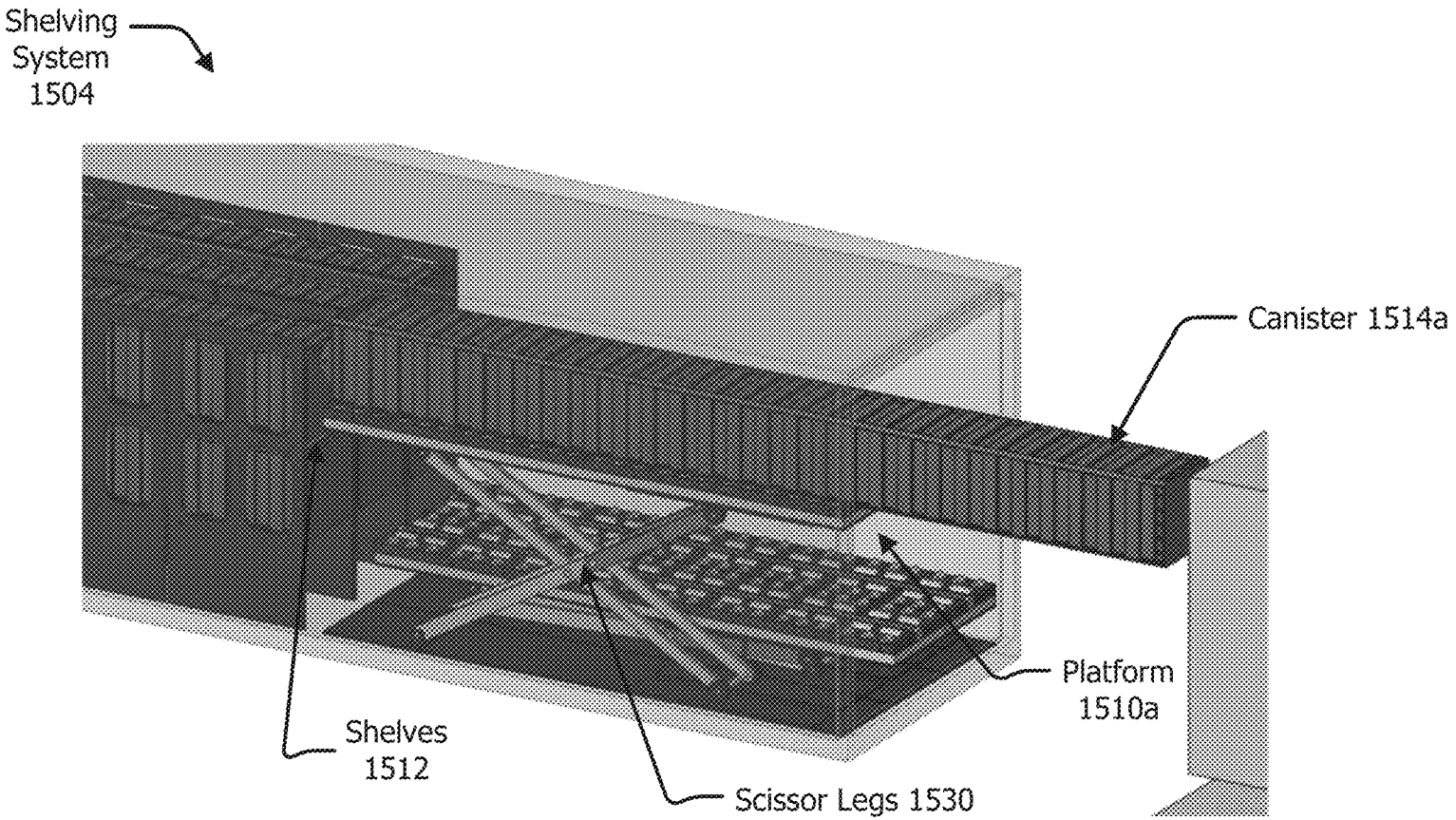
Figure 22M:
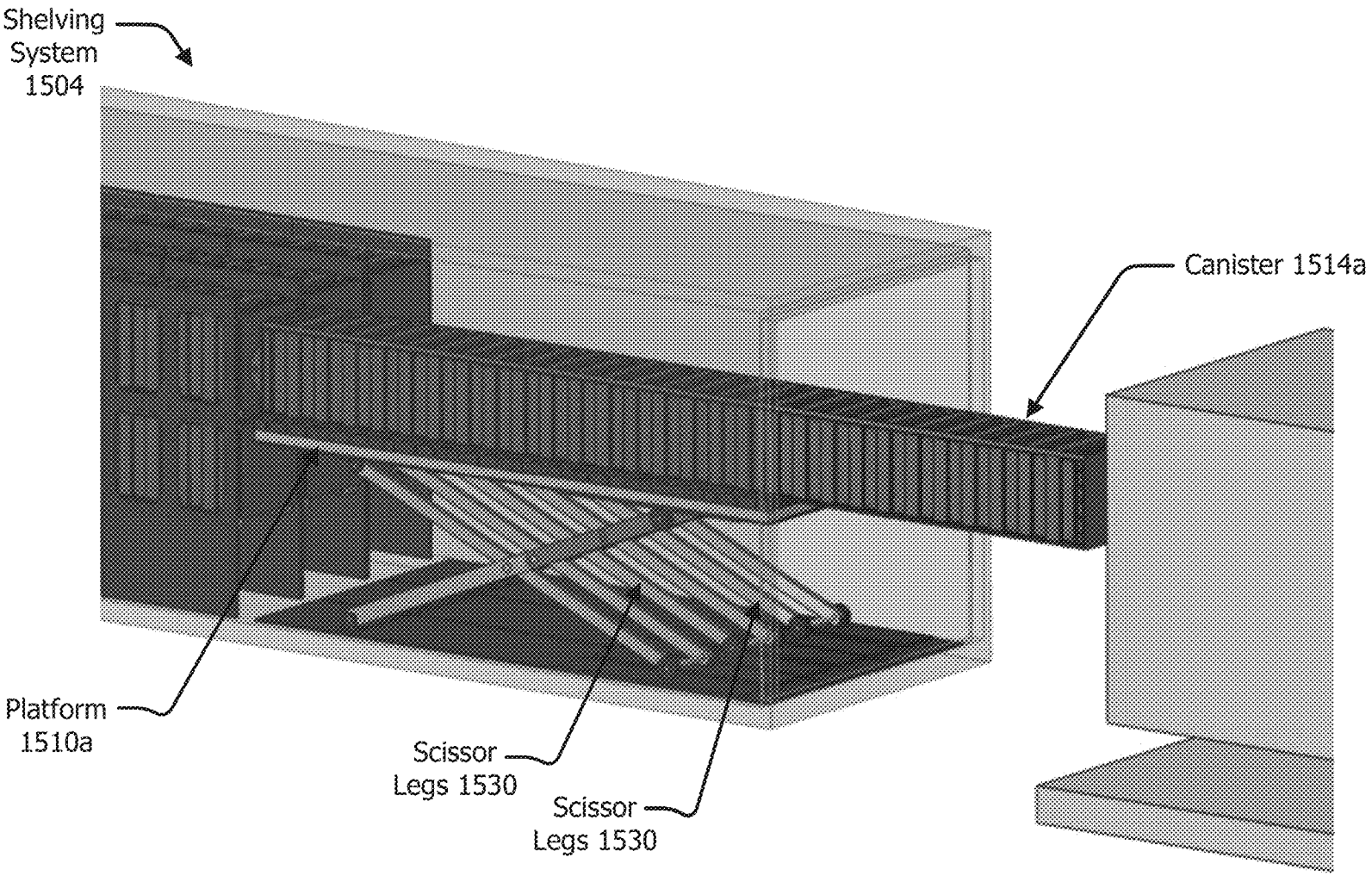
Figure 22N:
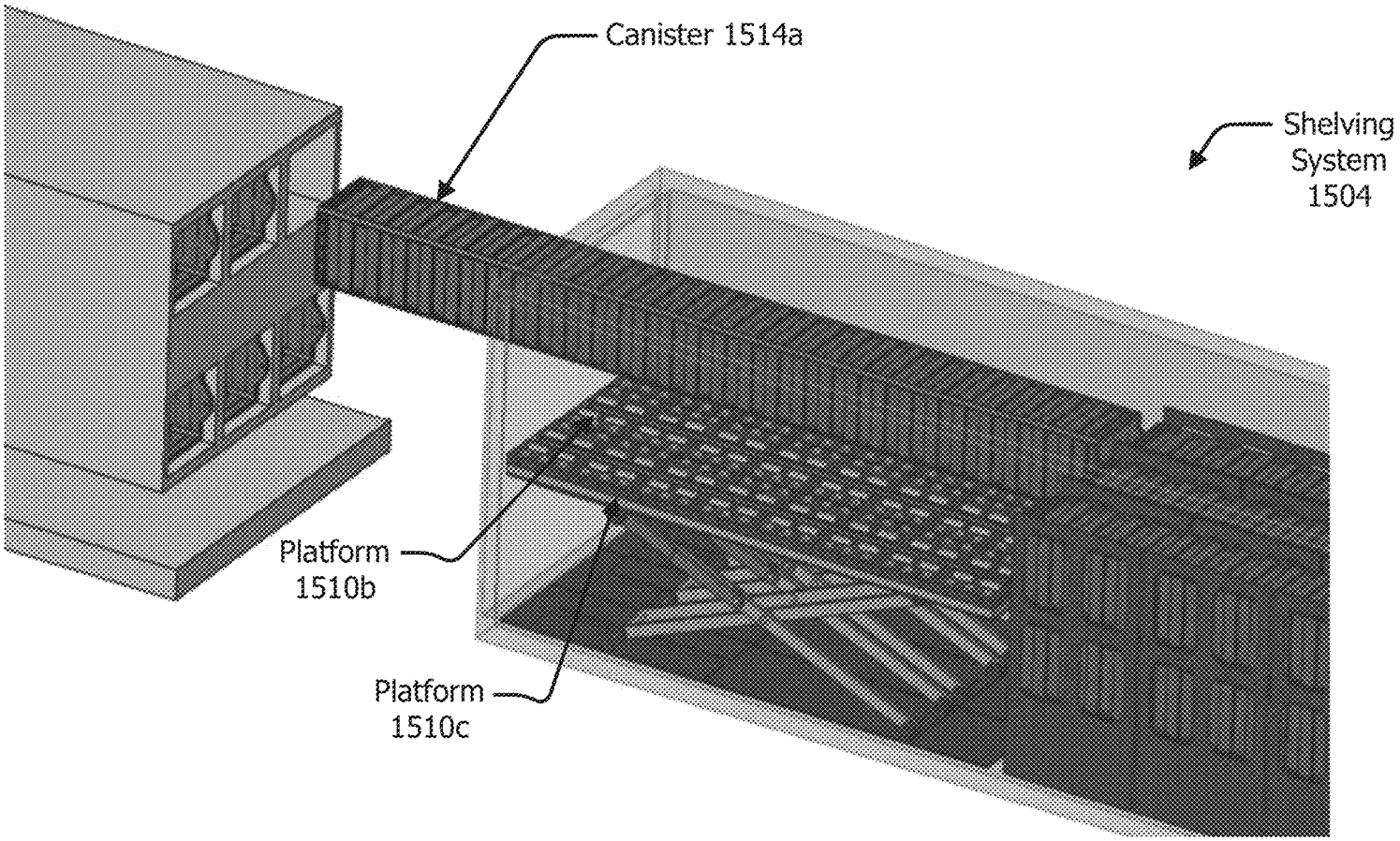

At step 2114 of method 2100, the vertical positionings of the first platform, the second platform, and the third platform are adjusted to align with a shelf height of a shelf of the shelving system. For example, referring to FIGS. 15 through 20 and FIG. 22L, control system 1509 may provide a control signal to shelving system 1504 to adjust scissor legs 1530 of first platform 1510*a* to align first platform 1510*a* with shelf 1512. FIG. 22L illustrates the first platform after scissor legs adjust the vertical positioning of the first platform, in accordance with certain embodiments. For example, as illustrated in FIG. 22L, scissor legs 1530 are used to adjust the vertical positioning of first platform 1510*a*. As another example, referring to FIGS. 15 through 20 and FIG. 22M, control system 1509 may provide a control signal to shelving system 1504 to extend scissor legs 1530 of second platform 1510*b* and third platform 1510*c* to raise second platform 1510*b* and third platform 1510*c* from the first position to the second position. FIG. 22M illustrates first platform 1510*a* of shelving system 1504, in accordance with certain embodiments. FIG. 22N illustrates second platform 1510*b* and third platform 1510*c* in the second position, in accordance with certain embodiments. As illustrated in FIGS. 22M and 22N, respective scissor legs 1530 have raised second platform 1510*b* and third platform 1510*c* to match the vertical positioning of first platform 1510*a*. Method 2100 then moves from step 2114 to step 2116.

Figure 22O:
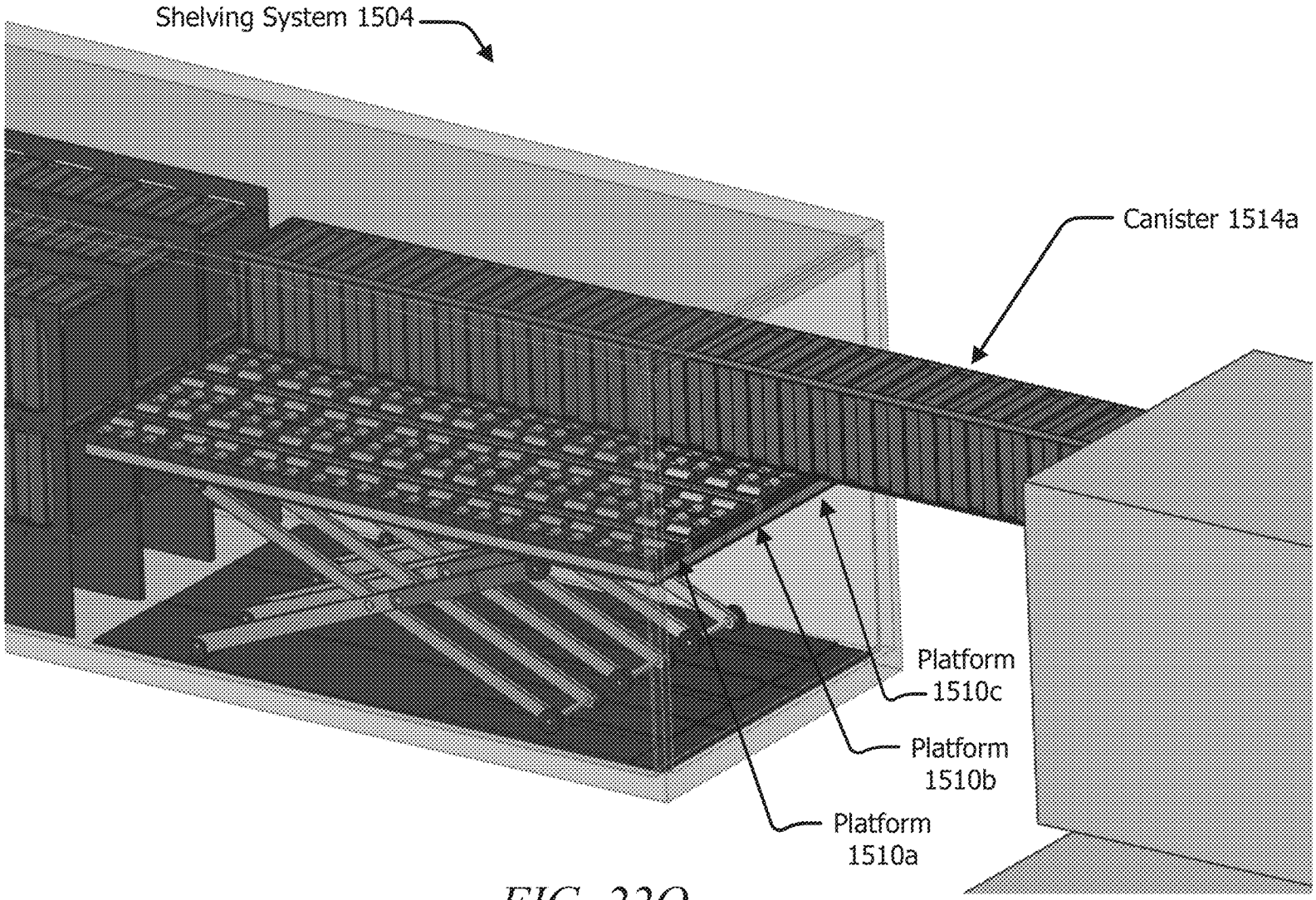

At step 2116 of method 2100, the first canister is translated from the first platform to the third platform. For example, referring to FIGS. 15 through 20 and FIG. 22O, control system 1509 may provide a control signal to shelving system 1504 to activate rollers 1528 (shown in FIG. 19) of platforms 1510 to transfer first canister 1514*a* from first platform 1510*a* to second platform 1510*b* and ultimately to third platform 1510*c*. FIG. 22O illustrates the first canister positioned on the third platform, in accordance with certain embodiments. For example, as illustrated in FIG. 22O, first canister 1514*a* is positioned on third platform 1510*c*. Method 2100 then moves from step 2116 to step 2118.

Figure 22P:
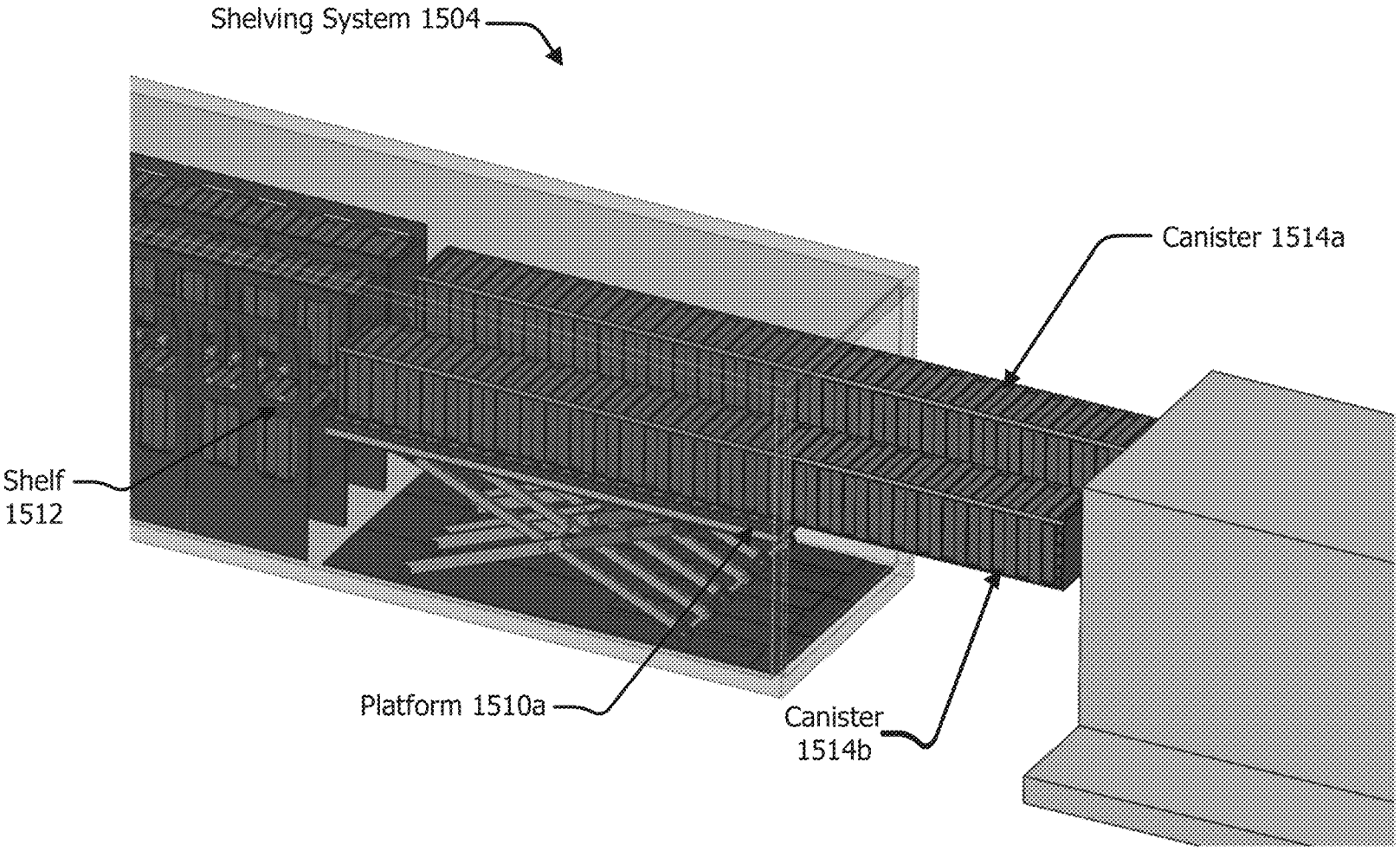

At step 2118 of method 2100, a second canister is extracted from a shelf of the shelving system by positioning the second canister on the first platform. For example, referring to FIGS. 15 through 20 and FIG. 22P, control system 1509 may provide a control signal to shelving system 1504 to activate rollers 1516 (shown in FIG. 17) of shelf 1512 to translate second canister 1514*b* on first platform 1510*a*. In certain embodiments, when second canister 1514*b* makes contact with first platform 1510*a*, control system 1509 provides a control signal to shelving system 1504 to activate rollers 1526 (shown in FIG. 19) of first platform 1510*a* to translate second canister 1514*b* on first platform 110*a*. FIG. 22P illustrates the second canister positioned on the first platform, in accordance with certain embodiments. For example, as illustrated in FIG. 22P, second canister 1514*b* is positioned on first platform 1510*a*. Method 2100 then moves from step 2118 to step 2120.

Figure 22Q:
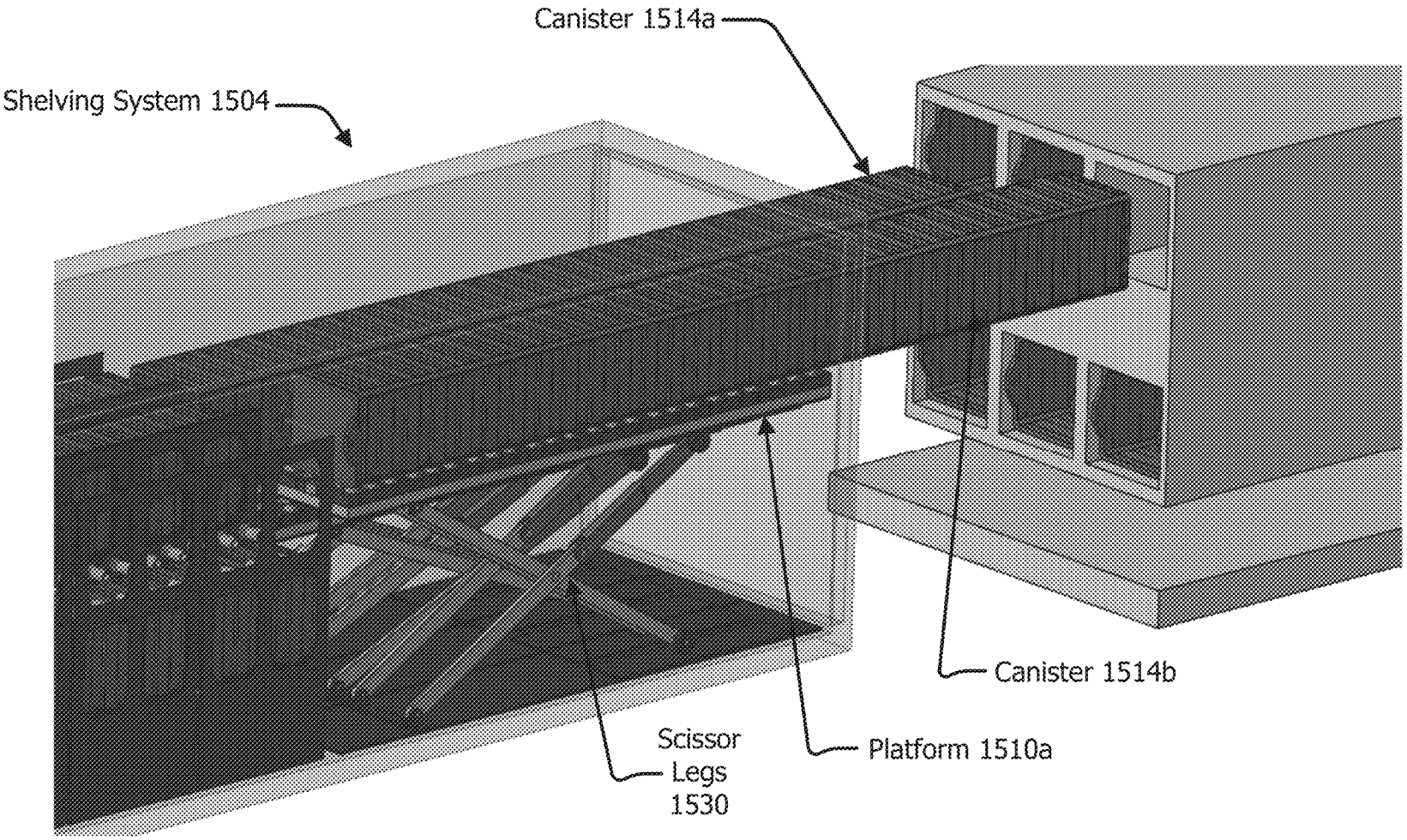

At step 2120 of method 2100, a vertical positioning of the first platform is adjusted to align with the launcher cell. For example, referring to FIGS. 15 through 20 and FIG. 22Q, control system 1509 may provide a control signal to shelving system 1504 to adjust scissor legs 1530 of first platform 1510*a* to align first platform 1510*a* with launcher cell 1506. FIG. 22Q illustrates the first platform after the scissor legs adjust the vertical positioning of the first platform, in accordance with certain embodiments. For example, referring to FIG. 22Q, scissor legs 1530 adjust the vertical positioning of first platform 1510*a*. Method 2100 then moves from step 2120 to step 2122.

Figure 22R:
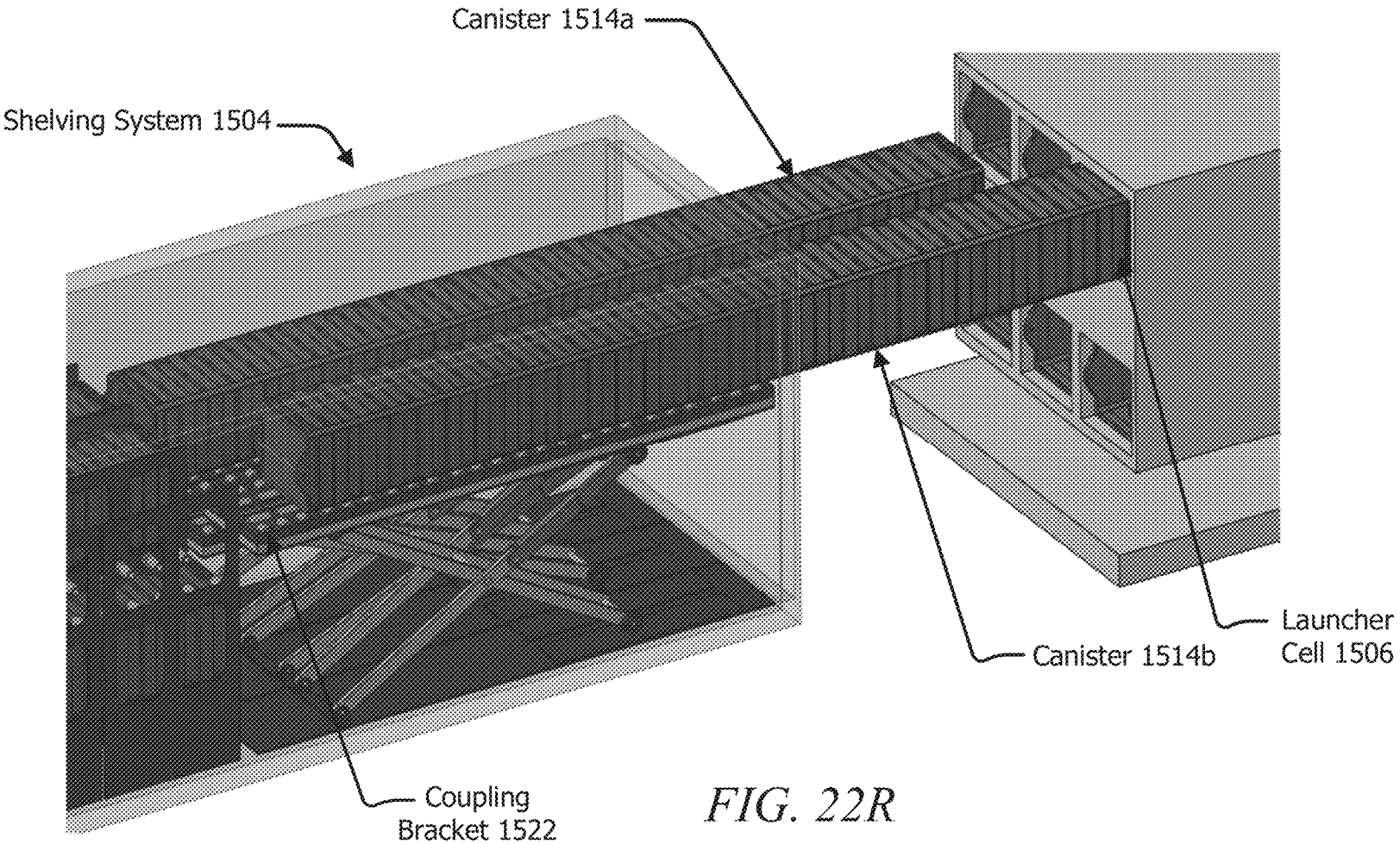

At step 2122 of method 2100, the second canister is translated toward to the launcher cell. For example, referring to FIGS. 15 through 20 and FIG. 22R, control system 1509 may provide a control signal to shelving system 1504 to activate rollers 1526 (shown in FIG. 19) to facilitate translating second canister 1514*b* toward launcher cell 1506. FIG. 22R illustrates the second canister translated toward the launcher cell, in accordance with certain embodiments. For example, as illustrated in FIG. 22R, second canister 1514*b* is translated toward launcher cell 1506 a distance to provide clearance for coupling bracket 1522 of first platform 1510*a*. Method 2100 then moves from step 2122 to step 2124.

Figure 22S:
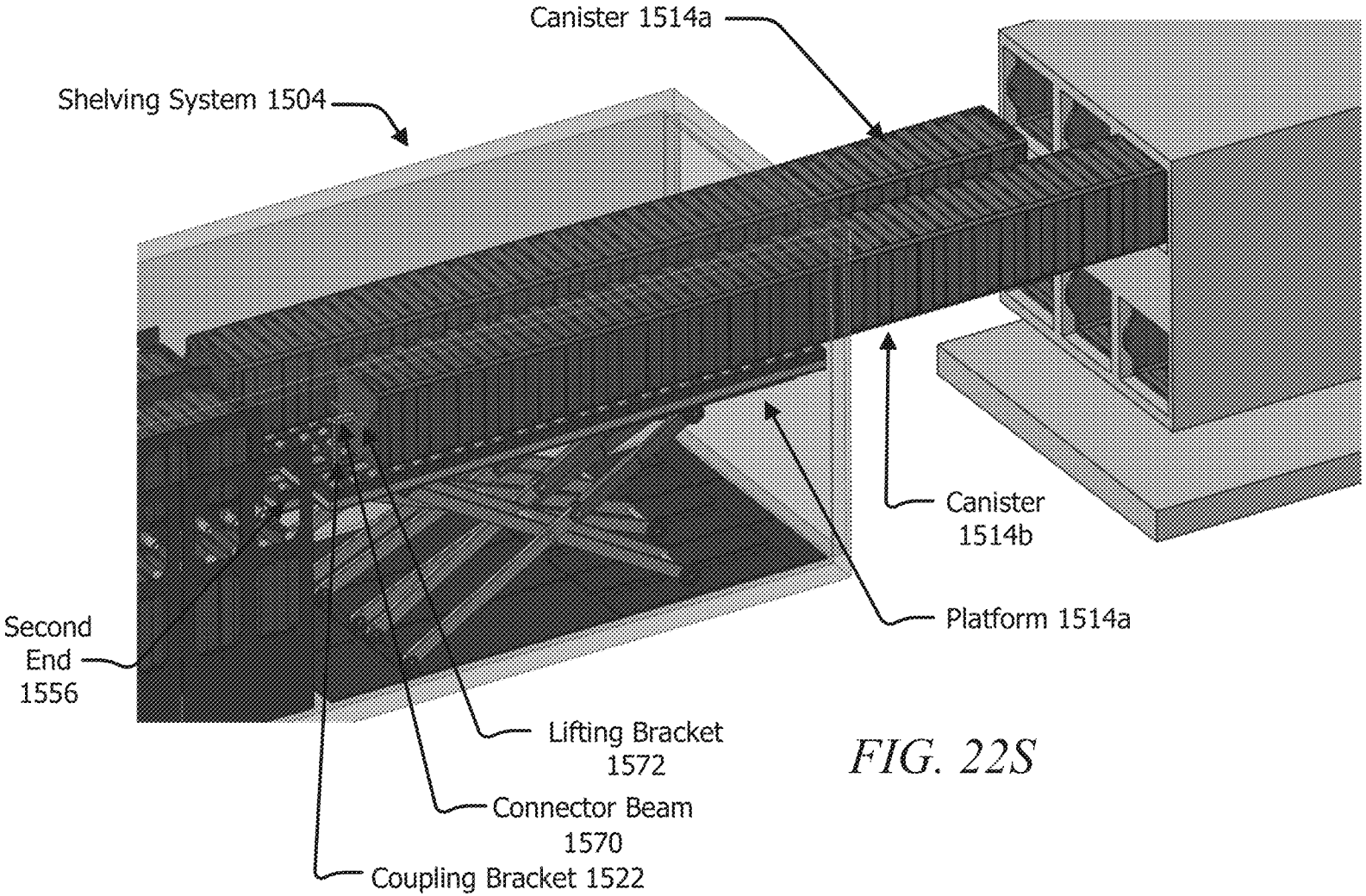

At step 2124 of method 2100, the coupling bracket of the first platform is coupled to the second canister at the second end of the sliding portion. For example, referring to FIGS. 15 through 20 and FIG. 22S, coupling bracket 1522 of first platform 1510*a* is coupled to second canister 1514*b* at second end 1556 of the sliding portion 1520. In certain embodiments, a user attaches the connector beam of the coupling bracket to the second canister and specifically to the lifting bracket of the second canister. FIG. 22S illustrates the connector beam of the coupling bracket attached to the second canister, in accordance with certain embodiments. For example, as illustrated in FIG. 22S, connector beam 1570 of coupling bracket 1522 is attached to second canister 1514*b*, and specifically to lifting bracket 1572 of second canister 1514*b*. Method 2100 then moves from step 2124 to step 2126.

Figure 22T:
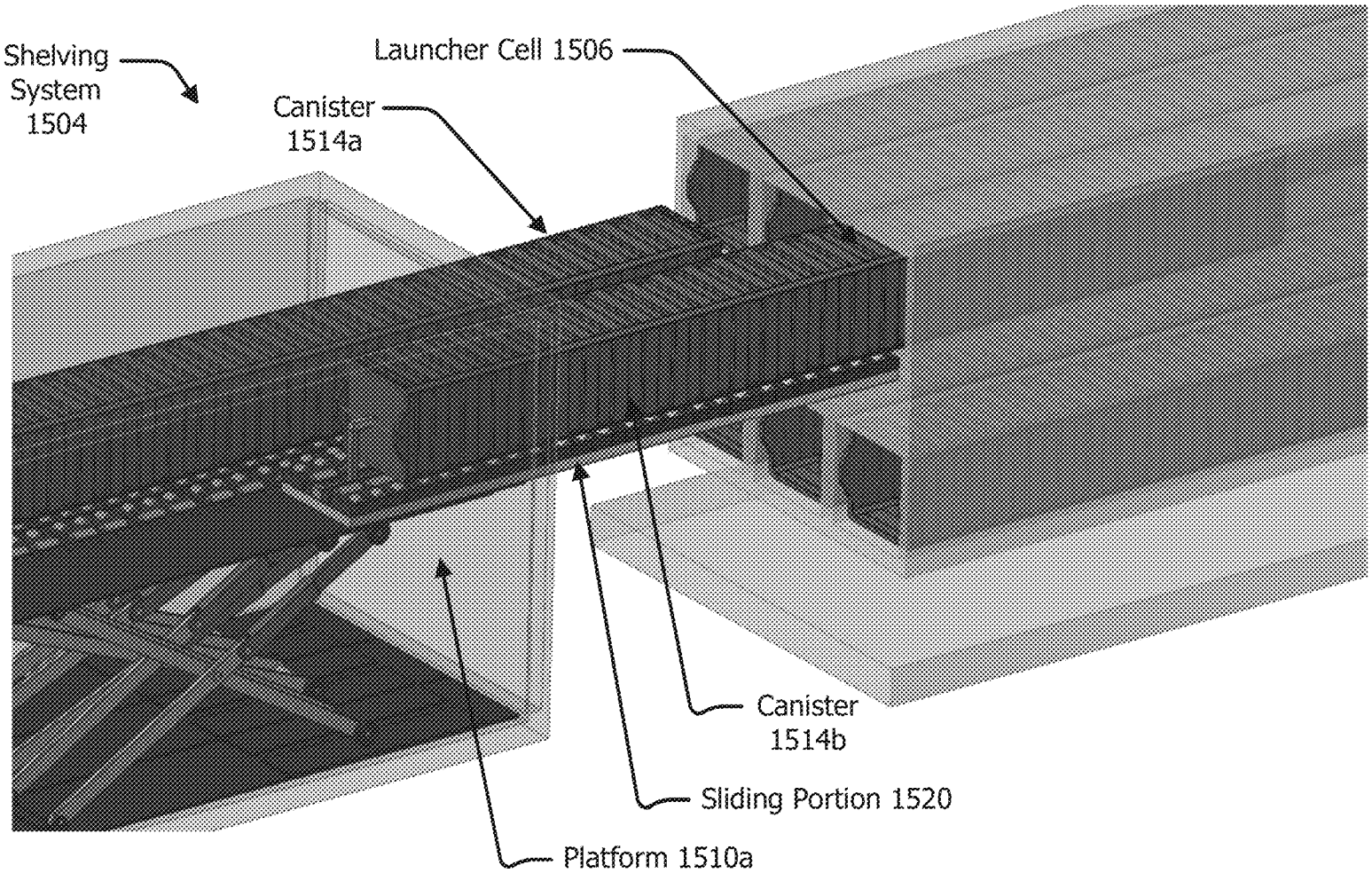

At step 2126 of method 2100, the sliding portion of the first platform is extended toward the launcher cell to position the second canister within the launcher cell. For example, referring to FIGS. 15 through 20 and 22T, control system 1509 may provide a control signal to shelving system 1504 to extend sliding portion 1520 of first platform 1510*a*. FIG. 22T illustrates the sliding portion of the first platform extended towards the launcher cell, in accordance with certain embodiments. For example, referring to FIG. 22T, sliding portion 1520 of first platform 1510*a* is extended toward launcher cell 1506. In certain embodiments, the tilting arms (e.g., tilting arms 1532 of FIG. 20) adjust a pitch or angle of the sliding portion to facilitate alignment between the first platform and the launcher cell. Method 2100 then moves from step 2126 to step 2128.

Figure 22U:
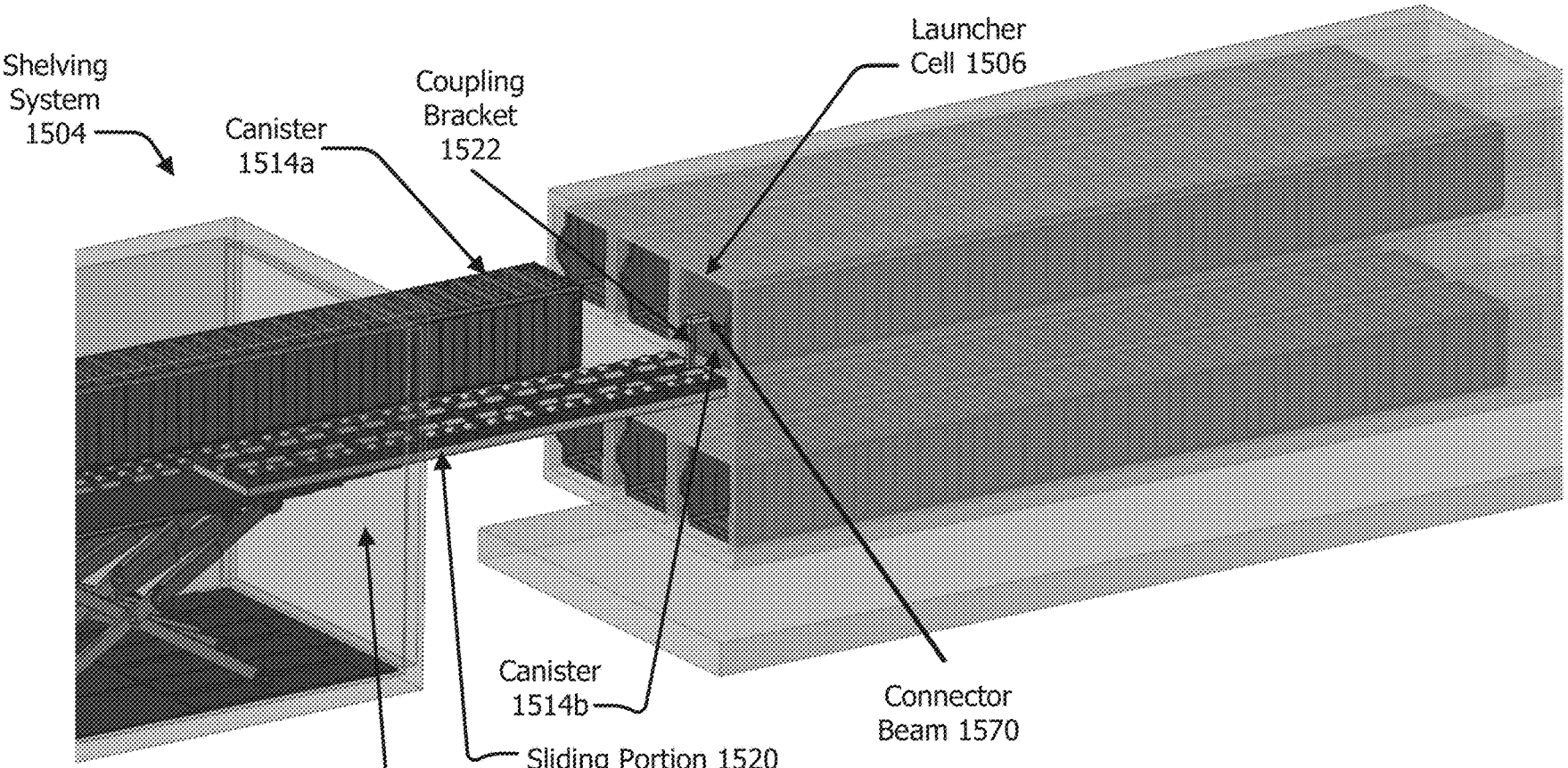

At step 2128 of method 2100, the coupling bracket extends toward the first end of the sliding portion of the first platform. For example, referring to FIGS. 15 through 20 and FIG. 22U, control system 1509 may provide a control signal to shelving system 1504 such that coupling bracket 1522 traverses guiding track 1524 to be positioned proximate to first end 1554 of sliding portion 1520 to fully position second canister 1514*b* within launcher cell 1506. FIG. 22U illustrates coupling bracket 1622 at the first end 1654 of sliding portion 1620 and second canister 1514*b* positioned within launcher cell 1606. Method 2100 then moves from step 2128 to step 2130.

Figure 22V:
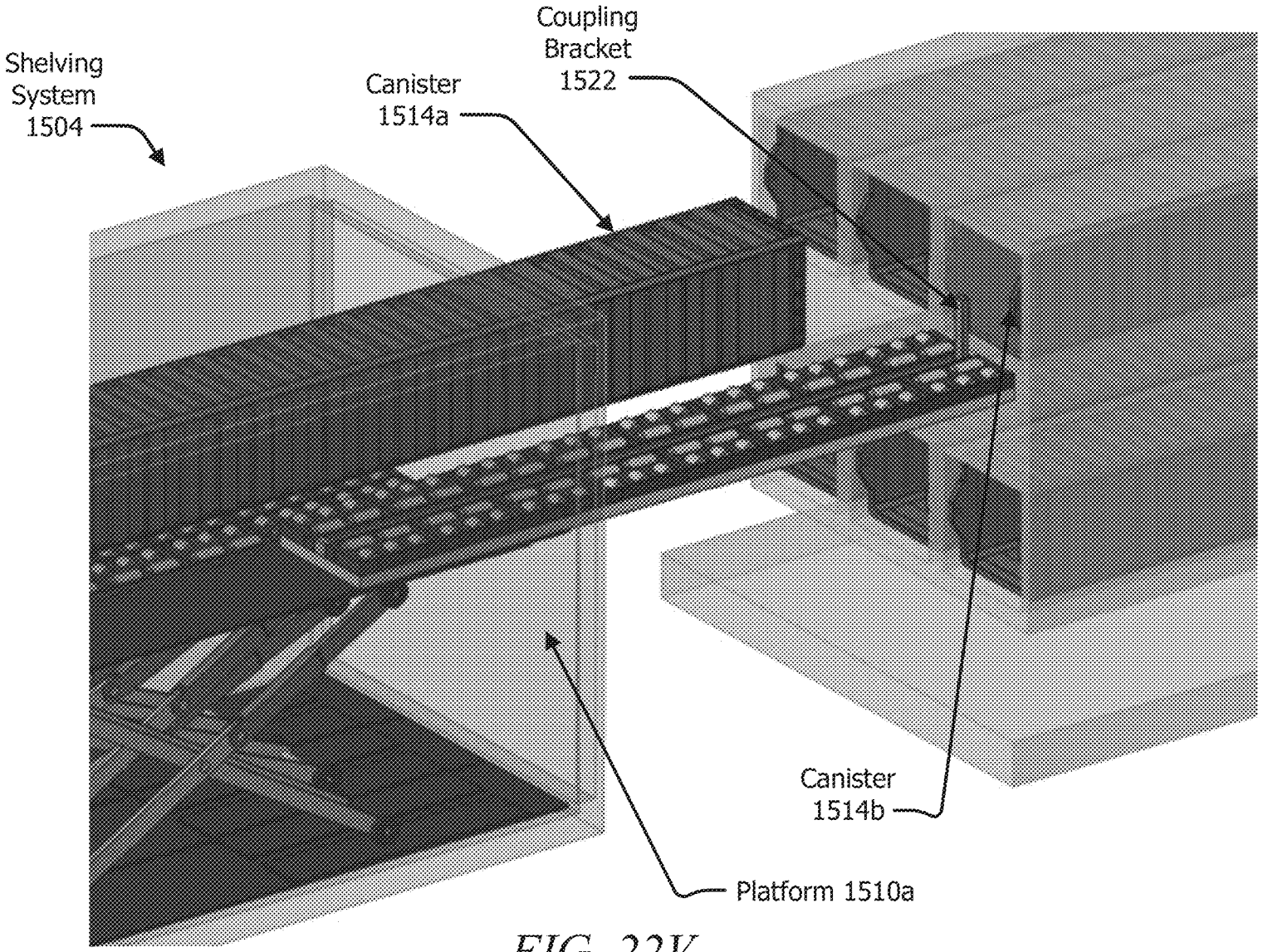

At step 2130 of method 2100, the coupling bracket at the first end of the sliding portion and the second canister is positioned within the launcher cell. FIG. 22U illustrates the coupling bracket at the first end of the sliding portion and the second canister positioned within the launcher cell, in accordance with certain embodiments. For example, as illustrated in FIG. 22U, coupling bracket 1522 of first platform 1510*a* is decoupled from second canister 1514*b*. In certain embodiments, a user detaches (or decouples) connector beam 1570 of coupling bracket 1522 from lifting bracket 1572 to decouple coupling bracket 1522 from second canister 1514*b*. In some embodiments, the user removes connector beam 1570 from being coupled to coupling bracket 1522. FIG. 22V illustrates the coupling bracket decoupled from the second canister, in accordance with certain embodiments. For example, as illustrated in FIG. 22V, coupling bracket 1522 is decoupled from second canister 1514*b*. Method 2100 then moves from step 2130 to step 2132.

Figure 22W:
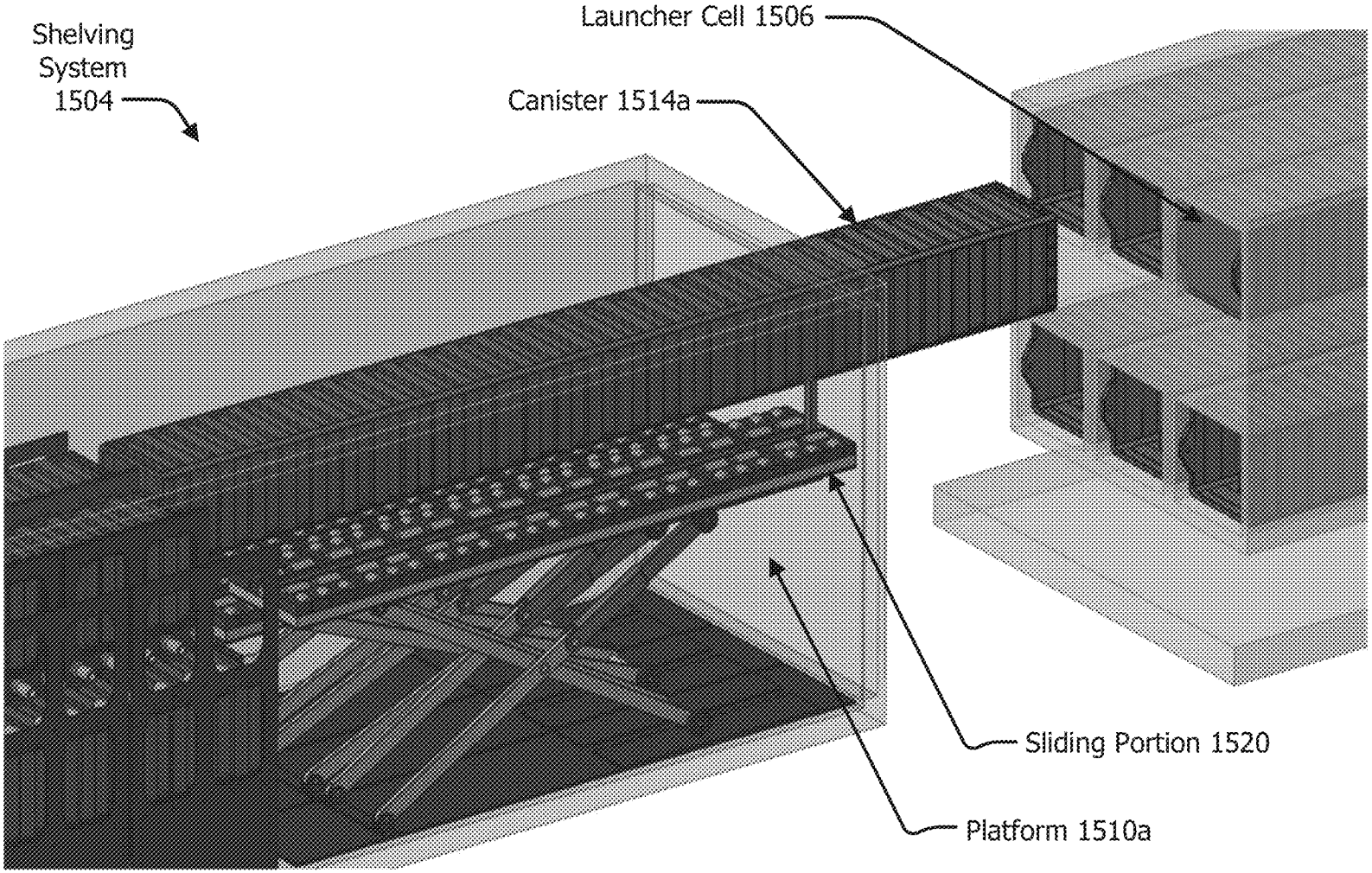
Figure 22X:
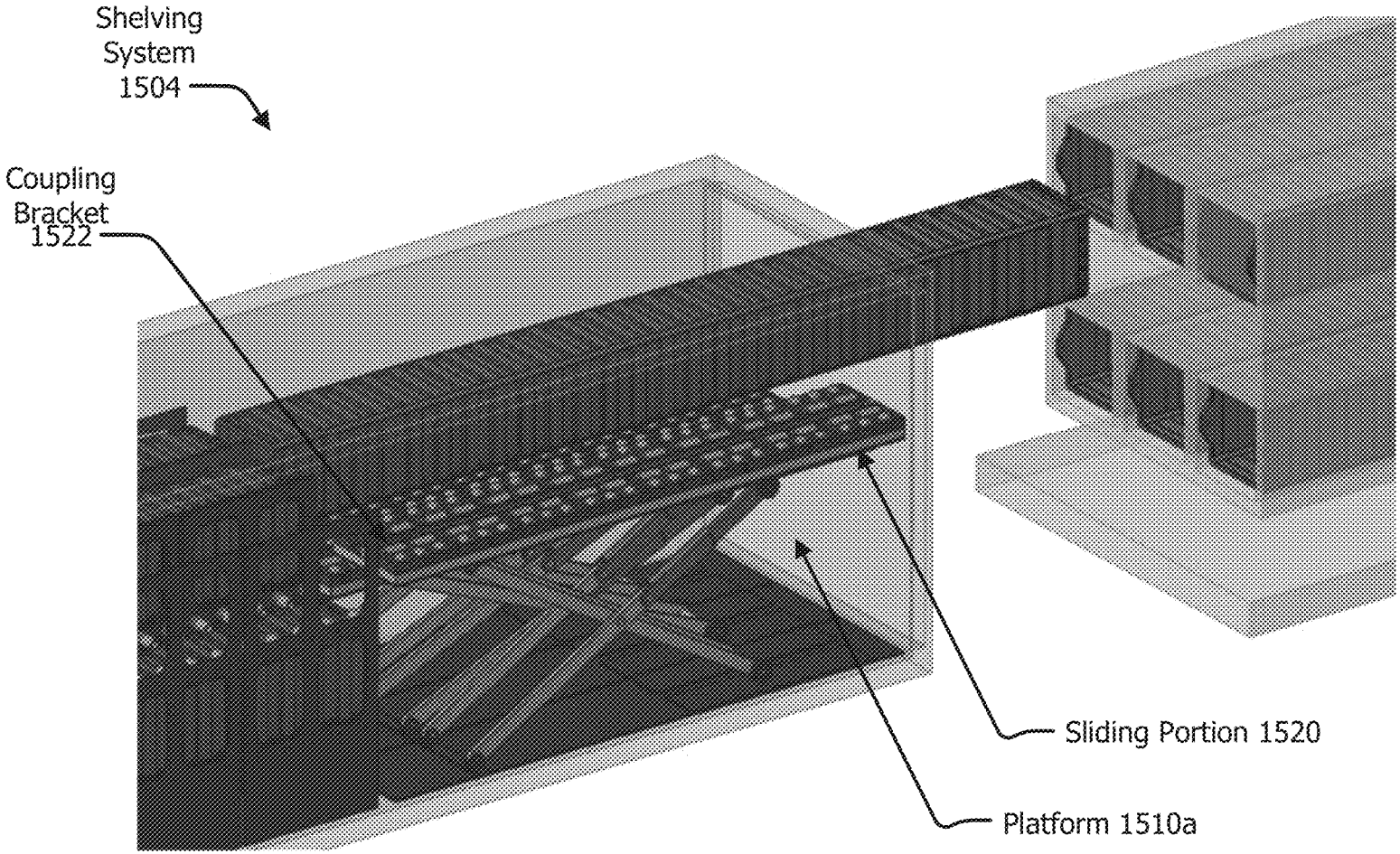

At step 2132 of method 2100, the sliding portion of the first platform is retracted from the launcher cell. For example, referring to FIGS. 15 through 20 and FIG. 22W, control system 1509 may provide a control signal to shelving system 1504 to retract sliding portion 1520 of first platform 1510*a* away from launcher cell 1506. FIG. 22W illustrates the sliding portion of the first platform retracted, in accordance with certain embodiments. For example, as illustrated in FIG. 22W, sliding portion 1520 of first platform 1510*a* is retracted to a stow position. FIG. 22X illustrates the coupling bracket of the first platform in the stow position, in accordance with certain embodiments. For example, referring to FIG. 22X, coupling bracket 1522 of first platform 1510*a* is in the stow position. Method 2100 then moves from step 2132 to step 2134.

Figure 22Y:
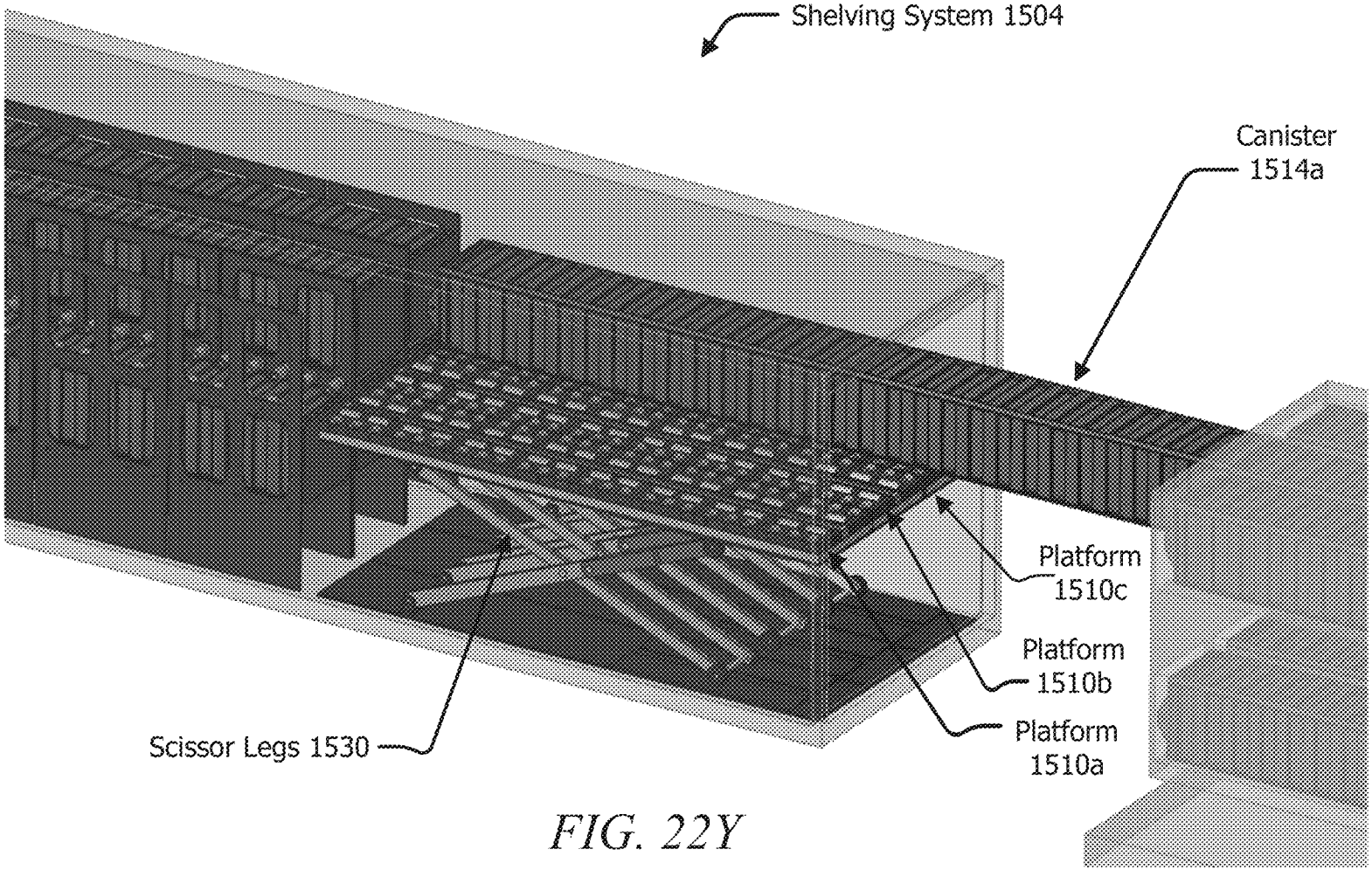

At step 2134 of method 2100, the vertical positioning of the first platform is adjusted to match the vertical positioning of the second platform and the third platform. For example, referring to FIGS. 15 through 20 and FIG. 22Y, control system 1509 may provide a control signal to shelving system 1504 to adjust scissor legs 1530 of first platform 1510*a* to be aligned with the vertical positioning of second platform 1510*b* and third platform 1510*c*. FIG. 22Y illustrates the vertical positioning of the first platform matching the vertical positioning of the second platform and the third platform, in accordance with certain embodiments. For example, as shown in FIG. 22Y, the vertical positioning of first platform 1510*a* matches the vertical positioning of second platform 1510*b* and the third platform 1510*c*. Method 2100 then moves from step 2134 to step 2136.

Figure 22Z:
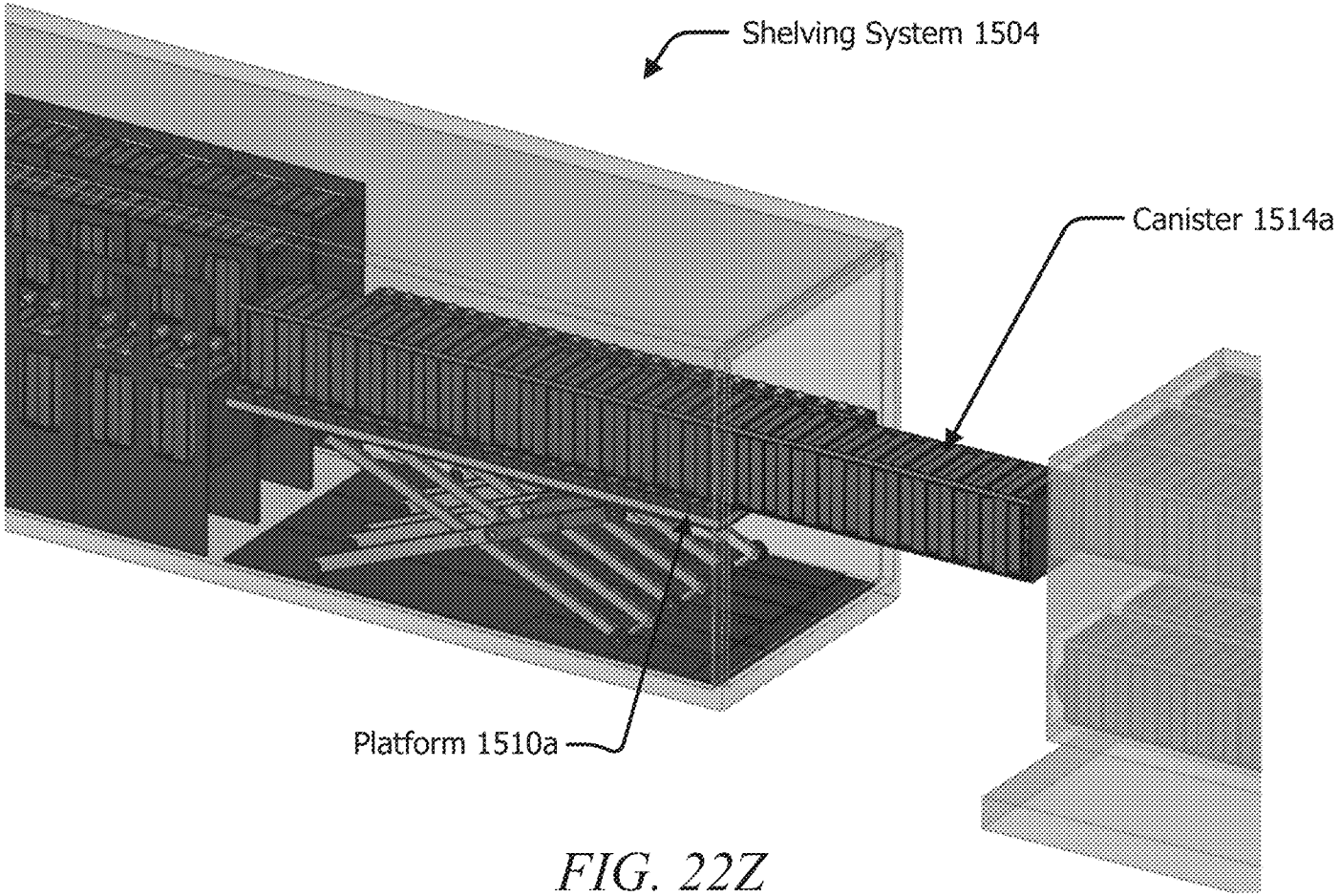
Figure 22Z:
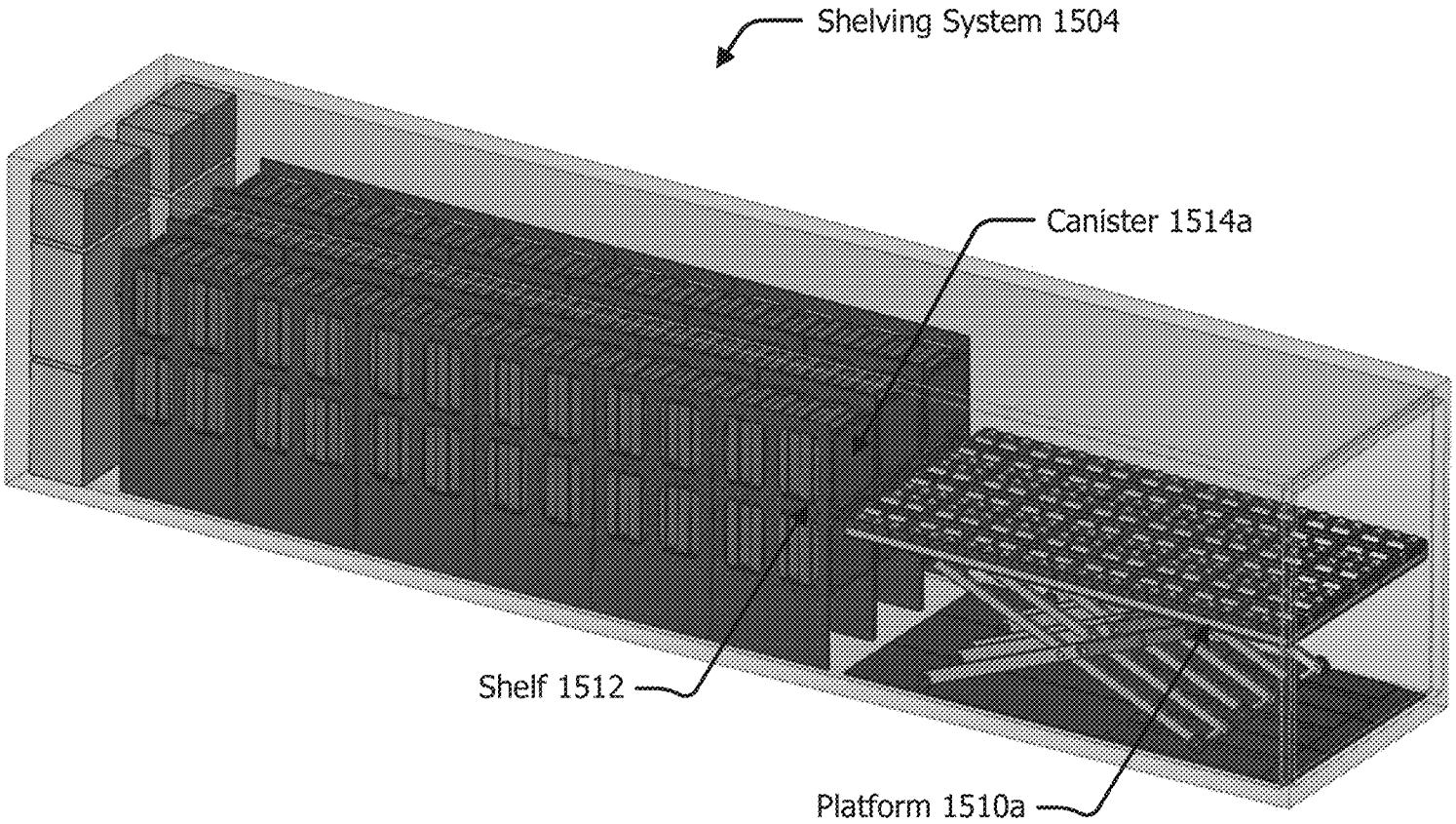
Figure 22Z:
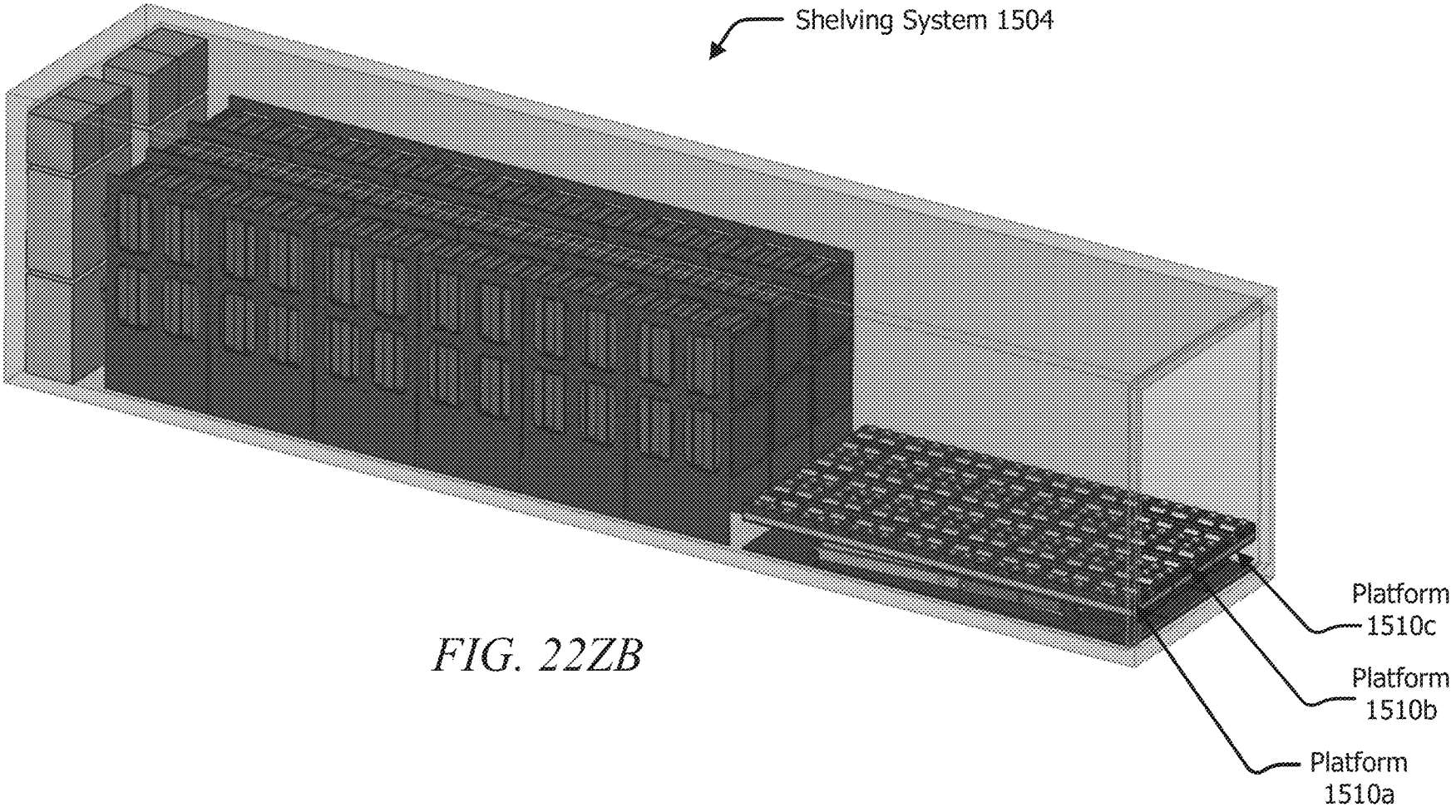

At step 2136 of method 2100, the first canister is translated from the second platform to the first platform. For example, referring to FIGS. 15 through 20 and FIG. 22Z, control system 1509 may provide a control signal to shelving system 1504 to activate rollers 1528 (shown in FIG. 19) of platforms 1510 to transfer first canister 1514*a* from third platform 1510*c* to second platform 1514*b* and ultimately to first platform 1510*a*. FIG. 22Z illustrates the first canister positioned on the first platform, in accordance with certain embodiments. For example, referring to FIG. 22Z, first canister 1514*a* is positioned on first platform 1510*a*. Method 2100 then moves from step 2136 to step 2138.

At step 2138 of method 2100, the first canister is translated from the first platform to the shelf of the shelving system. For example, referring to FIGS. 15 through 20 and FIG. 22ZA, control system 1509 may provide a control signal to shelving system 1504 to activate rollers 1526 (shown in FIG. 19) of shelf 1512 to translate first canister 1514*a* from first platform 1510*a* to shelf 1512. When first canister 1514*a* makes contact with shelf 1512, control system 1509 may provide an additional control signal to shelving system 1504 to activate rollers 1516 (shown in FIG. 17) of shelf 1512 to translate first canister 1514*a* fully to shelf 1512. FIG. 22ZA illustrates the first canister positioned on the shelf, in accordance with certain embodiments. For example, referring to FIG. 22ZA, first canister 1514*a* is positioned on shelf 1512. Method 2100 then moves from step 2138 to step 2140.

At step 2140 of method 2100, the vertical positioning of the platforms is adjusted to a stow position. For example, referring to FIGS. 15 through 20 and FIG. 22ZB, control system 1509 may provide a control signal to shelving system 1504 to adjust respective scissor legs 1530 of platforms 1510 to move from the second position to the first position. FIG. 22ZB illustrates the platforms in the stow position, in accordance with certain embodiments. For example, as illustrated in FIG. 22ZB, platform 1510*a*, platform 1510*b*, and platform 1510*c* are in the stow position. Method 2100 then moves from step 2140 to step 2141, where method 2100 ends.

Although this disclosure describes and illustrates particular steps method 2100 of FIG. 21 as occurring in a particular order, this disclosure contemplates any suitable steps of method 2100 of FIG. 21 occurring in any suitable order. Although this disclosure describes and illustrates an example method for automated missile launcher reloading including the particular steps of the method of FIG. 21, this disclosure contemplates any suitable method for automated launcher reloading including any suitable steps, which may include all, some, or none of the steps of the method of FIG. 21, where appropriate. Furthermore, although FIG. 21 describes and illustrates particular components, devices, or systems carrying out particular actions, this disclosure contemplates any suitable combination of any suitable components, devices, or systems carrying out any suitable actions.

Although FIGS. 15 through 20 and FIGS. 22A through 22XB illustrate particular number of components, devices, or systems, this disclosure contemplates any suitable number of components, devices, or systems. Although 15 through 20 and FIGS. 22A through 22XB illustrate particular arrangements of certain components, devices, or systems, this disclosure contemplates any suitable arrangement of components, devices, or systems. Furthermore, although 15 through 20 and FIGS. 22A through 22XB describe and illustrate particular components, devices, or systems carrying out particular actions, this disclosure contemplates any suitable combination of any suitable components, devices, or systems carrying out any suitable actions.

Figure 23:
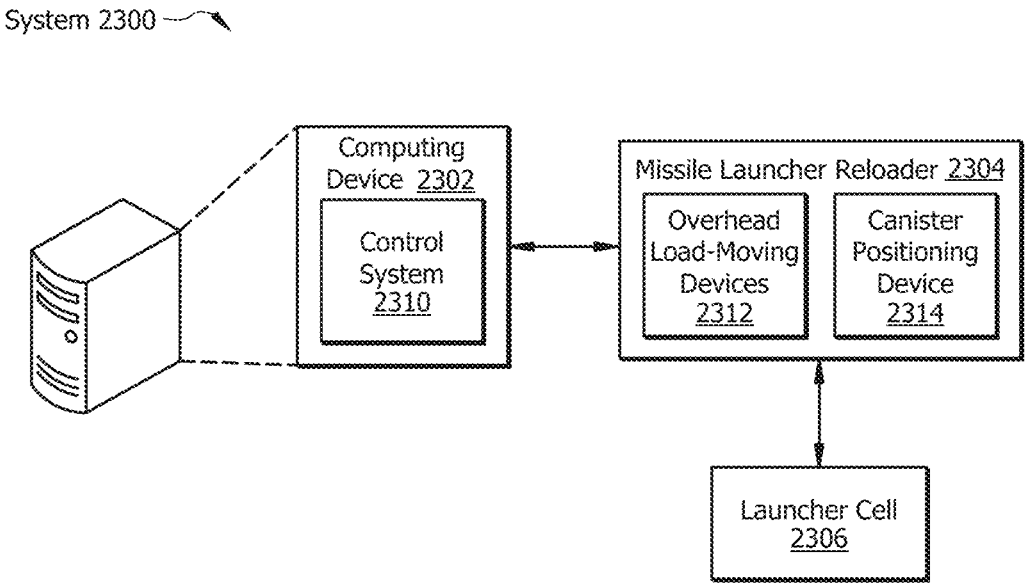
FIG. 23 illustrates a system for a missile launcher reloader, in accordance with a fourth embodiment.

FIG. 23 illustrates a system 2300 for a missile launcher reloader 2304, in accordance with a fourth embodiment. System 2300 or portions thereof may be associated with an entity, which may include any entity, such as a business, company, or enterprise, that is associated with missile launcher reloaders. For example, system 2300 may be associated with the United States Armed Forces (e.g., the Navy, the Army, the Air Force, etc.). The components of system 2300 may include any combination of hardware, firmware, and software. For example, the components of system 1500 may use one or more elements of the computer system of FIG. 28.

In the illustrated embodiment of FIG. 23, computing device 2302 includes a control system 2310. In certain embodiments, control system 2310 is included by a memory of computing device 2302. In some embodiments, control system 2310 includes a computer-executable program (software) that is executed by a processor of computing device 2302. In certain embodiments, computing device 2302 is in communication with missile launcher reloader 2304. In the illustrated embodiment of FIG. 23, missile launcher reloader 2304 includes overhead load-moving devices 2312 and a canister positioning device 2314. In certain embodiments, overhead load-moving devices 2312 are cranes (e.g., bridge cranes). In certain embodiments, missile launcher reloader 2304 of system 100 is automated. For example, missile launcher reloader 2304 may perform certain actions in response to one or more signals received from computing device 2302 without needing human control.

Control system 2310 of system 2300 may be in communication with any portion of missile launcher reloader 2304, including overhead load-moving devices 2312 and/or canister positioning device 2314. In certain embodiments, control system 2310 is configured to provide control signals to missile launcher reloader 2304 to control the actions of missile launcher reloader 2304. In some embodiments, control system 2310 is configured to provide control signals to overhead load-moving devices 2312 to control overhead load-moving devices 2312 to perform certain actions, as described further herein.

Figure 24:
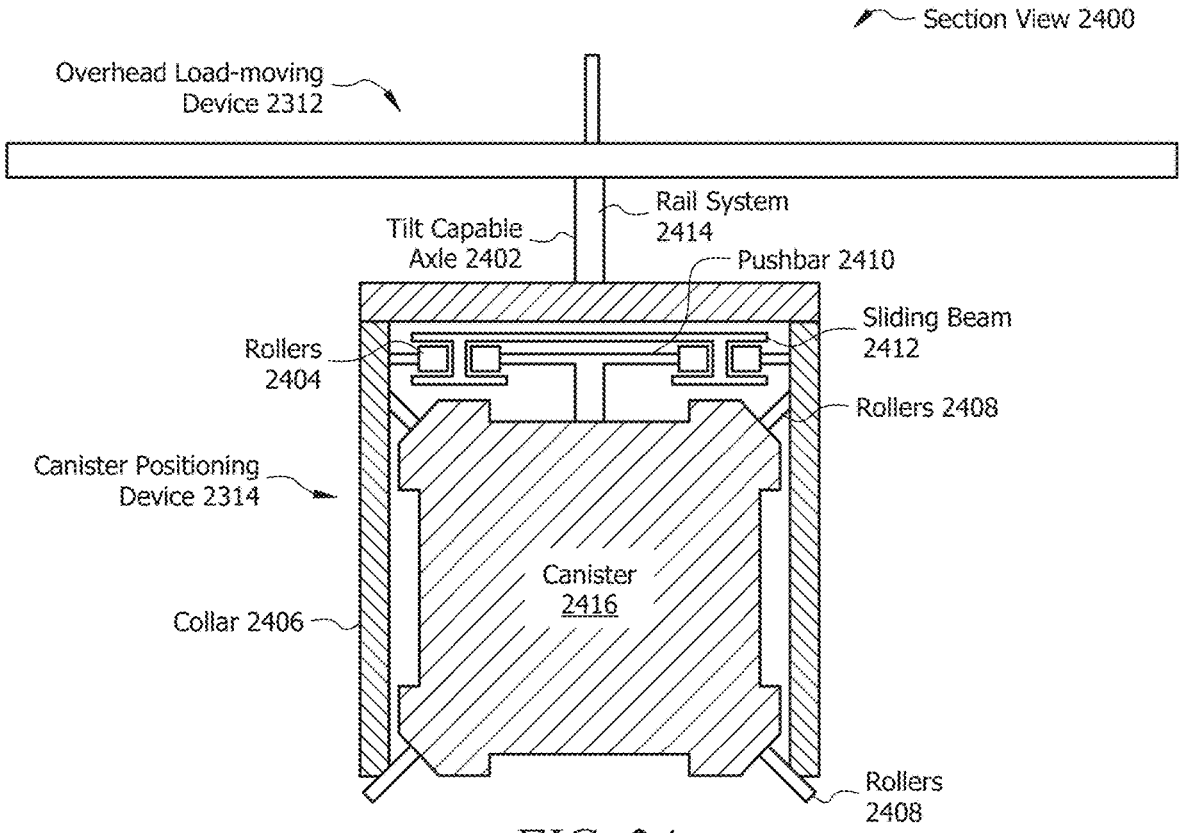
FIG. 24 illustrates a front view of a canister positioning device, in accordance with the fourth embodiment.

FIG. 24 illustrates a section view 2400 of canister positioning device 2314, in accordance with the fourth embodiment. In the illustrated embodiment of FIG. 24, canister positioning device 2314 is coupled to overhead load-moving device 2312 (e.g., a bridge crane and/or rail system). In certain embodiments, canister positioning device 2314 includes a tilt capable axle 2402, first rollers 2404 (e.g., active rollers, wheels, etc.), a collar 2406, second rollers 2408 (e.g., active rollers, wheels, etc.), a push bar 2410, a sliding beam 2412, and a rail system 2414 (e.g., a bridge crane, a beam, etc.). as illustrated in FIG. 24. Canister positioning device 2314 may be coupled to a canister 2416.

Figure 25:
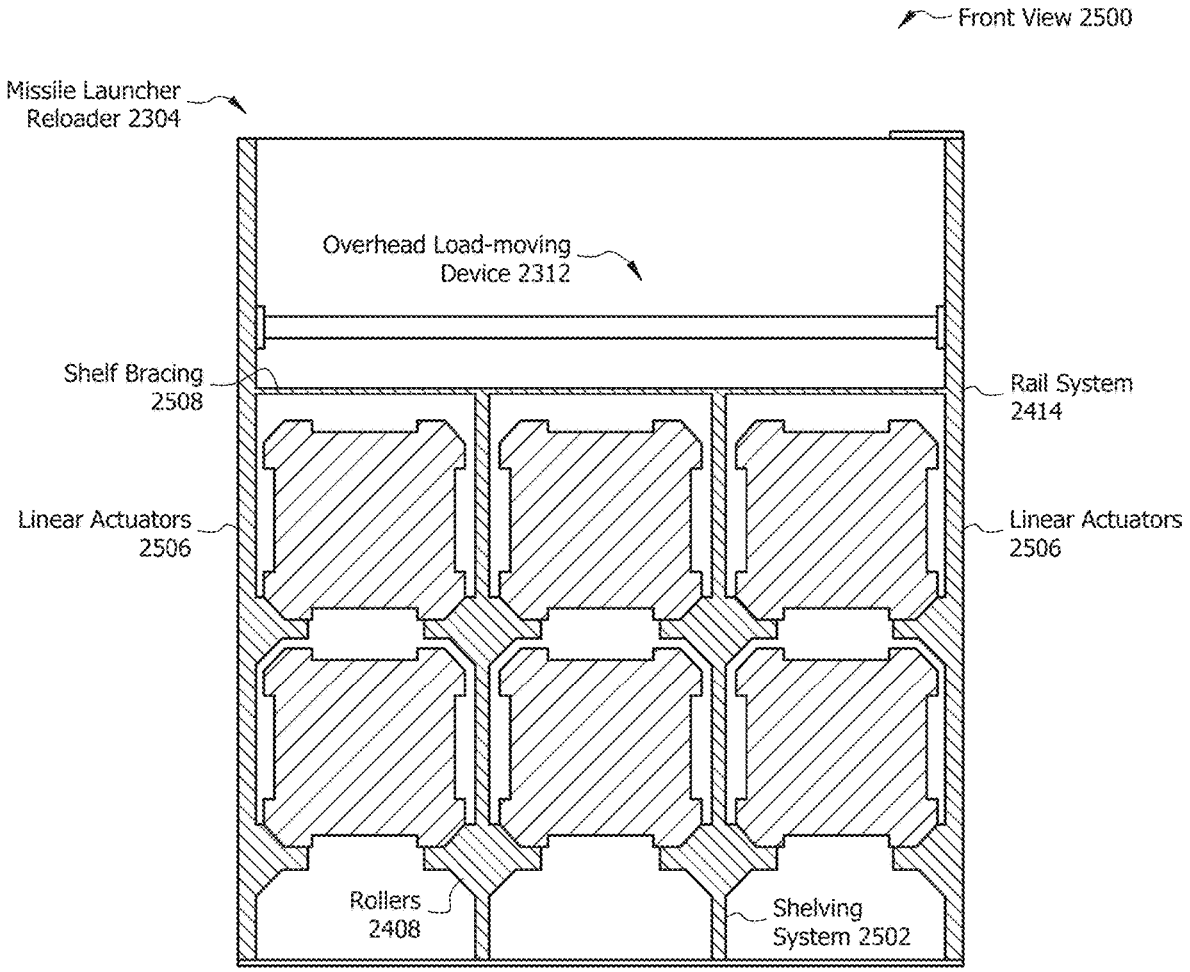
FIG. 25 illustrates a front view of a missile launcher reloader, in accordance with the fourth embodiment.

FIG. 25 illustrates a front view 2500 of missile launcher reloader 2304, in accordance with the fourth embodiment. As illustrated in FIG. 25, missile launcher reloader 2304 includes overhead load-moving device 2312 (e.g., a bridge crane and/or rail system), a shelving system 2502, rollers 2408, linear actuators 2506 (e.g., linear actuators, vertical rails, etc.), a shelf bracing 2508, and rail system 2414.

Figure 26:
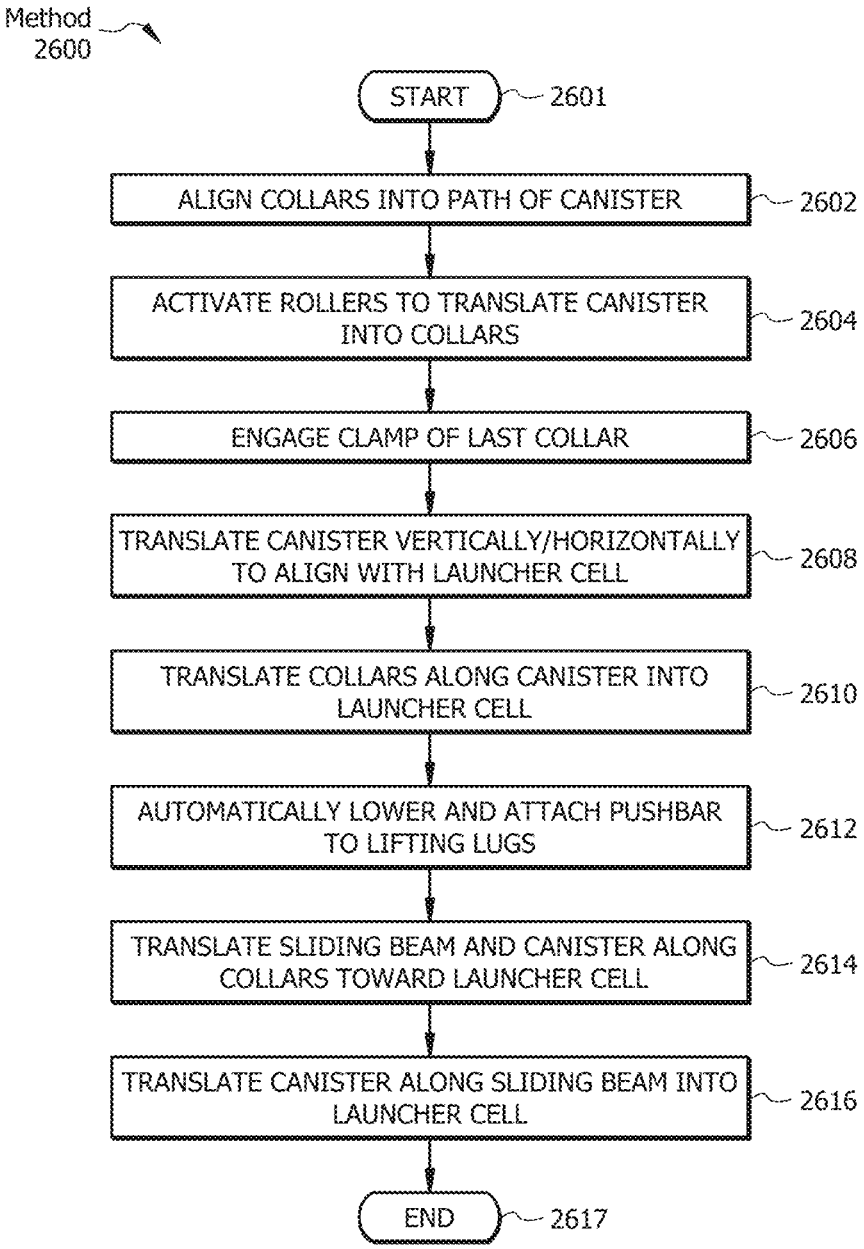
FIG. 26 illustrates a method for automated missile launcher reloading, in accordance with the fourth embodiment.

FIG. 26 illustrates a method 2600 for automated missile launcher reloading, in accordance with the fourth embodiment. Method 2600 may be performed by computing device 2302, shelving system 2502, missile launcher reloader 2304, and/or control system 2310, and with reference to FIGS. 23 through 25. FIG. 26 refers to FIGS. 27A through 27T, which illustrate the stages of automated missile launcher reloading at a missile launcher reloader, in accordance with the fourth embodiment. Certain operations described in method 2600 may be optional or may be rearranged in different embodiments.

Figure 27A:
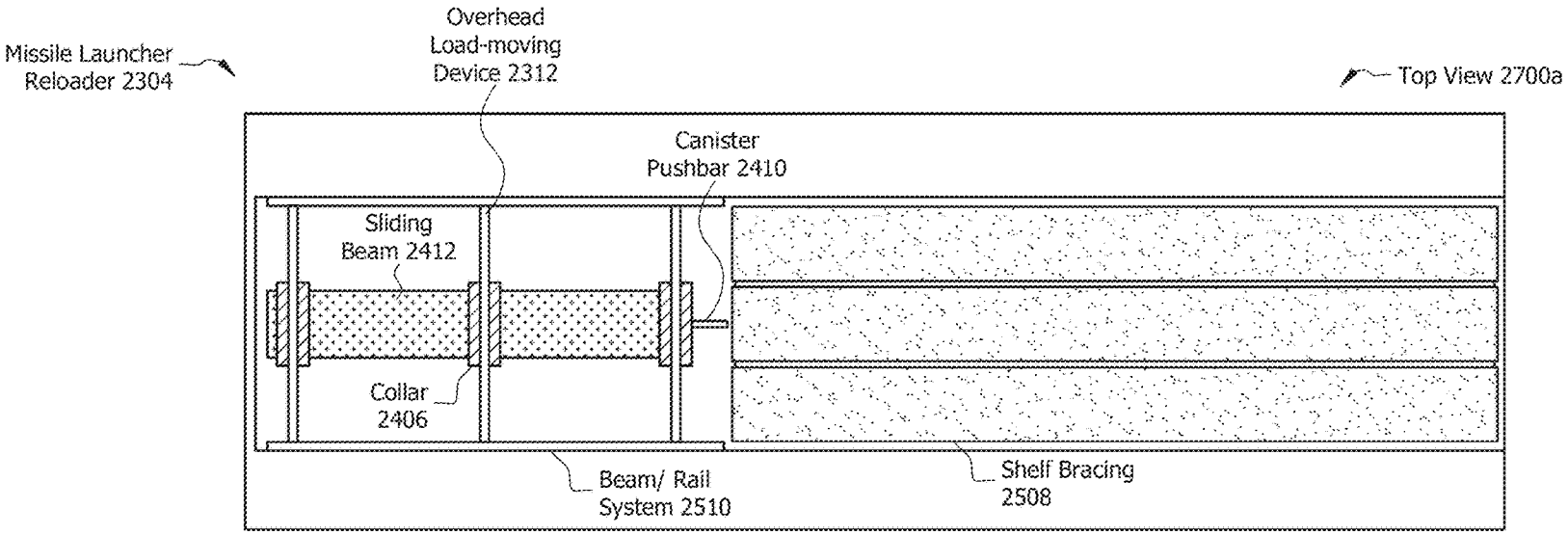
FIGS. 27A through 27T illustrate stages of automated missile launcher reloading at the missile launcher reloader, in accordance with the fourth embodiment.
Figure 27B:
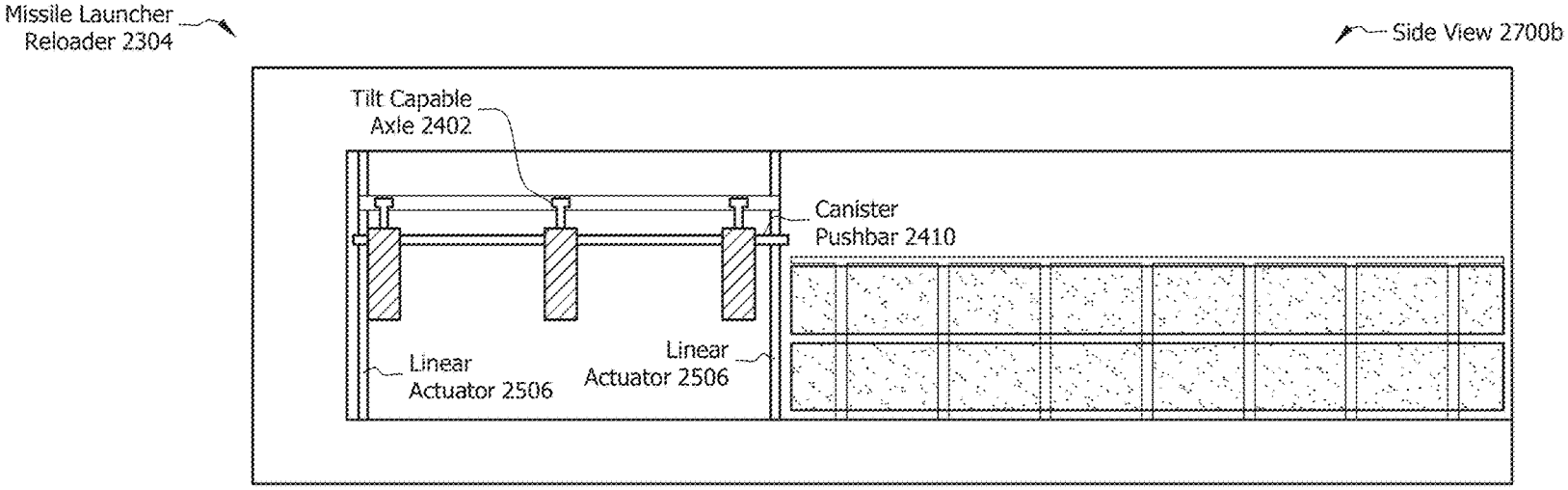

Method 2600 begins at step 2601. At step 2602 of method 2600, collars are aligned with a path of an awaiting canister. For example, referring to FIGS. 23 through 25, control system 2310 may provide a control signal to missile launcher reloader 2304 such that the collars are aligned with a path of an awaiting canister. FIG. 27A illustrates a top view 2700*a* of missile launcher reloader 2704. In the illustrated embodiment of FIG. 27A, missile launcher reloader 2304 includes overhead load-moving device 2312, collar 2406, canister push bar 2410, sliding beam 2412, shelf bracing 2508, and beam/rail system 2510. FIG. 27B illustrates a side view 2600*b* of missile launcher reloader 2304. In the illustrated embodiment of FIG. 27B, missile launcher reloader 2304 includes tilt capable axle 2402, canister push bar 2410, and linear actuators 2506. Missile launcher reloader 2304 of FIG. 27B is shown with all canister slots occupied. In certain embodiments, one or more of the canister slots may be empty to receive an empty (spent) canister.

Figure 27C:
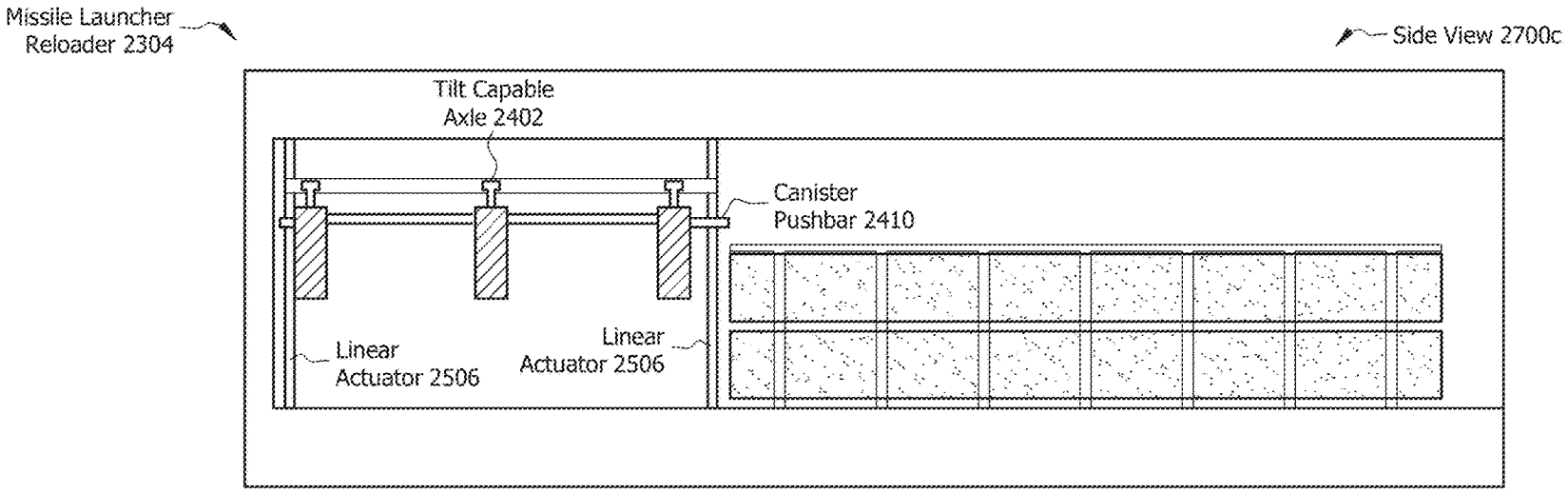
Figure 27D:
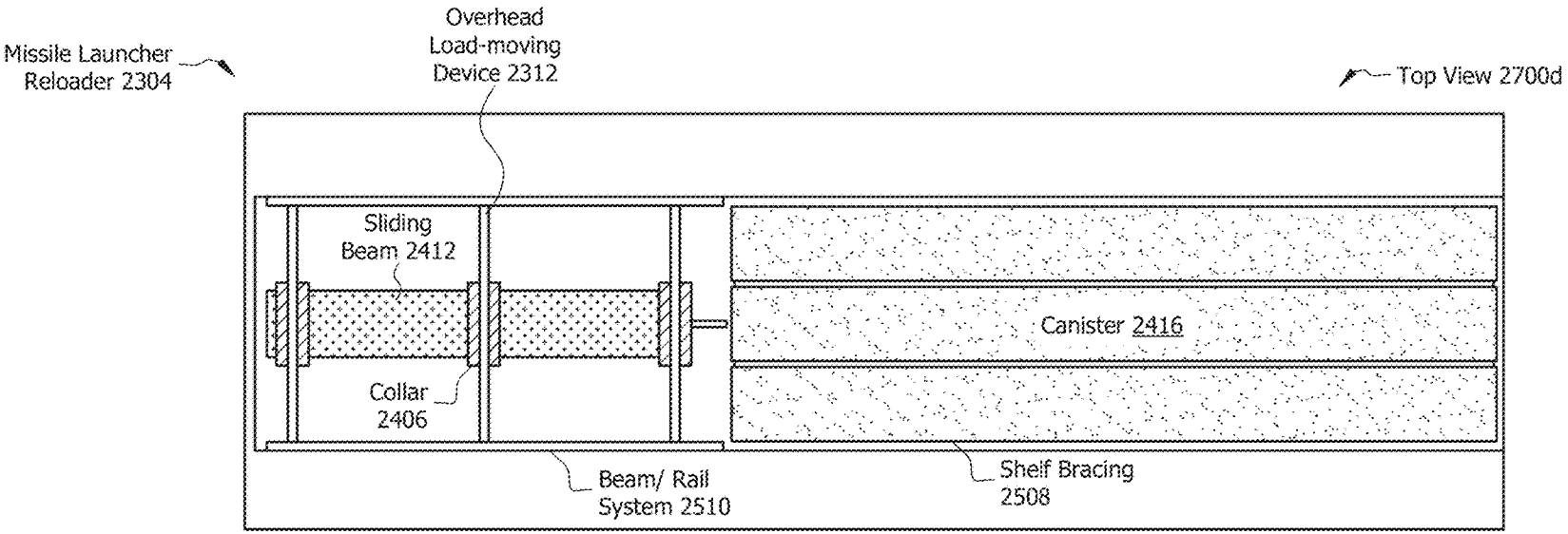

FIG. 27C illustrates a side view 2700*c* of missile launcher reloader 2304, and FIG. 27D illustrates a top view 2700*d* of missile launcher reloader 2304. FIG. 27C includes tilt capable axle 2402, push bar 2410, and linear actuators 2506. FIG. 27D includes overhead load-moving device 2312, collar 2406, sliding beam 2412, shelf bracing 2508, and beam/rail system 2510. In the illustrated embodiments of FIGS. 27C and 27D, collars 2406 are aligned via linear actuators 2506 (vertically) and overhead load-moving devices 2312 (horizontally), if needed, into the path of awaiting canister 2416 stored in shelving system 2502. Method 2600 then moves from step 2602 to step 2604.

Figure 27E:
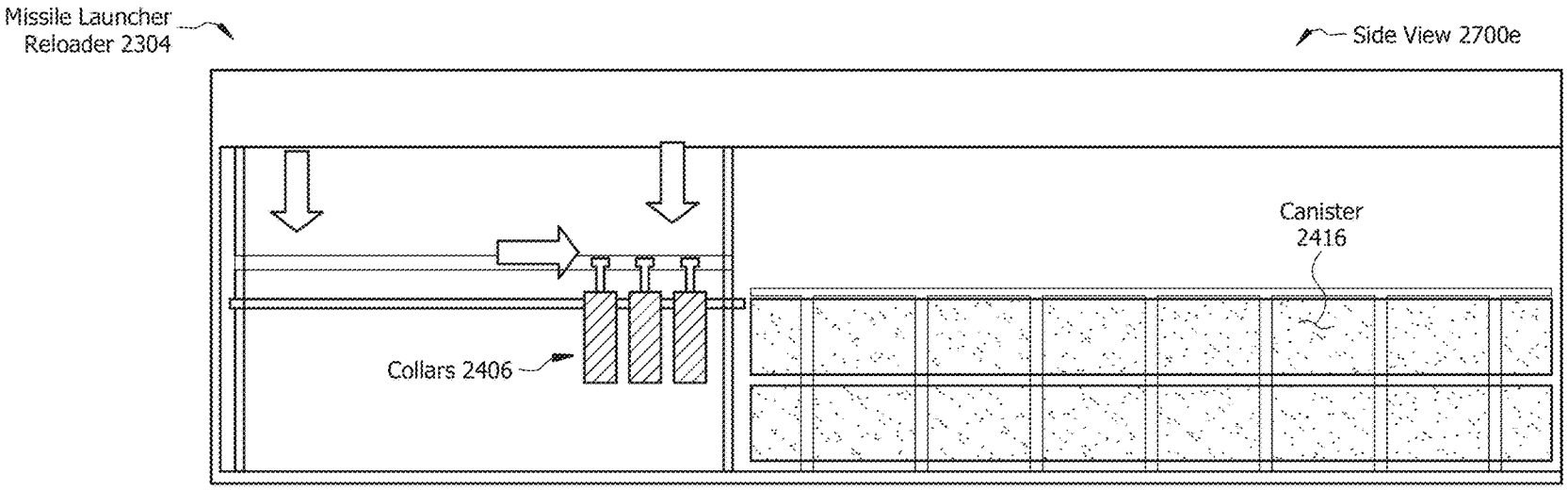
Figure 27F:
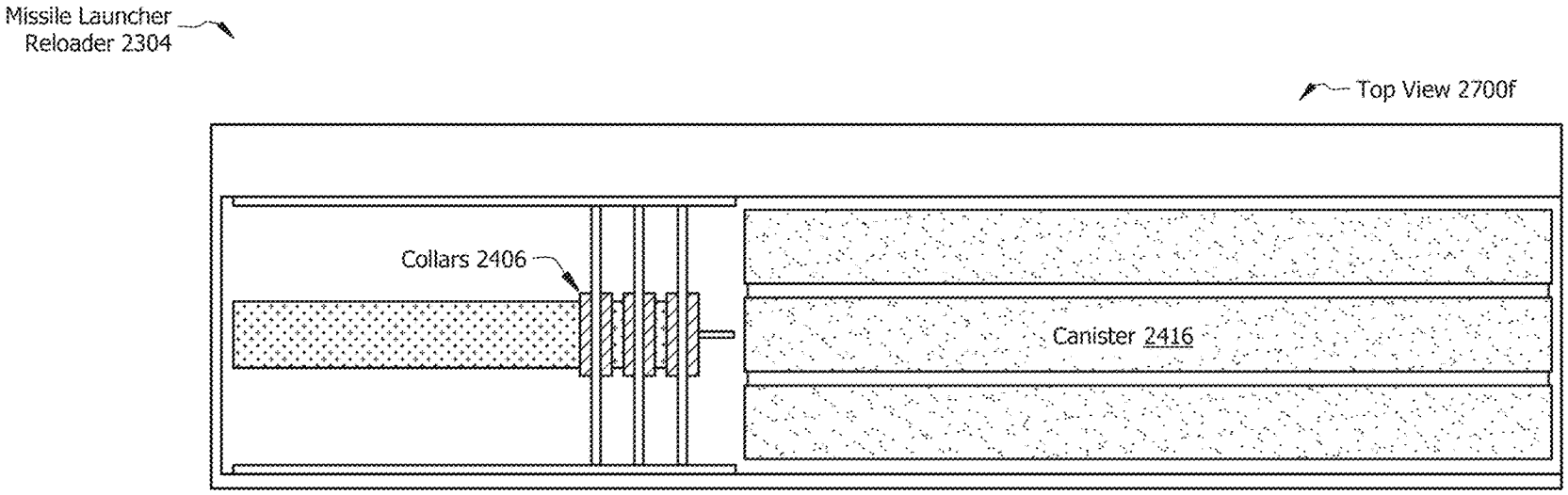

At step 2604 of method 2600, forward rollers are activated in the shelving system to translate the canister into the aligned collars. For example, referring to FIGS. 23 through 25, control system 2310 may provide a control signal to missile launcher reloader 2304 to activate forward rollers 2404 in shelving system 2502 and translate canister 2416 into aligned collars 2406. FIG. 27E illustrates a side view 2700*e* of missile launcher reloader 2304, and FIG. 27F illustrates a top view 2700*f* of missile launcher reloader 2304. In the illustrated embodiments of FIGS. 27E and 27F, forward rollers 2404 are activated in shelving system 2502 to translate (see arrow in FIG. 27E) canister 2416 into aligned collars 2406. In certain embodiments, collars 2406 are adjusted to receive canister 2416. For example, collars 2406 may be translated, tilted, and/or rotated to receive canister 2416. Method 2600 then moves from step 2604 to step 2606.

Figure 27G:
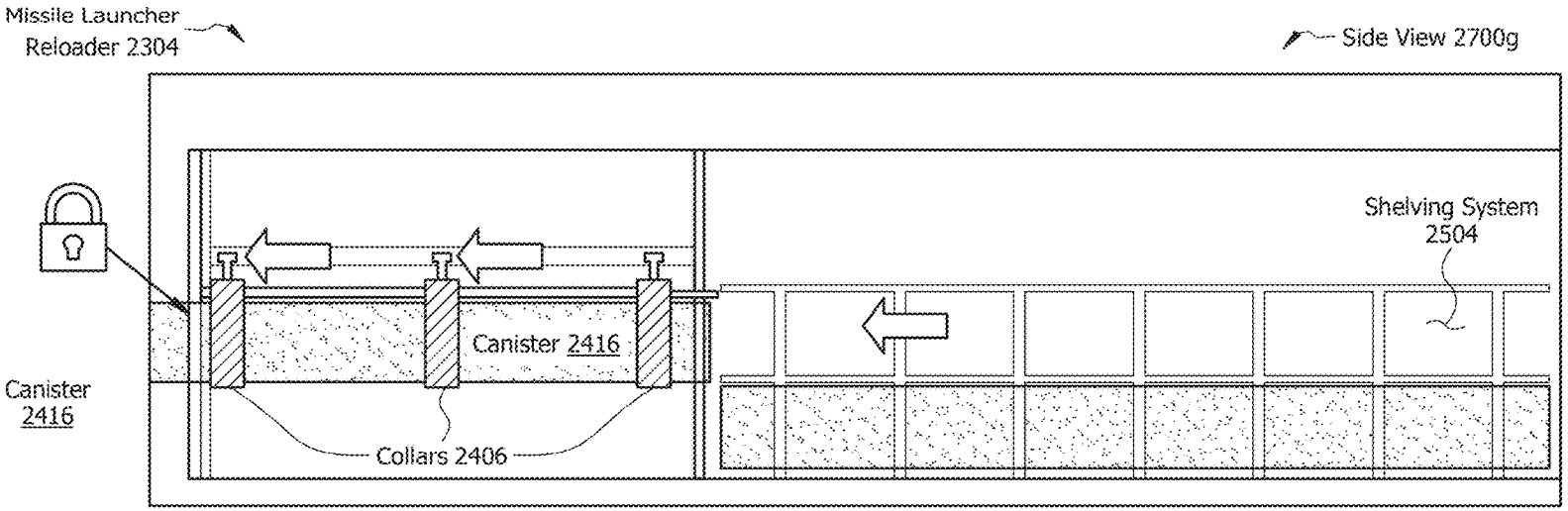
Figure 27H:
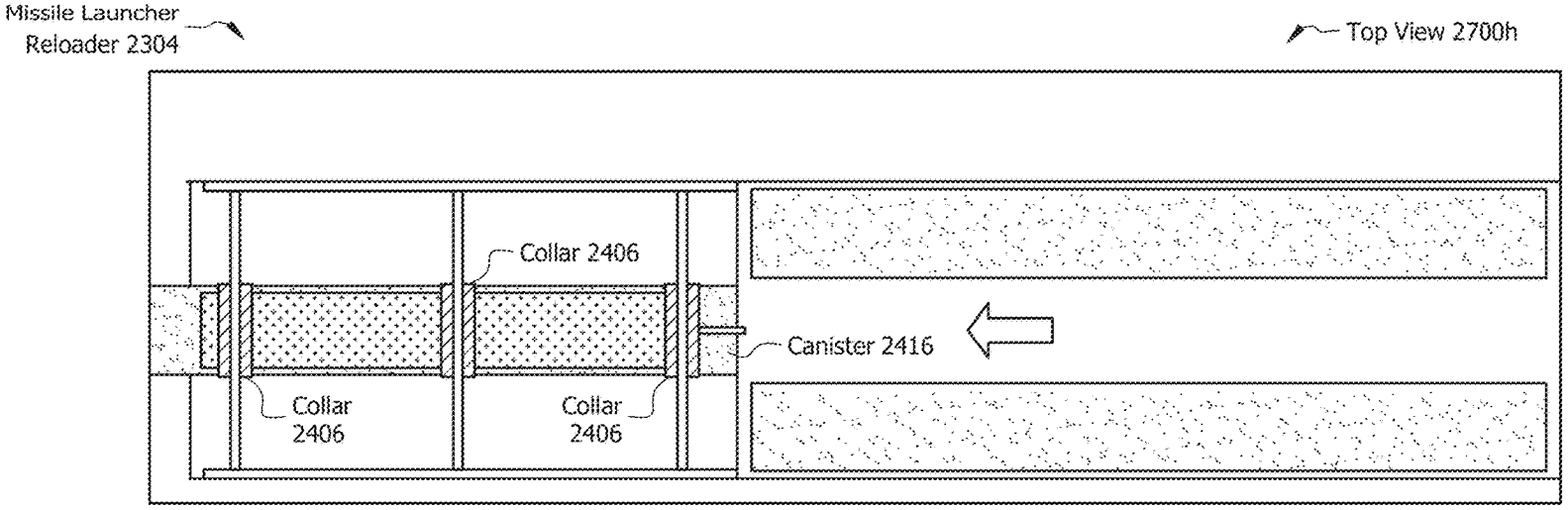
Figure 27I:
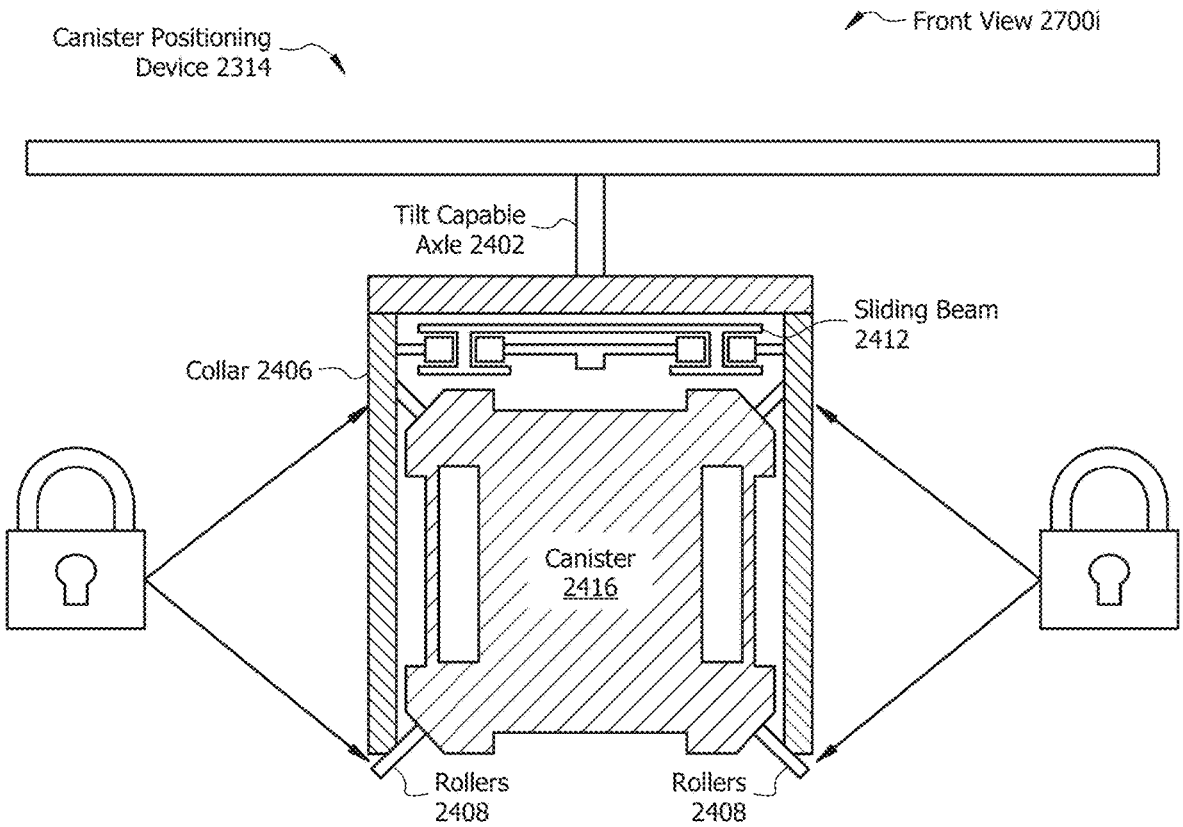

At step 2606 of method 2600, the clamping mechanism of the last collar engages to prepare for further movement of the canister once the canister is fully received by the collars and clears the shelving system. For example, referring to FIGS. 23 through 25, control system 2310 may provide a control signal to missile launcher reloader 2304 to engage the clamping mechanism of last collar 2406 to prepare for further movement of canister 2416 once canister 2416 is fully received by collars 2406 and clears shelving system 2502. FIG. 27G illustrates a side view 2700*g* of missile launcher reloader 2304, FIG. 27H illustrates a top view 2700*h* of missile launcher reloader 2304, and FIG. 27I illustrates a front view 2700*i* of canister positioning device 2314. FIGS. 26G, 26H, 26I illustrate that once canister 2416 is fully received by collars 2406 and clear of shelving system 2502, the clamping mechanism of last collar 2406 engages to prepare for further movement of canister 2416. In certain embodiments, brakes are applied to rollers 2404 or the engagement of the clamps. Method 2600 then moves from step 2606 to step 2608.

Figure 27J:
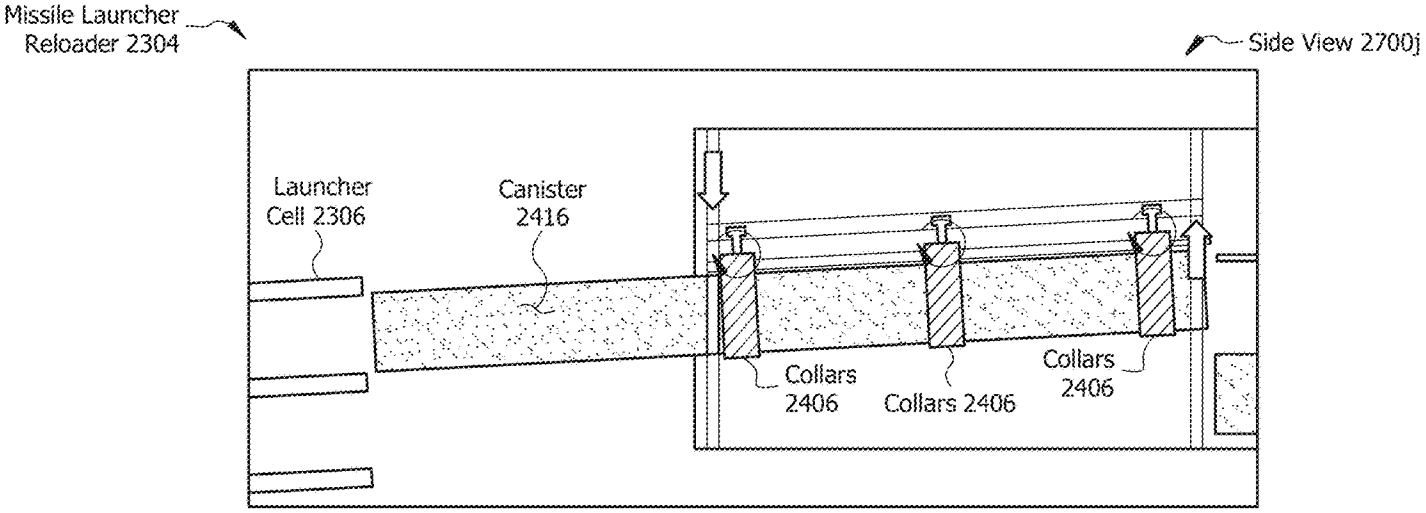
Figure 27K:
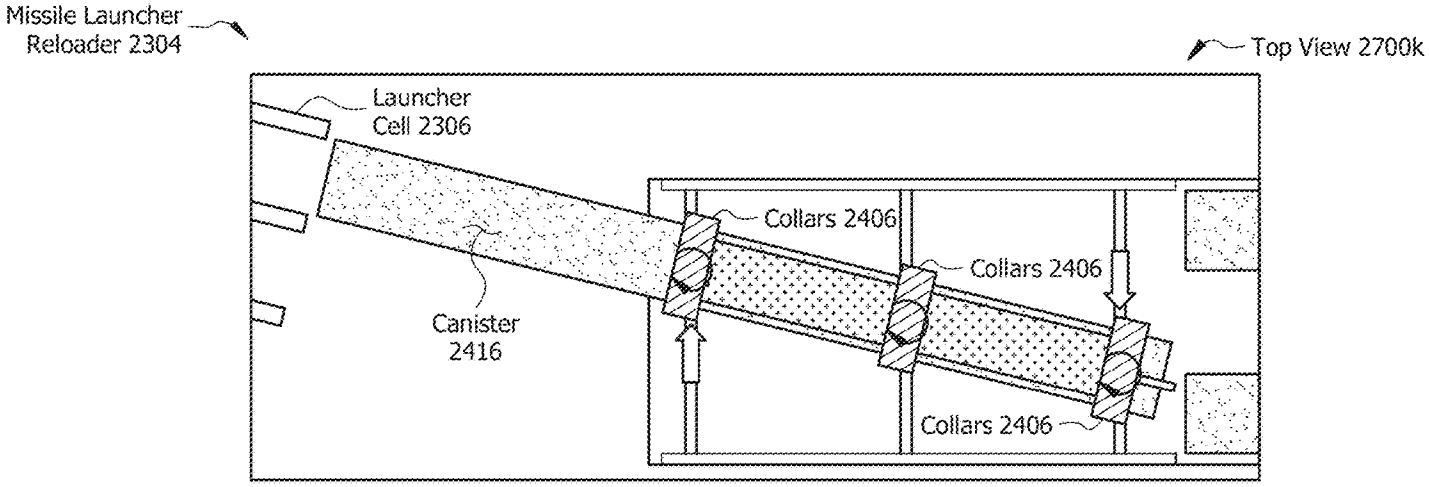

At step 2608 of method 2600, the canister is translated vertically and/or horizontally as necessary to align itself with the receiving launcher cell. For example, referring to FIGS. 23 through 25, control system 2310 may provide a control signal to missile launcher reloader 2304 to translate canister 2406 vertically and/or horizontally. FIG. 27J illustrates a side view 2700*j* of missile launcher reloader 2304, and FIG. 27K illustrates a top view 2700*k* of missile launcher reloader 2304. As shown in FIGS. 27J and 27K, canister 2416 is translated vertically and/or horizontally as necessary (see arrows), with collars 2406 tilting and rotating laterally as required. In the illustrated embodiment of FIG. 27J, receiving launcher cell 2306 is below horizontal. In the illustrated embodiment of FIG. 27K, receiving launcher cell 2306 is highly off axis. Method 2600 then moves from step 2608 to step 2610.

Figure 27L:
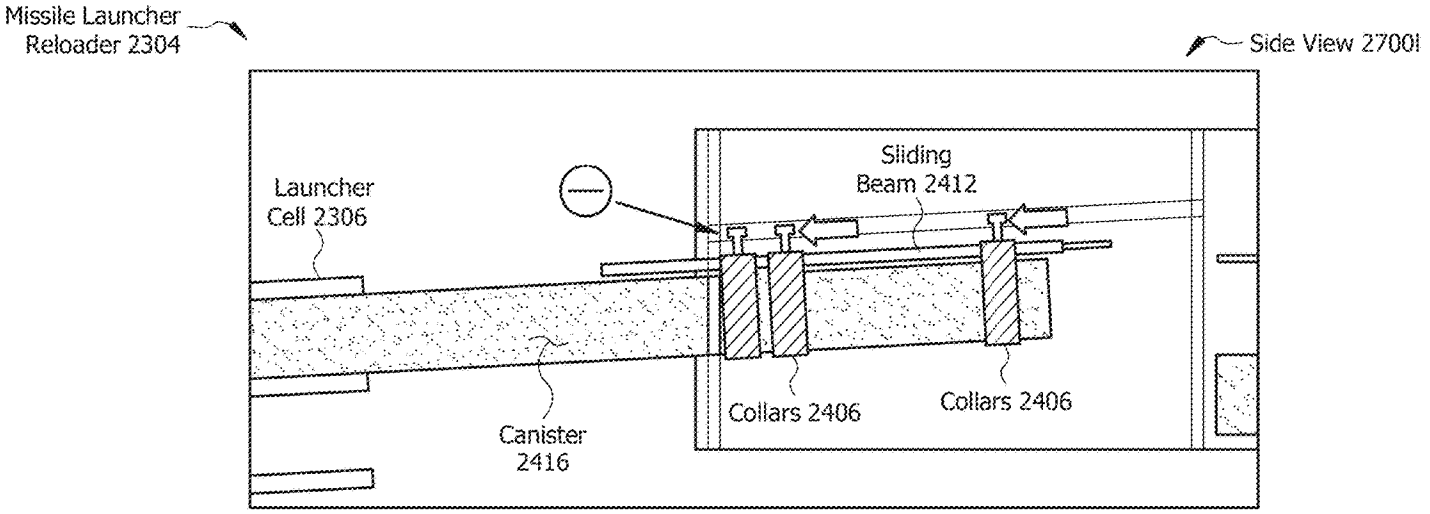
Figure 27M:
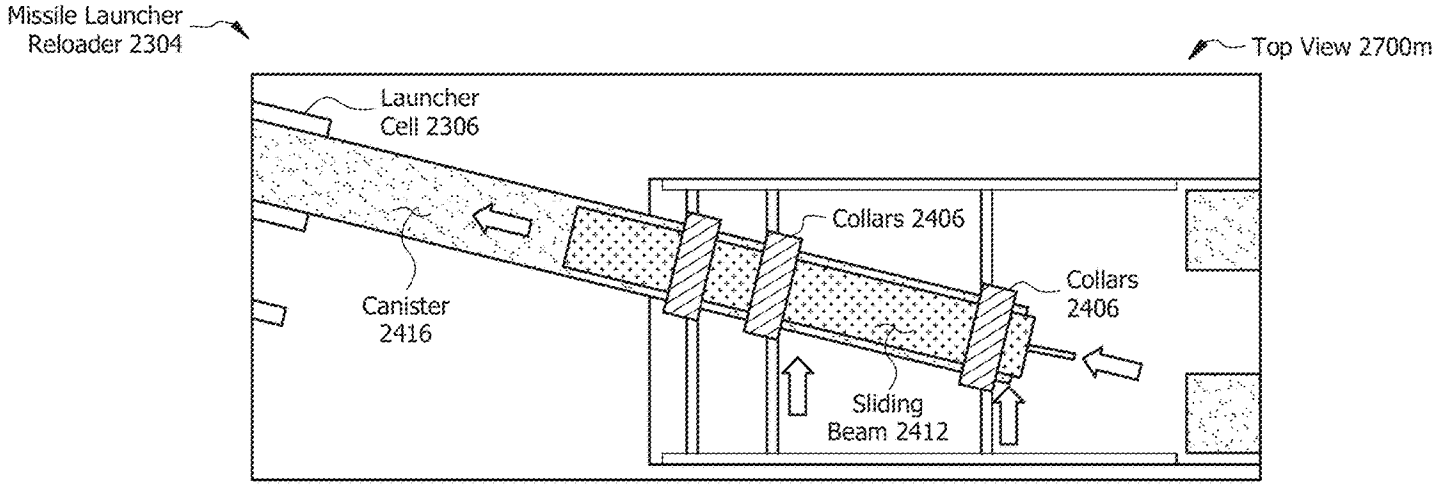

At step 2610 of method 2600, collars are translated along the attached canister into the path of the receiving launcher cell. For example, referring to FIGS. 23 through 25, control system 2310 may provide a control signal to missile launcher reloader 2304 to translate collars 2406 along attached canister 2416 into the path of receiving launcher cell 2306. FIG. 27L illustrates a side view 2600*l* of missile launcher reloader 2304, and FIG. 27M illustrates a top view 2600*m* of missile launcher reloader 2304. As illustrated in FIGS. 27L and 27M, collars 2406 are translated along attached canister 2416 into the path of the receiving launcher cell 2306, as indicated by the arrows in FIGS. 27L and 27M. In certain embodiments, collars 2406 are adjusted laterally as necessary to translate canister 2416 into the path of launcher cell 2306. The clamps are released for each collar 2406 when that collar 2406 reaches its full extent. Sliding beam 2412 has independent movement controls from both collar 2406 and canister 2416 and has moved along with canister 2416 at a slightly slower pace to gain access to the rear of canister 2416. Method 2600 then moves from step 2610 to step 2612.

Figure 27N:
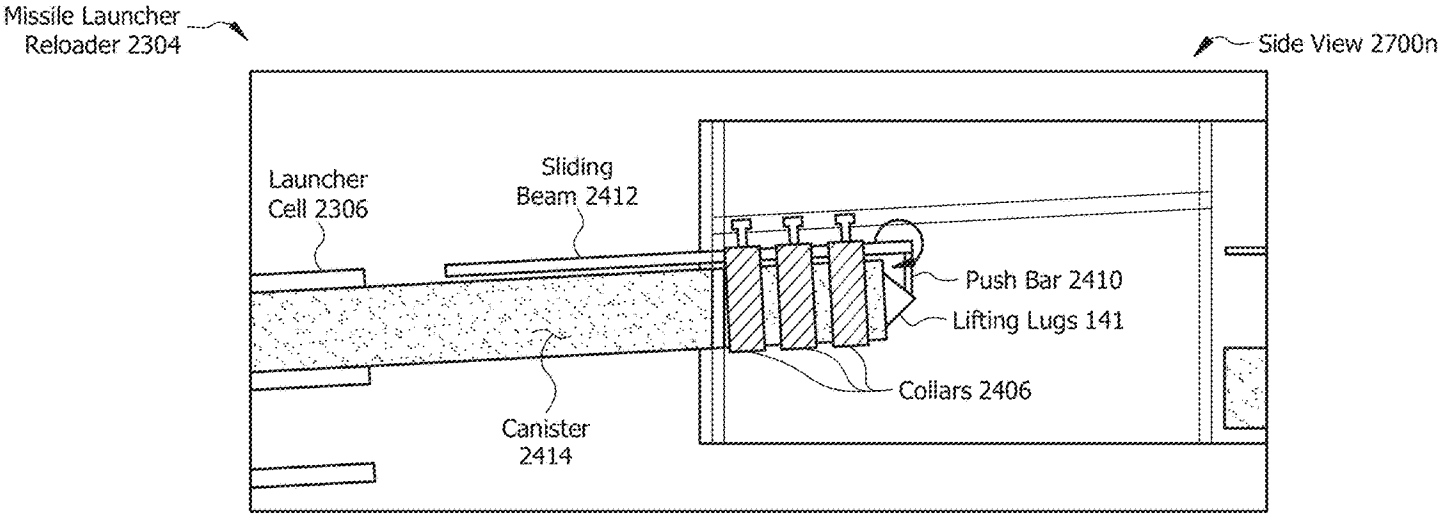
Figure 27O:
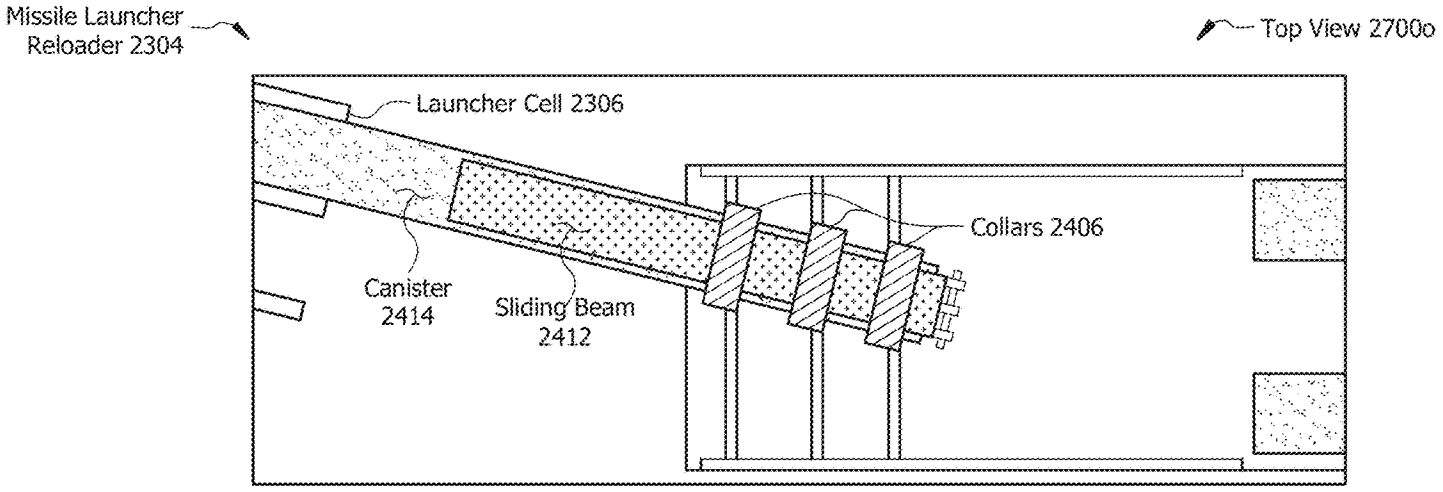
Figure 27P:
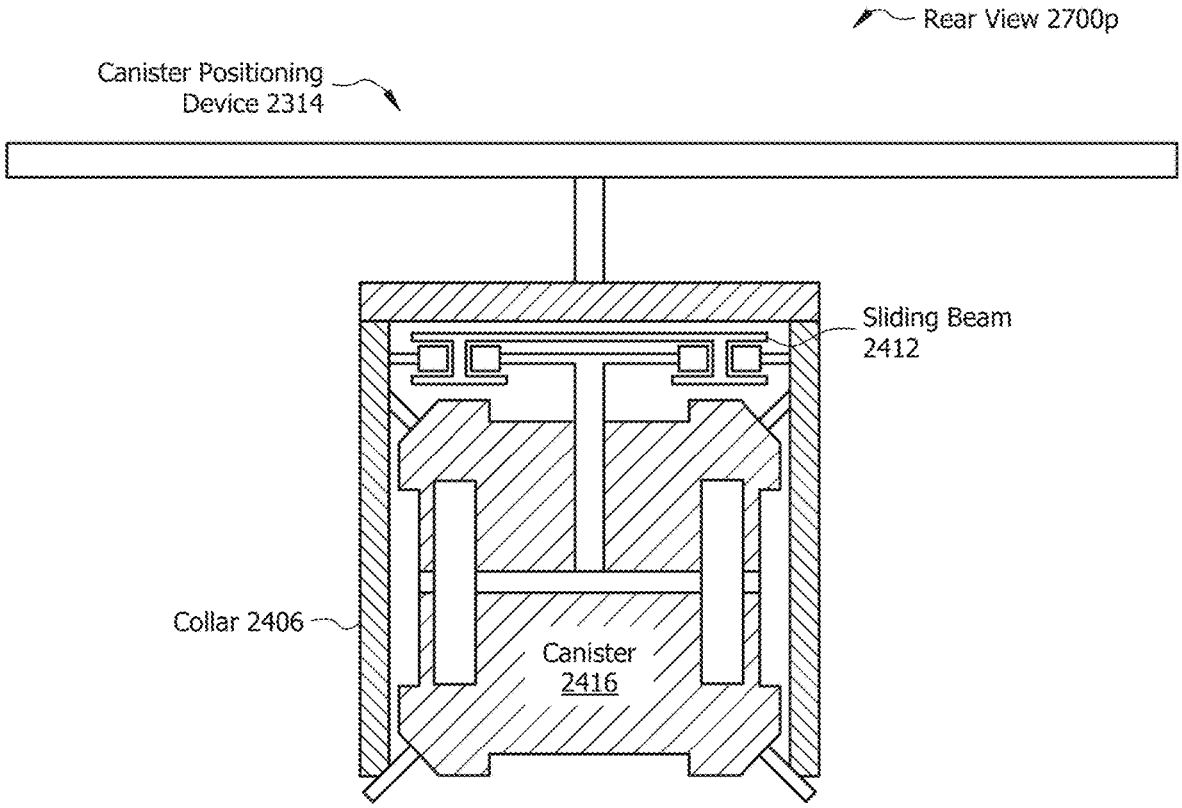
Figure 27Q:
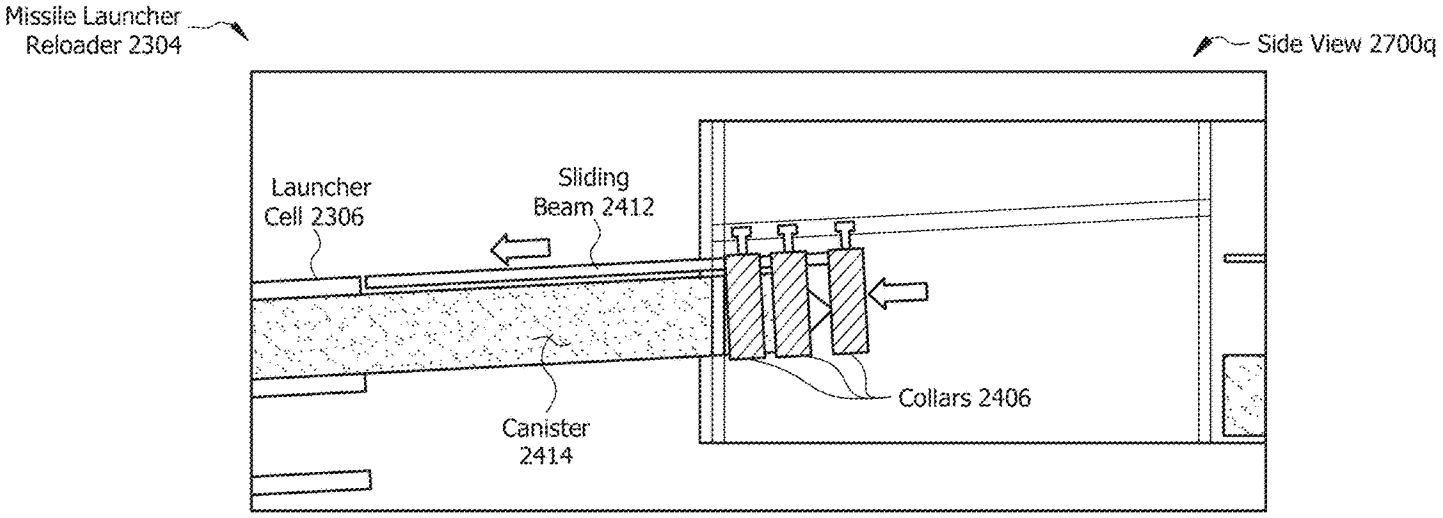
Figure 27R:
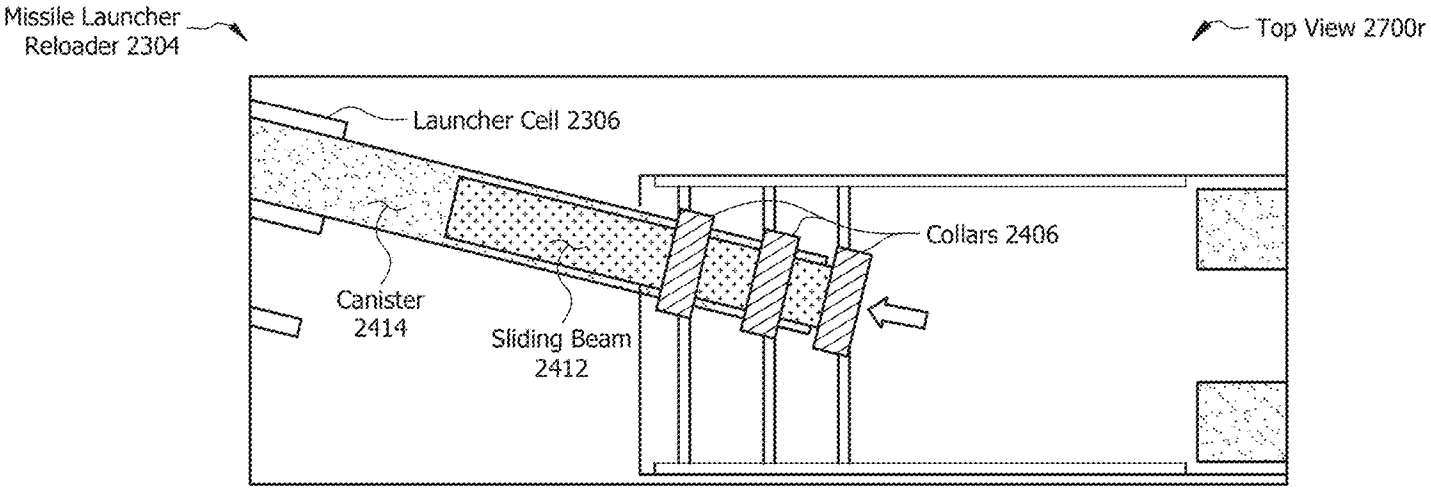
Figure 27S:
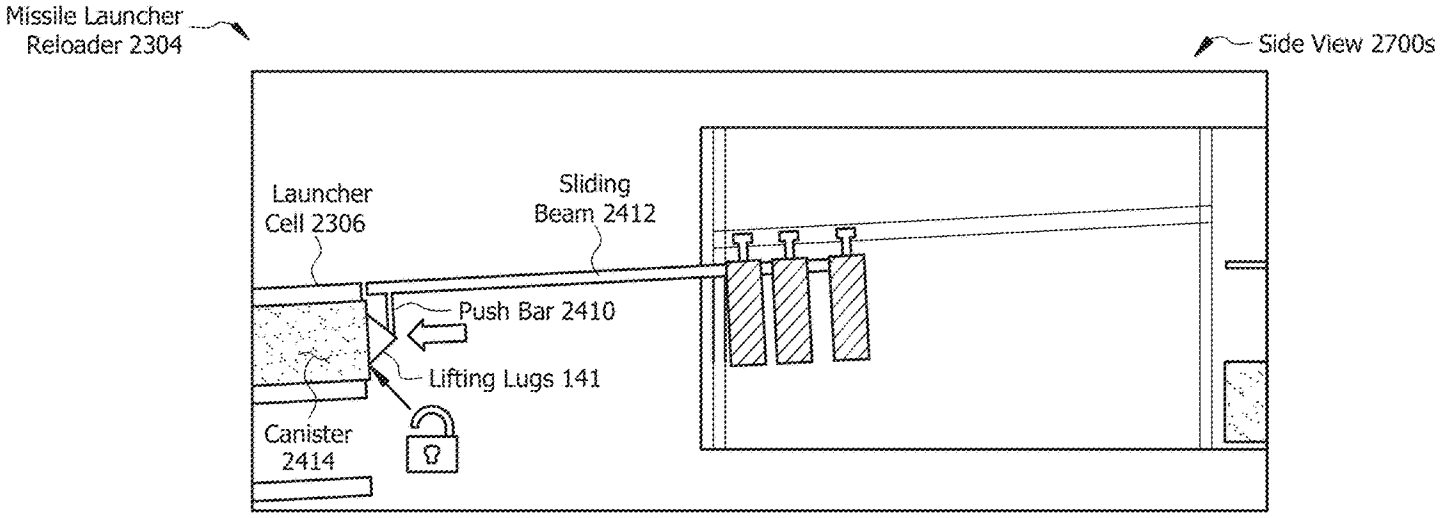

At step 2612 of method 2600, a push bar automatically lowers and attaches to the lifting lugs. For example, referring to FIGS. 23 through 25, control system 2310 may provide a control signal to missile launcher reloader 2304 to automatically lower and attach push bar 2410 to lifting lugs 141. FIG. 27N illustrates a side view 2700*n* of missile launcher reloader 2304, FIG. 27O illustrates a top view 2700*o* of missile launcher reloader 2304, and FIG. 27P illustrates a rear view 2700*p* of canister positioning device 2314. As illustrated in FIGS. 27N, 27O, and 27P, at full extension with sliding beam 2412 positioned slightly behind the rear of canister 2416, push bar 2410 automatically lowers and attaches (see arrow) to manually placed lifting lugs 141. Method 2600 then moves from step 2612 to step 2614.

At step 2614 of method 2600, the sliding beam and the attached canister are translated along the collars toward the launcher cell. For example, referring to FIGS. 23 through 25, control system 2310 may provide a control signal to missile launcher reloader 2304 to translate sliding beam 2412 and attached canister 2416 along collars 2406 toward launcher cell 2306. FIG. 26Q illustrates a side view 2600*q* of missile launcher reloader 2304, and FIG. 26R illustrates a top view 2600*r* of missile launcher reloader 2304. FIGS. 26Q and 26R illustrate sliding beam 2412, along with attached canister 2416, translated along collars 2406 toward launcher cell 2306. Method 2600 then moves from step 2614 to step 2616.

At step 2616 of method 2600, the canister is translated along the sliding beam into the launcher cell. For example, referring to FIGS. 23 through 25, control system 2310 may provide a control signal to missile launcher reloader 2304 to translate canister 2416, via a force applied through push bar 2410, along sliding beam 2412 and into launcher cell 2306. FIG. 26S illustrates a side view 2600*s* of missile launcher reloader 2304, and FIG. 26T illustrates a top view 2600*t* of missile launcher reloader 2304. FIGS. 4S and 4T illustrate canister 2416, via a force applied through push bar 2410, translated along sliding beam 2412 and into launcher cell 2306. In certain embodiments, lifting lugs 141 are then manually detached and missile launcher reloader 2304 returns to the default position ready to repeat the process. Method 2600 then moves from step 2616 to step 2617, where method 2600 ends.

Although this disclosure describes and illustrates particular steps method 2600 of FIG. 26 as occurring in a particular order, this disclosure contemplates any suitable steps of method 2600 of FIG. 26 occurring in any suitable order. Although this disclosure describes and illustrates an example method for automated missile launcher reloading including the particular steps of the method of FIG. 26, this disclosure contemplates any suitable method for automated launcher reloading including any suitable steps, which may include all, some, or none of the steps of the method of FIG. 26, where appropriate. Furthermore, although FIG. 21 describes and illustrates particular components, devices, or systems carrying out particular actions, this disclosure contemplates any suitable combination of any suitable components, devices, or systems carrying out any suitable actions.

Figure 27T:
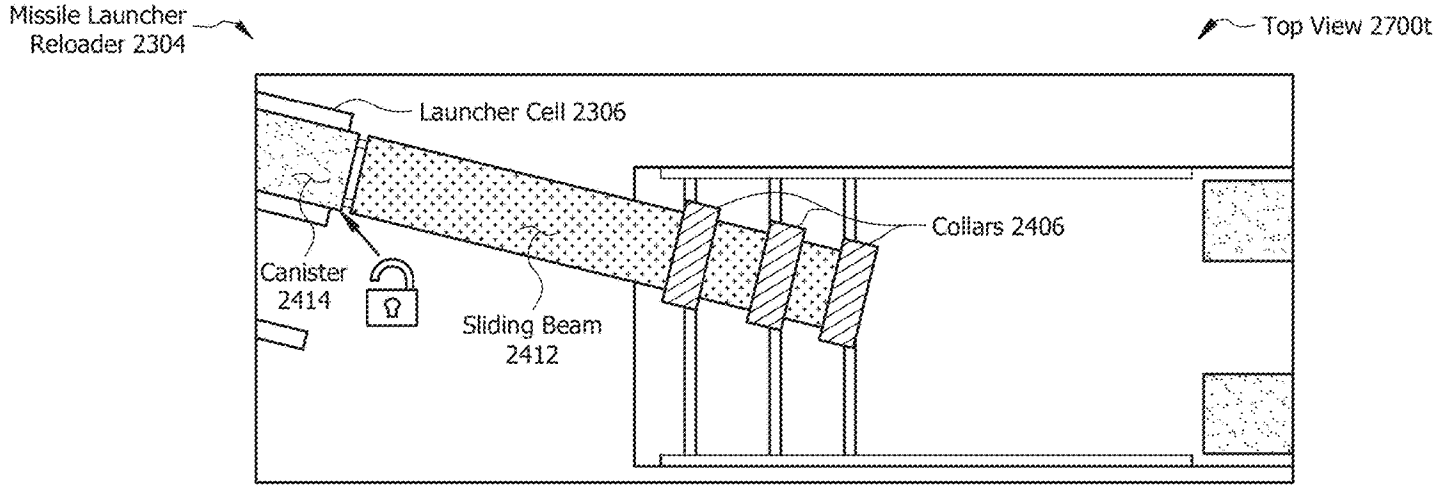

Although FIGS. 23 through 25 and FIGS. 27A through 27T illustrate particular number of components, devices, or systems, this disclosure contemplates any suitable number of components, devices, or systems. Although 23 through 25 and FIGS. 27A through 27T illustrate particular arrangements of certain components, devices, or systems, this disclosure contemplates any suitable arrangement of components, devices, or systems. Furthermore, although 23 through 25 and FIGS. 27A through 27T describe and illustrate particular components, devices, or systems carrying out particular actions, this disclosure contemplates any suitable combination of any suitable components, devices, or systems carrying out any suitable actions.

Figure 28:
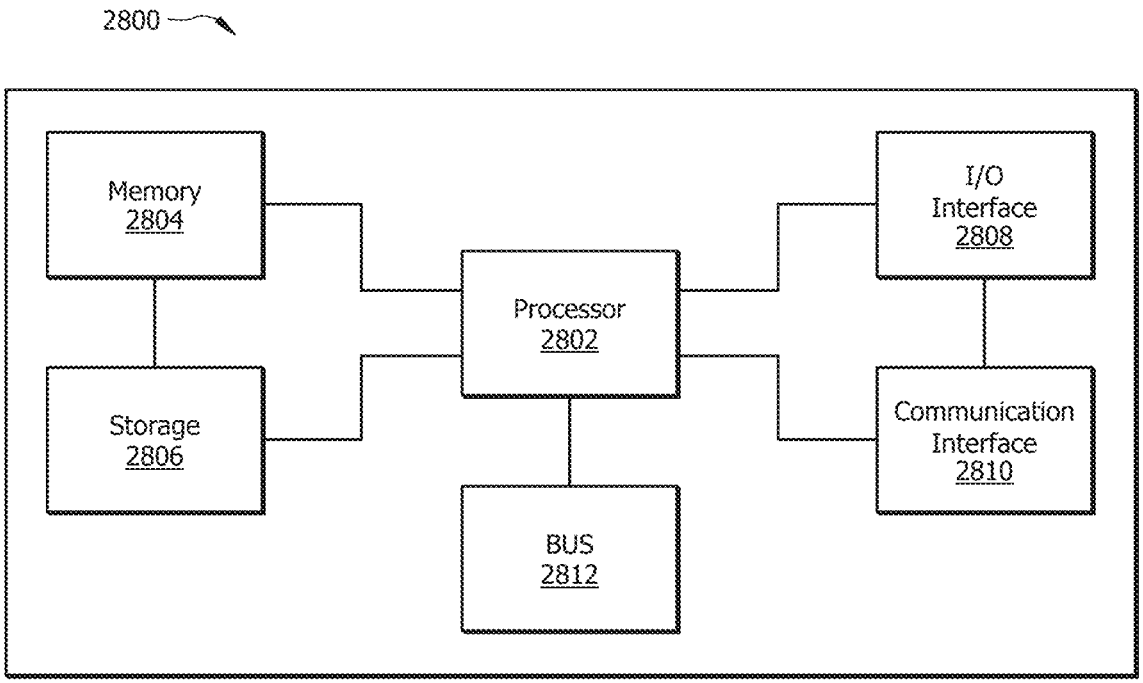
FIG. 28 illustrates an example computer system that may be used by the systems and methods described herein.

FIG. 28 illustrates an example computer system 2800 that may be used by the systems and methods described herein. One or more computer systems 2800 perform one or more steps of one or more methods described or illustrated herein. In particular embodiments, one or more computer systems 2800 provide functionality described or illustrated herein. In particular embodiments, software running on one or more computer systems 2800 performs one or more steps of one or more methods described or illustrated herein or provides functionality described or illustrated herein. Particular embodiments include one or more portions of one or more computer systems 2800. Herein, reference to a computer system may encompass a computing device, and vice versa, where appropriate. Moreover, reference to a computer system may encompass one or more computer systems, where appropriate.

This disclosure contemplates any suitable number of computer systems 2800. This disclosure contemplates computer system 2800 taking any suitable physical form. As example and not by way of limitation, computer system 2800 may be an embedded computer system, a system-on-chip (SOC), a single-board computer system (SBC) (such as, for example, a computer-on-module (COM) or system-on-module (SOM)), a desktop computer system, a laptop or notebook computer system, an interactive kiosk, a mainframe, a mesh of computer systems, a mobile telephone, a personal digital assistant (PDA), a server, a tablet computer system, or a combination of two or more of these. Where appropriate, computer system 2800 may include one or more computer systems 2800; be unitary or distributed; span multiple locations; span multiple machines; span multiple data centers; or reside in a cloud, which may include one or more cloud components in one or more networks. Where appropriate, one or more computer systems 2800 may perform without substantial spatial or temporal limitation one or more steps of one or more methods described or illustrated herein. As an example and not by way of limitation, one or more computer systems 2800 may perform in real time or in batch mode one or more steps of one or more methods described or illustrated herein. One or more computer systems 2800 may perform at different times or at different locations one or more steps of one or more methods described or illustrated herein, where appropriate.

In particular embodiments, computer system 2800 includes a processor 2802 a memory 2804, storage 2806, an input/output (I/O) interface 2808, a communication interface 2810, and a bus 2812. Although this disclosure describes and illustrates a particular computer system having a particular number of particular components in a particular arrangement, this disclosure contemplates any suitable computer system having any suitable number of any suitable components in any suitable arrangement.

In particular embodiments, processor 2802 includes hardware for executing instructions, such as those making up a computer program. As an example and not by way of limitation, to execute instructions, processor 2802 may retrieve (or fetch) the instructions from an internal register, an internal cache, memory 2804, or storage 2806; decode and execute them; and then write one or more results to an internal register, an internal cache, memory 2804, or storage 2806. In particular embodiments, processor 2802 may include one or more internal caches for data, instructions, or addresses. This disclosure contemplates processor 2802 including any suitable number of any suitable internal caches, where appropriate. As an example and not by way of limitation, processor 2802 may include one or more instruction caches, one or more data caches, and one or more translation lookaside buffers (TLBs). Instructions in the instruction caches may be copies of instructions in memory 2804 or storage 2806, and the instruction caches may speed up retrieval of those instructions by processor 2802. Data in the data caches may be copies of data in memory 2804 or storage 2806 for instructions executing at processor 2802 to operate on; the results of previous instructions executed at processor 2802 for access by subsequent instructions executing at processor 2802 or for writing to memory 2804 or storage 2806; or other suitable data. The data caches may speed up read or write operations by processor 2802. The TLBs may speed up virtual-address translation for processor 2802. In particular embodiments, processor 2802 may include one or more internal registers for data, instructions, or addresses. This disclosure contemplates processor 2802 including any suitable number of any suitable internal registers, where appropriate. Where appropriate, processor 2802 may include one or more arithmetic logic units (ALUs); be a multi-core processor; or include one or more processors 2802. Although this disclosure describes and illustrates a particular processor, this disclosure contemplates any suitable processor.

In particular embodiments, memory 2804 includes main memory for storing instructions for processor 2802 to execute or data for processor 2802 to operate on. As an example and not by way of limitation, computer system 2800 may load instructions from storage 2806 or another source (such as, for example, another computer system 2800) to memory 2804. Processor 2802 may then load the instructions from memory 2804 to an internal register or internal cache. To execute the instructions, processor 2802 may retrieve the instructions from the internal register or internal cache and decode them. During or after execution of the instructions, processor 2802 may write one or more results (which may be intermediate or final results) to the internal register or internal cache. Processor 2802 may then write one or more of those results to memory 2804. In particular embodiments, processor 2802 executes only instructions in one or more internal registers or internal caches or in memory 2804 (as opposed to storage 2806 or elsewhere) and operates only on data in one or more internal registers or internal caches or in memory 2804 (as opposed to storage 2806 or elsewhere). One or more memory buses (which may each include an address bus and a data bus) may couple processor 2802 to memory 2804. Bus 2812 may include one or more memory buses, as described below. In particular embodiments, one or more memory management units (MMUs) reside between processor 2802 and memory 2804 and facilitate accesses to memory 2804 requested by processor 2802. In particular embodiments, memory 2804 includes random access memory (RAM). This RAM may be volatile memory, where appropriate Where appropriate, this RAM may be dynamic RAM (DRAM) or static RAM (SRAM). Moreover, where appropriate, this RAM may be single-ported or multi-ported RAM. This disclosure contemplates any suitable RAM. Memory 2804 may include one or more memories 2804, where appropriate. Although this disclosure describes and illustrates particular memory, this disclosure contemplates any suitable memory.

In particular embodiments, storage 2806 includes mass storage for data or instructions. As an example and not by way of limitation, storage 2806 may include a hard disk drive (HDD), a floppy disk drive, flash memory, an optical disc, a magneto-optical disc, magnetic tape, or a Universal Serial Bus (USB) drive or a combination of two or more of these. Storage 2806 may include removable or non-removable (or fixed) media, where appropriate. Storage 2806 may be internal or external to computer system 2800, where appropriate. In particular embodiments, storage 2806 is non-volatile, solid-state memory. In particular embodiments, storage 2806 includes read-only memory (ROM). Where appropriate, this ROM may be mask-programmed ROM, programmable ROM (PROM), erasable PROM (EPROM), electrically erasable PROM (EEPROM), electrically alterable ROM (EAROM), or flash memory or a combination of two or more of these. This disclosure contemplates mass storage 2806 taking any suitable physical form. Storage 2806 may include one or more storage control units facilitating communication between processor 2802 and storage 2806, where appropriate. Where appropriate, storage 2806 may include one or more storages 2806. Although this disclosure describes and illustrates particular storage, this disclosure contemplates any suitable storage.

In particular embodiments, I/O interface 2808 (e.g., interface 256) includes hardware, software, or both, providing one or more interfaces for communication between computer system 2800 and one or more I/O devices. Computer system 2800 may include one or more of these I/O devices, where appropriate. One or more of these I/O devices may enable communication between a person and computer system 2800. As an example and not by way of limitation, an I/O device may include a keyboard, keypad, microphone, monitor, mouse, printer, scanner, speaker, still camera, stylus, tablet, touch screen, trackball, video camera, another suitable I/O device or a combination of two or more of these. An I/O device may include one or more sensors. This disclosure contemplates any suitable I/O devices and any suitable I/O interfaces 2808 for them. Where appropriate, I/O interface 2808 may include one or more device or software drivers enabling processor 2802 to drive one or more of these I/O devices. I/O interface 2808 may include one or more I/O interfaces 2808, where appropriate. Although this disclosure describes and illustrates a particular I/O interface, this disclosure contemplates any suitable I/O interface.

In particular embodiments, communication interface 2810 includes hardware, software, or both providing one or more interfaces for communication (such as, for example, packet-based communication) between computer system 2800 and one or more other computer systems 2800 or one or more networks. As an example and not by way of limitation, communication interface 2810 may include a network interface controller (NIC) or network adapter for communicating with an Ethernet or other wire-based network or a wireless NIC (WNIC) or wireless adapter for communicating with a wireless network, such as a WI-FI network. This disclosure contemplates any suitable network and any suitable communication interface 2810 for it. As an example and not by way of limitation, computer system 2800 may communicate with an ad hoc network, a personal area network (PAN), a local area network (LAN), a wide area network (WAN), a metropolitan area network (MAN), or one or more portions of the Internet or a combination of two or more of these. One or more portions of one or more of these networks may be wired or wireless. As an example, computer system 2800 may communicate with a wireless PAN (WPAN) (such as, for example, a BLUETOOTH WPAN), a WI-FI network, a WI-MAX network, a cellular telephone network (such as, for example, a Global System for Mobile Communications (GSM) network), or other suitable wireless network or a combination of two or more of these. Computer system 2800 may include any suitable communication interface 2810 for any of these networks, where appropriate. Communication interface 2810 may include one or more communication interfaces 2810, where appropriate. Although this disclosure describes and illustrates a particular communication interface, this disclosure contemplates any suitable communication interface.

In particular embodiments, bus 2812 includes hardware, software, or both coupling components of computer system 2800 to each other. As an example and not by way of limitation, bus 2812 may include an Accelerated Graphics Port (AGP) or other graphics bus, an Enhanced Industry Standard Architecture (EISA) bus, a front-side bus (FSB), a HYPERTRANSPORT (HT) interconnect, an Industry Standard Architecture (ISA) bus, an INFINIBAND interconnect, a low-pin-count (LPC) bus, a memory bus, a Micro Channel Architecture (MCA) bus, a Peripheral Component Interconnect (PCI) bus, a PCI-Express (PCIe) bus, a serial advanced technology attachment (SATA) bus, a Video Electronics Standards Association local (VLB) bus, or another suitable bus or a combination of two or more of these. Bus 2812 may include one or more buses 2812, where appropriate. Although this disclosure describes and illustrates a particular bus, this disclosure contemplates any suitable bus or interconnect.

The components of computer system 2800 may be integrated or separated. In some embodiments, components of computer system 2800 may each be housed within a single chassis. The operations of computer system 2800 may be performed by more, fewer, or other components. Additionally, operations of computer system 2800 may be performed using any suitable logic that may comprise software, hardware, other logic, or any suitable combination of the preceding.

The scope of this disclosure is not limited to the example embodiments described or illustrated herein. The scope of this disclosure encompasses all changes, substitutions, variations, alterations, and modifications to the example embodiments described or illustrated herein that a person having ordinary skill in the art would comprehend.

Modifications, additions, or omissions may be made to the systems and apparatuses described herein without departing from the scope of the disclosure. The components of the systems and apparatuses may be integrated or separated. Moreover, the operations of the systems and apparatuses may be performed by more, fewer, or other components. Additionally, operations of the systems and apparatuses may be performed using any suitable logic comprising software, hardware, and/or other logic.

Modifications, additions, or omissions may be made to the methods described herein without departing from the scope of the disclosure. The methods may include more, fewer, or other steps. Additionally, steps may be performed in any suitable order. That is, the steps of any method disclosed herein do not have to be performed in the exact order disclosed, unless explicitly stated.

As used in this document, "each" refers to each member of a set or each member of a subset of a set. Furthermore, as used in the document "or" is not necessarily exclusive and, unless expressly indicated otherwise, can be inclusive in certain embodiments and can be understood to mean "and/or." Similarly, as used in this document "and" is not necessarily inclusive and, unless expressly indicated otherwise, can be inclusive in certain embodiments and can be understood to mean "and/or." All references to "a/an/the element, apparatus, component, means, step, etc." are to be interpreted openly as referring to at least one instance of the element, apparatus, component, means, step, etc., unless explicitly stated otherwise.

Furthermore, reference to an apparatus or system or a component of an apparatus or system being adapted to, arranged to, capable of, configured to, enabled to, operable to, or operative to perform a particular function encompasses that apparatus, system, component, whether or not it or that particular function is activated, turned on, or unlocked, as long as that apparatus, system, or component is so adapted, arranged, capable, configured, enabled, operable, or operative.

Although several embodiments have been illustrated and described in detail, it will be recognized that substitutions and alterations are possible without departing from the spirit and scope of the present disclosure, as defined by the appended claims.

The invention claimed is:

1. A method of automated missile launcher reloading, comprising:
- aligning one or more collars of a shelving system with a path of a canister;
- activating one or more rollers of the shelving system to translate the canister into the one or more collars;
- coupling a first collar of the one or more collars to the canister;
- adjusting the one or more collars to align the canister with a path of a launcher cell; and
- translating the one or more collars into the path of the launcher cell to feed the canister into the launcher cell.

2. The method of claim 1, wherein aligning the one or more collars of the shelving system with the path of the canister comprises adjusting a positioning of one or more linear actuators and one or more overhead load-moving devices of the shelving system.

3. The method of claim 1, wherein coupling the first collar of the one or more collars to the canister comprises:
- engaging one or more clamps of the first collar; or
- applying brakes to the one or more rollers.

4. The method of claim 1, wherein adjusting the one or more collars to align the canister with the path of the launcher cell comprises rotating and tilting the one or more collars until the canister is aligned with an axis of the launcher cell.

5. The method of claim 1, further comprising:
- coupling one or more lifting lugs to the canister;
- lowering a push bar connected to a sliding beam of the shelving system to couple the push bar to the one or more lifting lugs; and
- translating the push bar along the sliding beam to fully position the canister within the launcher cell.

6. The method of claim 1, further comprising uncoupling the first collar from the canister after translating the one or more collars into the path of the launcher cell.

7. The method of claim 1, further comprising translating a sliding beam into the path of the launcher cell, wherein the sliding beam moves independently from the one or more collars and the canister.

8. A system, comprising:
- a shelving system comprising;
  - one or more collars; and
  - one or more rollers;
- a canister;
- a launcher cell; and
- a control system configured to provide control signals to the shelving system to control the one or more collars and the one or more rollers to perform actions comprising:
  - aligning the one or more collars of the shelving system with a path of the canister;
  - activating the one or more rollers of the shelving system to translate the canister into the one or more collars;
  - coupling a first collar of the one or more collars to the canister;
  - adjusting the one or more collars to align the canister with a path of the launcher cell; and
  - translating the one or more collars into the path of the launcher cell to feed the canister into the launcher cell.

9. The system of claim 8, wherein aligning the one or more collars of the shelving system with the path of the canister comprises adjusting a positioning of one or more linear actuators and one or more overhead load-moving devices of the shelving system.

10. The system of claim 8, wherein coupling the first collar of the one or more collars to the canister comprises:
- engaging one or more clamps of the first collar; or
- applying brakes to the one or more rollers.

11. The system of claim 8, wherein adjusting the one or more collars to align the canister with the path of the launcher cell comprises rotating and tilting the one or more collars until the canister is aligned with an axis of the launcher cell.

12. The system of claim 8, the actions further comprising:
- coupling one or more lifting lugs to the canister;
- lowering a push bar connected to a sliding beam of the shelving system to couple the push bar to the one or more lifting lugs; and
- translating the push bar along the sliding beam to fully position the canister within the launcher cell.

13. The system of claim 8, the actions further comprising uncoupling the first collar from the canister after translating the one or more collars into the path of the launcher cell.

14. The system of claim 8, the actions comprising translating a sliding beam into the path of the launcher cell, wherein the sliding beam moves independently from the one or more collars and the canister.

15. One or more computer-readable non-transitory storage media embodying instructions that, when executed by a processor, cause the processor to perform operations comprising:

aligning one or more collars of a shelving system with a path of a canister;

activating one or more rollers of the shelving system to translate the canister into the one or more collars;

coupling a first collar of the one or more collars to the canister;

adjusting the one or more collars to align the canister with a path of a launcher cell; and translating the one or more collars into the path of the launcher cell to feed the canister into the launcher cell.

16. The one or more computer-readable non-transitory storage media of claim 15, wherein aligning the one or more collars of the shelving system with the path of the canister comprises adjusting a positioning of one or more linear actuators and one or more overhead load-moving devices of the shelving system.

17. The one or more computer-readable non-transitory storage media of claim 15, wherein coupling the first collar of the one or more collars to the canister comprises:

engaging one or more clamps of the first collar; or applying brakes to the one or more rollers.

18. The one or more computer-readable non-transitory storage media of claim 15, wherein adjusting the one or more collars to align the canister with the path of the launcher cell comprises rotating and tilting the one or more collars until the canister is aligned with an axis of the launcher cell.

19. The one or more computer-readable non-transitory storage media of claim 15, the operations further comprising:

coupling one or more lifting lugs to the canister;

lowering a push bar connected to a sliding beam of the shelving system to couple the push bar to the one or more lifting lugs; and translating the push bar along the sliding beam to fully position the canister within the launcher cell.

20. The one or more computer-readable non-transitory storage media of claim 15, the operations further comprising uncoupling the first collar from the canister after translating the one or more collars into the path of the launcher cell.

* * * * *